US006544469B2

(12) United States Patent
Suzuki et al.

(10) Patent No.: US 6,544,469 B2
(45) Date of Patent: Apr. 8, 2003

(54) APPARATUS AND METHOD FOR PRODUCING METAL FORMED PRODUCT

(75) Inventors: Atsushi Suzuki, Utsunomiya (JP); Kazuya Sakamoto, Tochigi-ken (JP); Kenji Ohwada, Utsunomiya (JP); Tomonori Taoka, Koriyama (JP); Koichi Kuroki, Utsunomiya (JP); Takahiro Suenaga, Tochigi-ken (JP); Takashi Idegomori, Utsunomiya (JP); Kenichi Katahira, Utsunomiya (JP); Hideomi Ito, Tochigi-ken (JP); Akira Noda, Tochigi-ken (JP); Kazuaki Kobayashi, Tochigi-ken (JP); Masayoshi Kai, Iruma (JP); Shinji Kazama, Iruma (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 32 days.

(21) Appl. No.: 09/736,411

(22) Filed: Dec. 15, 2000

(65) Prior Publication Data

US 2001/0003931 A1 Jun. 21, 2001

(30) Foreign Application Priority Data

| | | |
|---|---|---|
| Dec. 16, 1999 | (JP) | 11-357375 |
| Dec. 16, 1999 | (JP) | 11-357384 |
| Dec. 16, 1999 | (JP) | 11-358025 |
| Dec. 16, 1999 | (JP) | 11-358031 |
| Dec. 22, 1999 | (JP) | 11-364759 |
| Apr. 14, 2000 | (JP) | 2000-114151 |

(51) Int. Cl.[7] ..... C21C 5/42

(52) U.S. Cl. ..... 266/142; 266/236; 266/242; 164/71.1; 164/900

(58) Field of Search ..... 266/142, 242, 266/236; 164/71.1, 900

(56) References Cited

U.S. PATENT DOCUMENTS 4,094,055 A 6/1978 Morimoto
5,533,562 A 7/1996 Moschini et al.
6,073,678 A * 6/2000 Garza-Ondarza et al. ... 164/130

FOREIGN PATENT DOCUMENTS

| | | |
|---|---|---|
| DE | 19807687 | 9/1999 |
| DE | 199 26 653 A1 | 12/2000 |
| EP | 0 745 694 A1 | 12/1996 |
| EP | 0 845 316 A1 | 6/1998 |
| EP | 0 903 193 A1 | 3/1999 |
| EP | 1050353 | 11/2000 |
| JP | A11-197814 | 7/1999 |
| WO | WO9710065 | 3/1997 |
| WO | WO9936209 | 7/1999 |

OTHER PUBLICATIONS

JP8215819, abstract only, Japan, Aug. 27, 1996.

JP56070925, abstract only, Japan, Jun. 13, 1981.

RU2009009, abstract only, Russian, Mar. 15, 1994.

* cited by examiner

*Primary Examiner*—Melvyn Andrews
(74) *Attorney, Agent, or Firm*—Birch, Stewart, Kolasch & Birch, LLP

(57) ABSTRACT

An apparatus for producing a metal formed product comprises a molten metal-holding furnace; a semisolidified metal-producing mechanism; a cooling member-restoring mechanism arranged adjacent to the semisolidified metal-producing mechanism, for applying a restoring treatment so that chillers have a desired function; a forming machine for forming semisolidified metal to have a predetermined shape; and an articulated robot capable of transporting a crucible to the molten metal-holding furnace, the semisolidified metal-producing mechanism, and the forming machine. The semisolidified metal-producing mechanism includes first to third agitators. The cooling member-restoring mechanism includes first to third treating sections. These components are arranged in a direction of back and forth movement of the articulated robot. Accordingly, it is possible to efficiently obtain the metal formed product having a high quality.

20 Claims, 41 Drawing Sheets

58
50
60
19

58
52
62a(b)
63
63
19

58
54
72
19

58
56
76
74
19

APPARATUS AND METHOD FOR PRODUCING METAL FORMED PRODUCT

BACKGROUND OF THE INVENTION

1. Field of the Invention

The present invention relates to an apparatus for producing a metal formed product, which is used in order to obtain a predetermined metal formed product from semisolidified metal.

2. Description of the Related Art

In general, an operation is performed, in which molten metal composed of, for example, aluminum, magnesium, or alloy of each of them is used to produce semisolidified metal, i.e., slurry in an amount of one shot for the forming process. It is known that the forming operation based on the use of the slurry is advantageous especially in that the surface accuracy and the internal quality of a formed product are excellent.

For example, a method has been suggested, in which slurried semisolidified metal is obtained by rotating a chiller cooled to have a temperature of not more than a temperature of molten metal, in the molten metal supplied to a heat-insulating crucible (vessel), and then the semisolidified metal is introduced from the heat-insulating crucible to a forming machine to apply a forming treatment so that a metal formed product having a predetermined shape is produced (see Japanese Laid-Open Patent Publication No. 11-197814).

In the case of the conventional technique described above, it is necessary to remove solidified matters adhered to the chiller, for example, aluminum solidified matters, after the semisolidified metal is obtained in accordance with the rotating action of the chiller in the heat-insulating crucible. Therefore, the chiller is usually removed from a rotary shaft, and the chiller is set to a restoring apparatus so that a predetermined restoring treatment is applied to the chiller by the aid of the restoring apparatus.

In this case, when the operation to apply an agitation treatment to the molten metal supplied to the heat-insulating crucible is completed, it is necessary that the chiller is installed to the restoring apparatus to apply the restoring treatment thereto. Therefore, it is required that the operation to exchange the chiller between the agitation apparatus and the restoring apparatus is frequently performed during the forming operation steps. The following problem is pointed out. That is, a considerable period of time is required for the restoring treatment for the chiller. The entire steps for producing the metal formed product are not efficiently performed.

In the conventional technique described above, when the semisolidified metal is introduced into the forming machine after the semisolidified metal is formed in accordance with the rotating action of the chiller in the heat-insulating crucible, it is necessary to apply a predetermined restoring treatment to the heat-insulating crucible before the next time forming operation is performed for another semisolidified metal. Specifically, the following treatments are performed, i.e., a treatment for removing solidified matters, for example, aluminum solidified matters adhered to the inner wall surface of the heat-insulating crucible, a treatment for adjusting the heat-insulating crucible to have a predetermined temperature, and a treatment for coating the inner wall surface of the heat-insulating crucible with a releasing agent.

However, the restoring treatment as described above is applied to the heat-insulating crucible every time when one time of the forming process for the semisolidified metal is completed. The forming operation for the metal formed product is stopped during the period of the restoring treatment. Therefore, the following problem is pointed out. That is, a long period of time is required to perform the forming cycle, and it is impossible to efficiently produce the metal formed product.

Further, the heat-insulating crucible is gripped by a wrist tip of a robot. The semisolidified metal in the heat-insulating crucible is introduced into the injection sleeve which constitutes the forming machine, by performing the rotary action in accordance with the driving action of the robot. Specifically, as shown in FIG. 40, an opening 2 for introducing the slurry is formed on the upper side of an injection sleeve 1 which constitutes a forming machine. A heat-insulating crucible 3, which is gripped by the wrist tip of the robot, is rotated about a center of a rotation axis 4. Accordingly, the semisolidified metal 5 in the heat-insulating crucible 3 is introduced into the injection sleeve 1 through the opening 2.

However, as described above, the heat-insulating crucible 3 is rotated at a constant rotation speed about the center of the rotation axis 4. Therefore, it is extremely difficult to control the falling position of the semisolidified metal 5 in the heat-insulating crucible 3. That is, the angle position for the semisolidified metal 5 to fall from the inside of the heat-insulating crucible 5 tends to vary every time when the introduction is performed. For example, the following situations sometimes occur. That is, the semisolidified metal 5 falls when the heat-insulating crucible 3 is arranged at an angle position P1 (see dashed lines), or the semisolidified metal 5 falls when the heat-insulating crucible 3 is arranged at an angle position P2 (see two-dot chain lines).

As a result, the falling position of the semisolidified metal 5 is diversely varied, and it is difficult to introduce the all amount of the semisolidified metal 5 through the opening 2 into the injection sleeve 1. Further, it is feared that the semisolidified metal 5 remains in the heat-insulating crucible 3. Therefore, a problem is pointed out such that it is impossible to efficiently supply the semisolidified metal 5 to the injection sleeve 1.

On the other hand, the heat-insulating crucible 3 is designed to have a rectangular parallelepiped-shaped configuration corresponding to the shape of the semisolidified metal 5 to be introduced into the injection sleeve 1 which constitutes the forming machine. Therefore, a both-side support hand structure, which supports both ends of the heat-insulating crucible 3 in the longitudinal direction, is usually constructed at the wrist tip of the robot for handling the heat-insulating crucible.

The both-side support hand structure protrudes in a relatively lengthy configuration from the wrist tip of the robot, even when the heat-insulating crucible 3 is not gripped. The interference range of the both-side support hand structure itself is considerably large. For this reason, the following problems are pointed out. That is, it is impossible to move the wrist of the robot in a shortest distance, and it is impossible to shorten the cycle time.

Further, when the semisolidified metal 5 is introduced into the injection sleeve 1, the both-side support hand structure and the forming machine tend to interfere with each other. A problem arises such that the heat-insulating crucible 3 cannot be moved to the position close to the opening 2 of the injection sleeve 1 with ease. Therefore, the semisolidified metal 5 in the heat-insulating crucible 3 must be introduced into the opening 2 at the upward position which is separated from the injection sleeve 1 relatively greatly. A problem arises such that any defective introduction of the semisolidified metal 5 is apt to occur.

On the other hand, as shown in FIG. 41, a plunger 6 is provided at the first end of the injection sleeve 1. The semisolidified metal 5, which has been introduced into the injection sleeve 1, is introduced under pressure into an unillustrated cavity in accordance with the movement of the plunger 6 in the direction of the arrow.

However, in the case of the forming machine described above, the following inconvenience arises. That is, the injection condition for the injection into the cavity is dispersed depending on variations of the sleeve filling rate R and the solidus rate of the semisolidified metal 5. In this case, the volume V of the space portion, which is expressed by the length L of the opening 2 and the inner diameter D of the injection sleeve 1, is $V=\pi(D/2)^2L$. The weight Ws, which is obtained when all of the space portion having the volume V is occupied by the semisolidified metal 5, is represented by Ws=2.6V (specific gravity of aluminum molten metal: 2.6). Assuming that the practical casting weight is W, the sleeve filling rate R is defined to be $R=(W/Ws)\times 100$ (%).

In this case, when the sleeve filling rate R is increased, it is feared that an upper portion of the semisolidified metal 5 is spilled out from the opening 2 to the outside of the injection sleeve 1, when the semisolidified metal 5 is injected by applying the pressure with the plunger 6. Further, it is feared that the semisolidified metal 5 overflows from the opening 2, when the semisolidified metal 5 is introduced through the opening 2 into the injection sleeve 1.

On the other hand, when the solidus rate of the semisolidified metal 5 is increased, the semisolidified metal 5 introduced into the injection sleeve 1 overflows from the opening 2. It is feared that when the semisolidified metal 5 is introduced into the opening 2, then the semisolidified metal 5 falls in a transport shape as it is, and the semisolidified metal 5 is not introduced into the opening 2. Therefore, the following problem is pointed out. That is, the injection condition for the injection into the cavity is dispersed, and the product quality is unstable.

When the semisolidified metal 5 is introduced into the injection sleeve 1, a flow like the flow of molten metal tends to be caused. Therefore, it is feared that when the semisolidified metal 5 is injected by applying the pressure with the plunger 6, an upper portion of the semisolidified metal 5 is spilled out from the opening 2 of the injection sleeve 1 to the outside of the injection sleeve 1. Therefore, the following problem is pointed out. That is, the injection condition for the injection into the cavity is dispersed, and the product quality is unstable.

SUMMARY OF THE INVENTION

A general object of the present invention is to provide an apparatus for producing a metal formed product, which has a simple structure and which makes it possible to efficiently produce the metal formed product.

A principal object of the present invention is to provide an apparatus for producing a metal formed product, which makes it possible to perform the entire forming operation efficiently and quickly without being affected by a restoring treatment for a vessel.

Another principal object of the present invention is to provide an apparatus for producing a metal formed product, which makes it possible to shorten the cycle time with a simple structure and which makes it possible to effectively avoid the interference with the equipment so that the metal formed product is produced efficiently and highly accurately.

Still another principal object of the present invention is to provide an apparatus for producing a metal formed product, which makes it possible to efficiently obtain the formed product having a stable quality without being affected by the sleeve filling rate and the solidus rate of solid-liquid co-existing metal.

Still another principal object of the present invention is to provide an apparatus and a method for producing a metal formed product, which make it possible to reliably fill a cavity with solid-liquid co-existing metal and efficiently obtain the formed product having a stable quality.

Still another principal object of the present invention is to provide a method for producing a metal formed product, which makes it possible to introduce solid-liquid co-existing metal from a vessel into an injection sleeve quickly and reliably.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
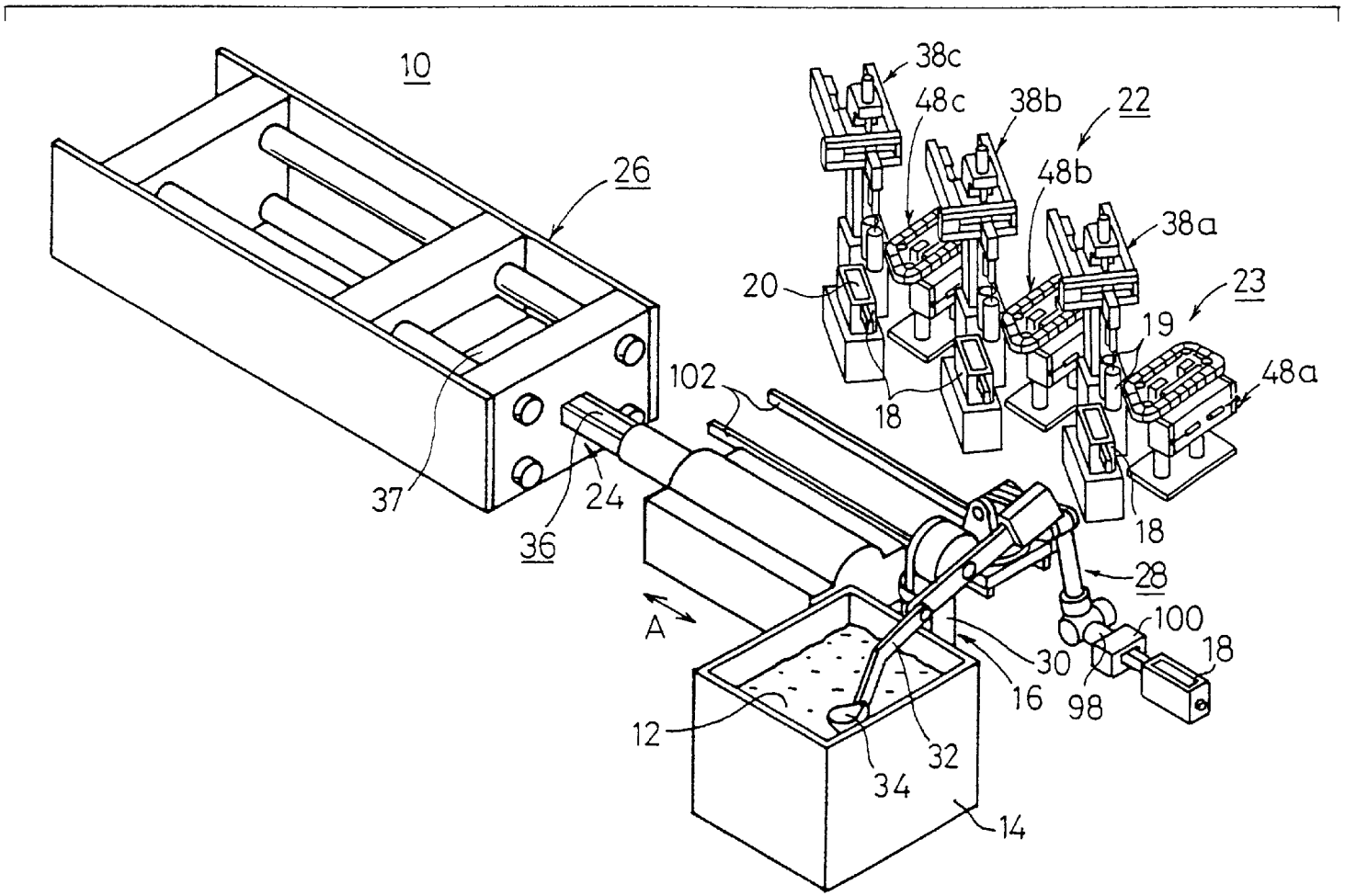
FIG. 1 shows a schematic perspective view illustrating an apparatus for producing a metal formed product according to a first embodiment of the present invention.
Figure 2:
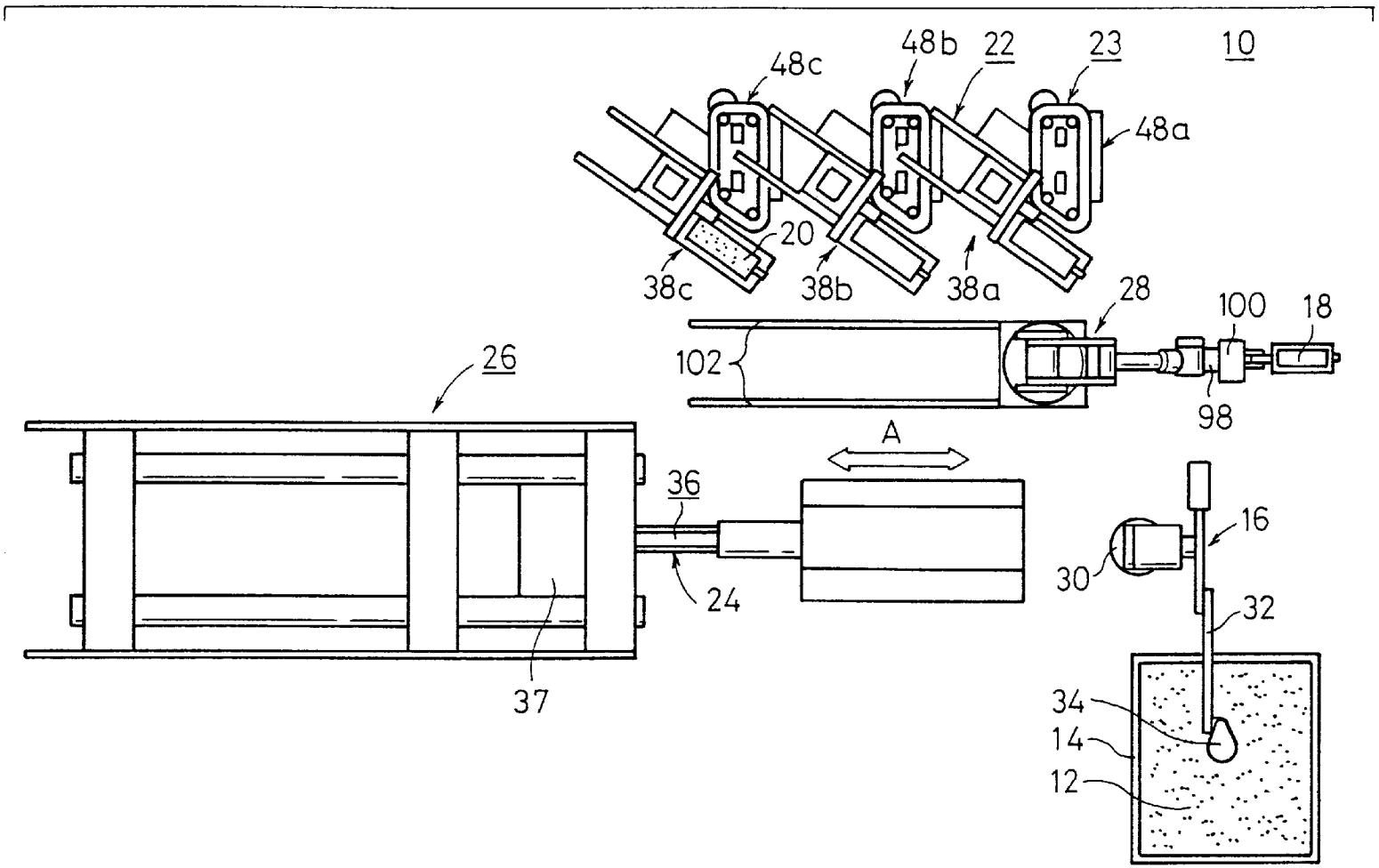
FIG. 2 shows a plan view illustrating the production apparatus shown in FIG. 1.

FIG. 1 shows a schematic perspective view illustrating an apparatus 10 for producing a metal formed product according to a first embodiment of the present invention, and FIG. 2 shows a plan view illustrating the production apparatus 10.

The production apparatus 10 comprises a molten metal-holding furnace 14 for holding molten metal 12 composed of melted metal such as aluminum, alloy thereof, magnesium, and alloy thereof; a molten metal-ladling robot 16 for ladling a predetermined amount (amount of one shot) of the molten metal 12 from the inside of the molten metal-holding furnace 14; a semisolidified metal-producing mechanism 22 which is provided with a heat-insulating crucible (vessel) 18 for pouring the molten metal 12 ladled by the molten metal-ladling robot 16 thereinto so that the molten metal 12 in the crucible 18 is agitated with chillers (cooling members) 19 to give a slurry state in order to obtain semisolidified metal 20 as solid-liquid co-existing metal; a cooling member-restoring mechanism 23 which is arranged adjacent to the semisolidified metal-producing mechanism 22, for applying a restoring treatment so that the chillers 19 have a desired function; a forming machine (forming mechanism) 26 which has an injection sleeve 24 into which the semisolidified metal 20 is introduced, for forming the semisolidified metal 20 to have a predetermined shape; and an articulated robot 28 which is capable of transporting the crucible 18 to the molten metal-holding furnace 14, the semisolidified metal-producing mechanism 22, and the forming machine 26.

The molten metal-ladling robot 16 comprises an arm 32 which is provided swingably on a support pillar 30. A ladle 34 is tiltably installed to a forward end of the arm 32. An opening 36 for introducing the slurry is formed at an upper portion of the injection sleeve 24 which constitutes the forming machine 26. The opening 36 communicates with an unillustrated cavity which is formed at the inside of a mold 37.

The semisolidified metal-producing mechanism 22 includes first to third agitators 38*a* to 38*c* in each of which the crucible 18 is arranged to cool and agitate the molten metal 12 in the crucible 18. The first to third agitators 38*a* to 38*c* are constructed in the same manner. The following explanation will be made principally using the first agitator 38*a* as an example.

Figure 3:
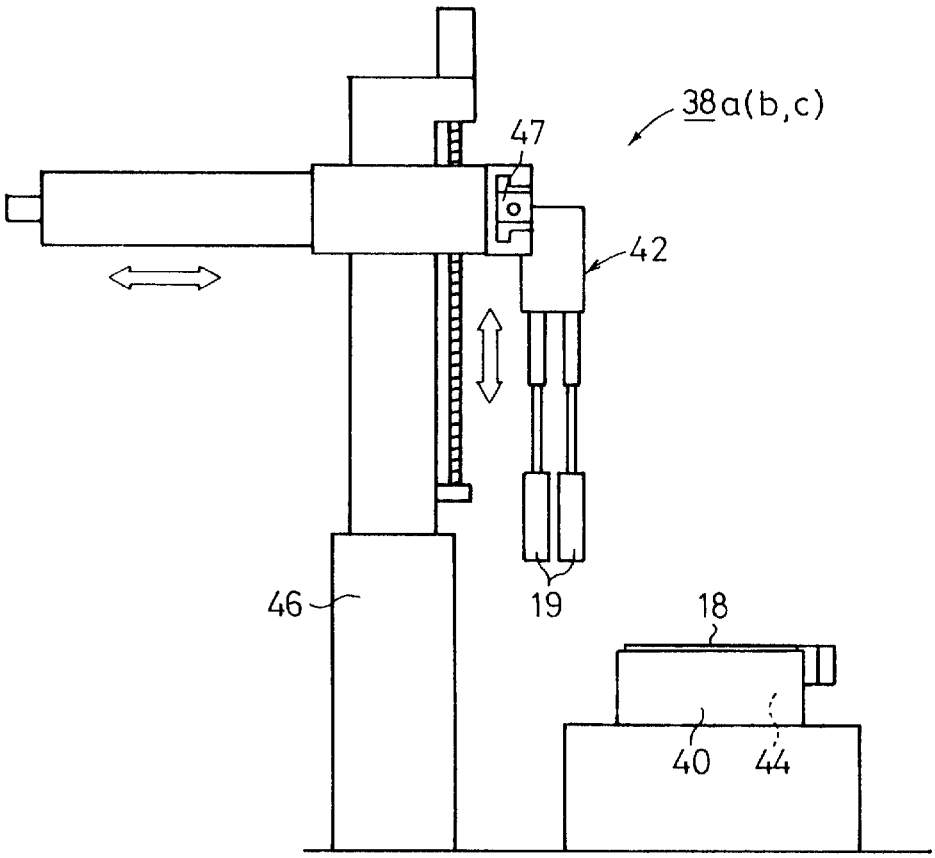
FIG. 3 shows a front view illustrating an agitator which constitutes the production apparatus shown in FIG. 1.

As shown in FIG. 3, the first agitator 38*a* includes a crucible-receiving stand 40 for disengageably arranging the crucible 18, and a driving section 42 for rotating the chillers 19 in the molten metal 12 in the crucible 18. A heater 44 is embedded at the inside of the crucible-receiving stand 40 so that the crucible 18 is surrounded thereby.

The chiller 19 is composed of, for example, a material such as copper and stainless steel which is not melted at the molten metal temperature of, for example, the aluminum molten metal to be used as the molten metal 12. The contour of the chiller 19 is designed to have a columnar configuration, and it has a draft downwardly.

The driving section 42 is provided with a three-axis robot 47 which is installed to a support pillar 46 and which is movable in three-axis directions of the X axis, Y axis, and the Z axis. The two chillers 19 are detachably installed to forward ends of the three-axis robot 47. The chillers 19 are driven and rotated by the aid of the three-axis robot 47. The chillers 19 are removed from the three-axis robot 47, and they are fed to the cooling member-restoring mechanism 23, every time when the molten metal 12 is agitated and cooled (every time when the operation is performed for one shot).

The cooling member-restoring mechanism 23 includes first to third treating sections 48*a*, 48*b*, 48*c* which are arranged closely to the first to third agitators 38*a* to 38*c*. As shown in FIG. 4 and FIGS. 5A to 5D, the first treating section 48*a* comprises a cooling means 50 for applying a cooling treatment to the chiller 19, a solidified matter-removing means 52 for removing aluminum solidified matters adhered to the surface of the chiller 19, a coating means 54 for coating the chiller 19 with a ceramic material, a drying means 56 for applying a drying treatment to the chiller 19, and a transport means 58 to which the chiller 19 is detachably attached and which is capable of gripping and transporting the chiller 19 successively to the cooling means 50, the solidified matter-removing means 52, the coating means 54, and the drying means 56.

Figure 6:
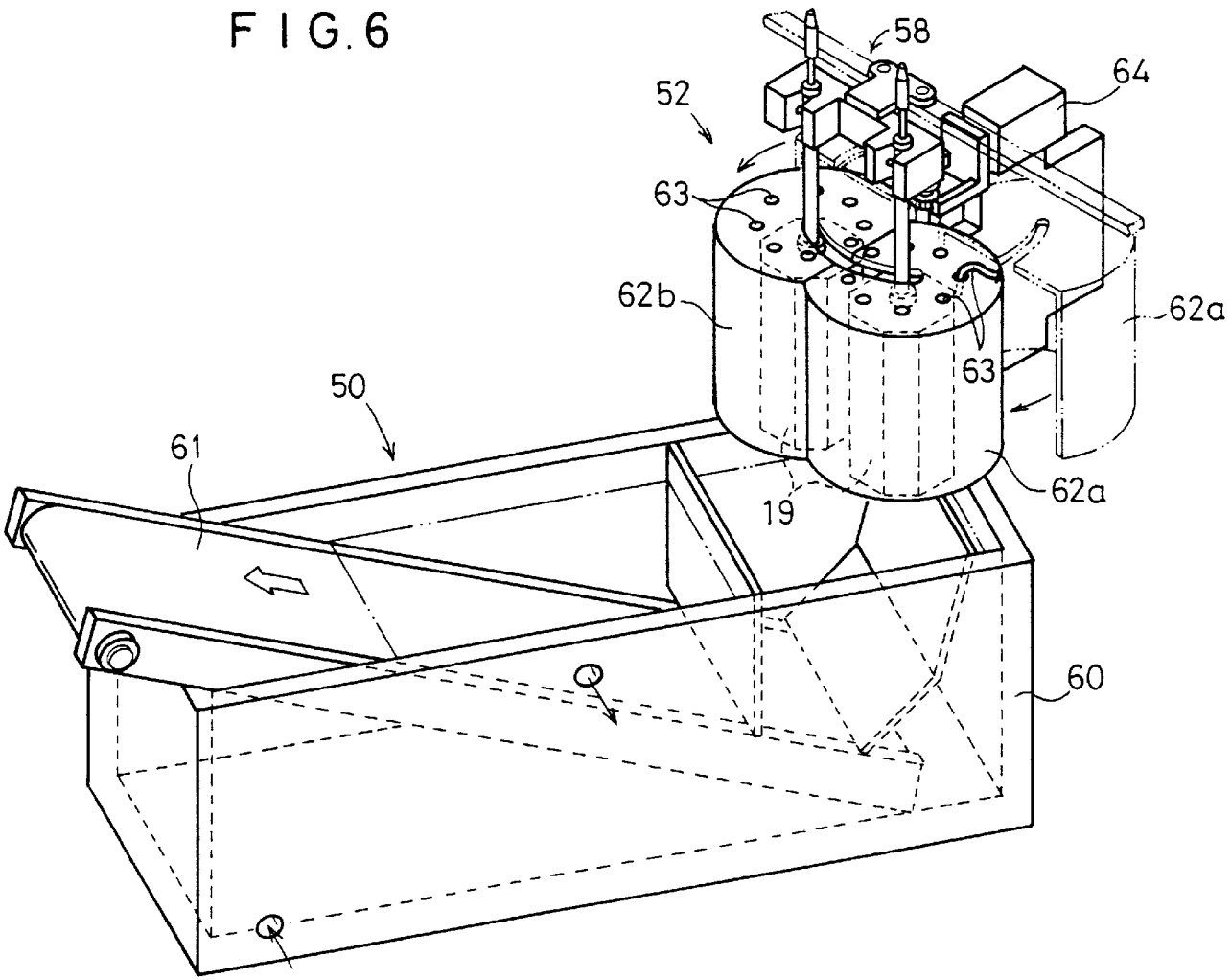
FIG. 6 shows a schematic view illustrating a cooling means and a solidified matter-removing means which constitute the cooling member-restoring mechanism.

As shown in FIG. 6, the cooling means 50 is provided with a cooling tank 60 for simultaneously cooling the two chillers 19 with a cooling medium such as cooling oil. A discharge conveyer 61 for discharging aluminum solidified matters is arranged in the cooling tank 60. Air blow casings 62*a*, 62*b*, which constitute the solidified matter-removing means 52, are arranged over the cooling tank 60 so that they are openable/closable by the aid of an actuator 64. The actuator 64 is fixed to the support pillar 46 which supports the three-axis robot 47 (see FIG. 4). A plurality of air blow nozzles 63 for removing the aluminum solidified matters adhered to the chillers 19 are arranged at upper portions at the inside of the casings 62*a*, 62*b* (see FIG. 6).

Figure 4:
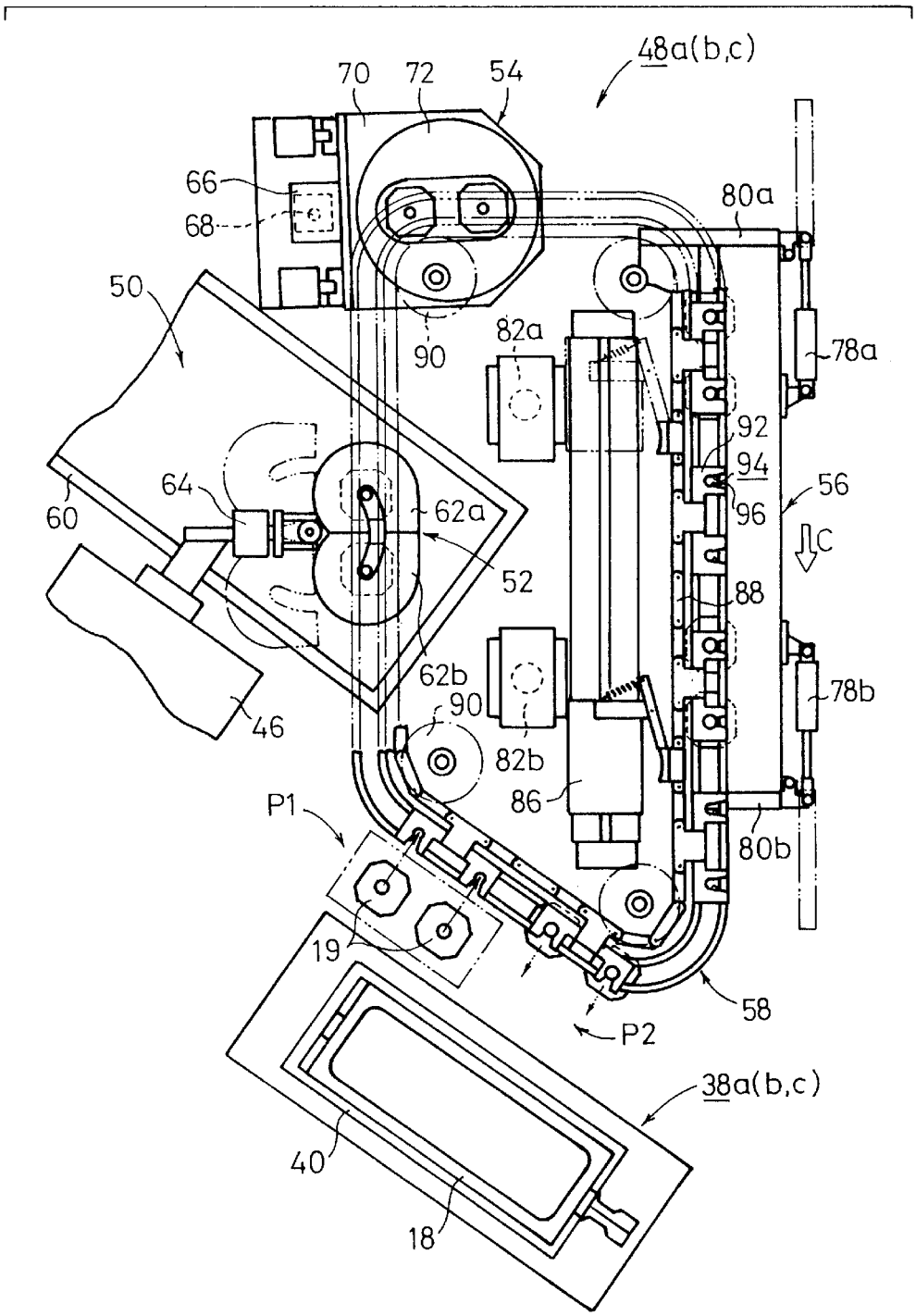
FIG. 4 shows a plan view illustrating a cooling member-restoring mechanism which constitutes the production apparatus shown in FIG. 1.
Figure 7:
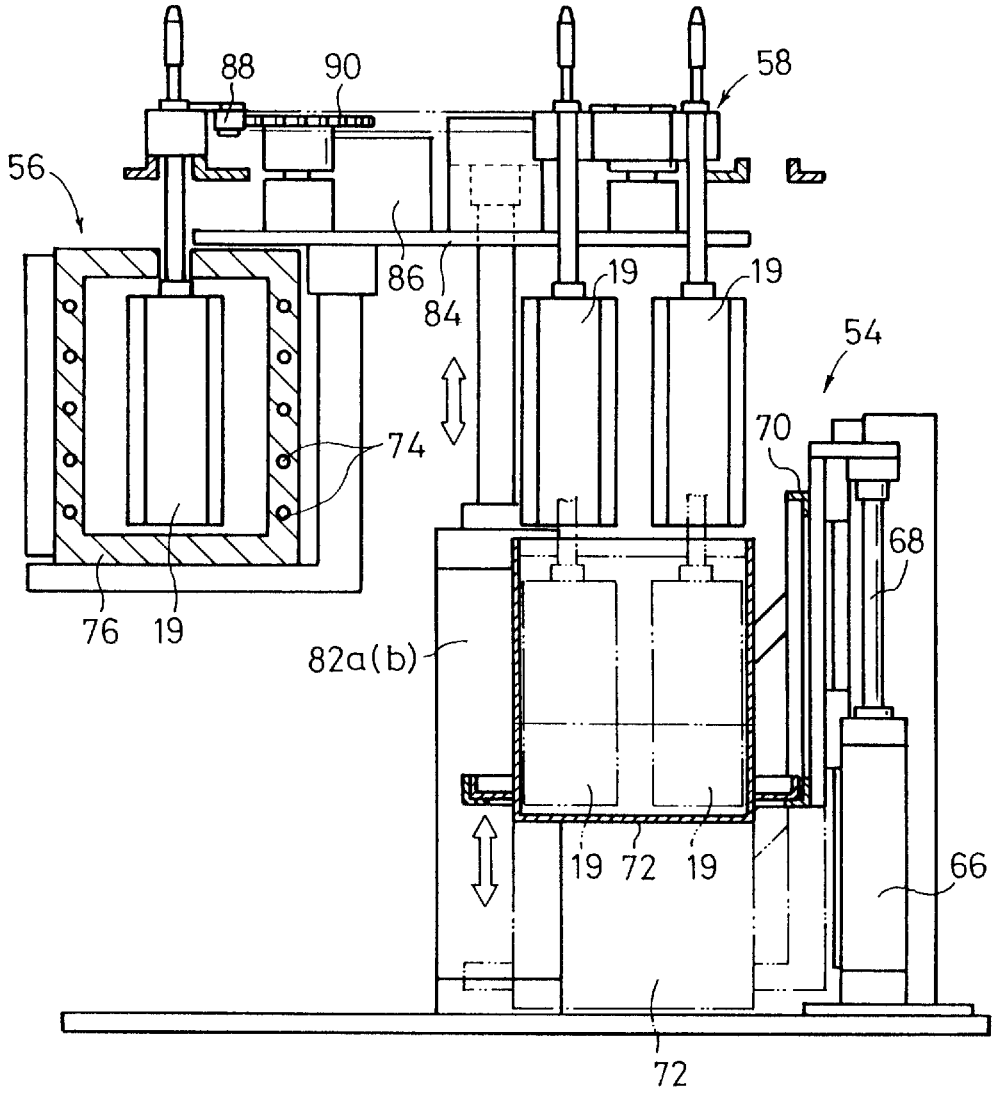
FIG. 7 shows a front view illustrating a coating means and a drying means which constitute the cooling member-restoring mechanism.

As shown in FIGS. 4 and 7, the coating means 54 is provided with an upward/downward movement cylinder 66. A coating tank 72 is supported by a rod 68 which extends upwardly from the upward/downward movement cylinder 66, by the aid of an attachment member 70. A coating liquid composed of a ceramic material is stored in the coating tank 72. The coating tank 72 is constructed so that it is movable upwardly/downwardly singly by the aid of the upward/downward movement cylinder 66, in order to change the coating time for the chillers 19.

As shown in FIGS. 4 and 7, the drying means 56 includes a drying preheating furnace 76 for drying the chillers 19 after the coating treatment with a heater 74. Lid members 80*a*, 80*b*, which are openable/closable by the aid of cylinders 78*a*, 78*b* respectively, are provided on the inlet side and on the outlet side of the drying preheating furnace 76.

The transport means 58 is provided with a base stand 84 which is elevatable by the aid of elevator cylinders 82*a*, 82*b*. A chain 88, which is capable of circumscribing running by the aid of a rodless cylinder 86 that is movable back and forth in the horizontal direction, is provided on the base stand 84. The chain 88 is supported by a plurality of sprockets 90. A plurality of plate members 92 are connected to the chain 88.

The plate member 92 is provided with a recess 94 into which the chiller 19 is inserted. The chiller 19 is held by the recess 94 by the aid of a ball plunger 96. The rodless cylinder 86 is movable back and forth at a constant stroke. The rodless cylinder 86 is constructed such that it is engaged with the chain 88 only when it is moved in one direction, and thus the chain 88 is moved in the direction of the arrow C by a constant distance.

As shown in FIGS. 1 and 2, the articulated robot 28 constitutes, for example, a six-axis robot. A gripping section 100, which is capable of holding the crucible 18, is installed to a wrist 98. The articulated robot 28 is arranged so that is it movable linearly back and forth along rails 102 between the molten metal-holding furnace 14 and the forming machine 26. The first to third agitators 38*a* to 38*c* and the first to third treating sections 48*a* to 48*c* are arranged along the rails 102.

The operation of the production apparatus 10 constructed as described above will be explained below.

At first, the molten metal-ladling robot 16 is driven in a state in which the molten metal 12 is heated and held at about 650° C. in the molten metal-holding furnace 14. The molten metal-ladling robot 16 is operated as follows. That is, the ladle 34 is inserted into the molten metal-holding furnace 14 in accordance with the action of the arm 32. The ladle 34 is tilted, and thus the molten metal 12 in an amount of one shot is ladled by the ladle 34. The ladle 34, with which the molten metal 12 has been ladled, is moved to the pouring position for the molten metal 12. On the other hand, the articulated robot 28, which holds the empty crucible 18 by the aid of the gripping section 100, is arranged at the pouring position.

When the ladle 34 is tilted to pour the molten metal 12 in the amount of one shot into the crucible 18, the articulated robot 28 arranges the crucible 28 at a predetermined position of any one of the first to third agitators 38*a* to 38*c*, for example, on the crucible-receiving stand 40 which constitutes the first agitator 38*a*. In the crucible-receiving stand 40, the heater 44 is operated to previously maintain a predetermined temperature so that the molten metal 12 in the crucible 18 is prevented from quick cooling by the surroundings.

As for the first agitator 38*a*, the two chillers 19 are previously heated and held at about 100° C. in order to remove water and stabilize the cooling condition. The chillers 19 are immersed in the molten metal 12 in the crucible 18, while being rotated in a predetermined direction at a relatively low speed by the aid of the three-axis robot 47. After that, the rotation speed of the chillers 19 in the molten metal 12 is increased in accordance with the action of the three-axis robot 47. Accordingly, the molten metal 12 is quickly agitated while effecting cooling.

After the chillers 19 agitate the molten metal 12 for a preset period of time or until a slurry supply signal is inputted, the chillers 19 are pulled up from the crucible 18 while being rotated. Accordingly, the semisolidified metal 20, which is maintained at a constant temperature as a whole, is produced in the heat-insulating crucible 18.

On the other hand, the articulated robot 28 is moved corresponding, for example, to the second agitator 38*b* which possesses the semisolidified metal 20 cooled and agitated to give a desired slurry state, of the first to third agitators 38*a* to 38*c*. As for the second agitator 38*b*, the three-axis robot 47 waits at a position thereover, and the chillers 19 are removed therefrom. The articulated robot 28 grips the crucible 18 arranged on the crucible-receiving stand 40 of the second agitator 38*b* so that the crucible 18 is taken out from the second agitator 38*b*.

The articulated robot 28 arranges the crucible 18 gripped by the gripping section 100 with respect to the opening 36 of the forming machine 26, and then it inverts the crucible 18. Accordingly, the semisolidified metal 20 in the crucible 18 falls, and it is supplied to the opening 36. The forming treatment is performed with the semisolidified metal 20 in the forming machine 26. Thus, a predetermined formed product is obtained.

The articulated robot 28 moves the empty crucible 18 to an air blow position to apply the air blow treatment thereto. Accordingly, any aluminum, which remains in the heat-insulating crucible 18, is removed. Subsequently, the interior of the crucible 18 is subjected to coating with a ceramic material or the like, and then the crucible 18 is arranged at the pouring position.

As for the first agitator 38*a*, the chillers 19, which are taken out upwardly after performing the cooling and the agitation for the molten metal 12, are moved by the three-axis robot 47 toward the first treating section 48*a* which constitutes the cooling member-restoring mechanism 23. As shown in FIG. 4, in the first treating section 48*a*, the two chillers 19 are delivered from the three-axis robot 47 to the transport means 58 at a delivery position P1 provided for the transport means 58. Each of the chillers 19 is inserted into the recess 94 which is provided for the plate member 92 for constructing the transport means 58, and the chiller 19 is held by the plate member 92 by the aid of the ball plunger 96.

The three-axis robot 47 is arranged at a predetermined waiting position after the chillers 19 are delivered to the transport means 58. On the other hand, in the transport means 58, the chain 88 is intermittently transported in the direction of the arrow C in accordance with the action of the rodless cylinder 86. The two chillers 19, which have been delivered at the delivery position P1, are firstly arranged over the cooling means 50. Accordingly, the elevator cylinders 82*a*, 82*b* are driven, and the base stand 84 is moved in the downward direction. The two chillers 19, which are held by the transport means 58, are immersed in the cooling tank 60 which constitutes the cooling means 50 so that the cooling treatment is applied thereto (see FIG. 5A).

Subsequently, the base stand 84 is moved upwardly by the aid of the elevator cylinders 82*a*, 82*b*. The two chillers 19 are arranged corresponding to the solidified matter-removing means 52. As shown in FIG. 6, in the solidified matter-removing means 52, the casings 62*a*, 62*b* make the swinging movement in the direction to cause approach to one another in accordance with the action of the actuator 64. The two chillers 19 are accommodated in the casings 62*a*, 62*b*. In this state, the air is jetted toward the respective chillers 19 from the plurality of air blow nozzles 63. The aluminum solidified matters, which adhere to the surfaces of the chillers 19, are removed (see FIG. 5B).

The aluminum solidified matters, which have been removed from the surfaces of the chillers 19 by the solidified matter-removing means 52 and the cooling means 50, are discharged to the outside by the aid of the discharge conveyer 61 arranged in the cooling tank 60. The casings 62*a*, 62*b* makes the swinging movement to cause separation from each other, and then the two chillers 19 are arranged corresponding to the coating means 54 by the aid of the transport means 58.

In the coating means 54, as shown in FIG. 7, the coating tank 72 is arranged at the upward movement end position. The two chillers 19 are moved downwardly integrally with the base stand 84 in accordance with the action of the elevator cylinders 82*a*, 82*b*, and the chillers 19 are immersed in the coating liquid in the coating tank 72. Accordingly, the surfaces of the chillers 19 are coated with the ceramic material (see FIG. 5C). In this process, when the coating is changed to be performed for a short period of time, the upward/downward movement cylinder 66 is driven. The coating tank 72 is moved downwardly by the aid of the rod 68 and the attachment member 70, and the chillers 19 are separated from the coating liquid.

Figures 5A, 5B, 5C, 5D:
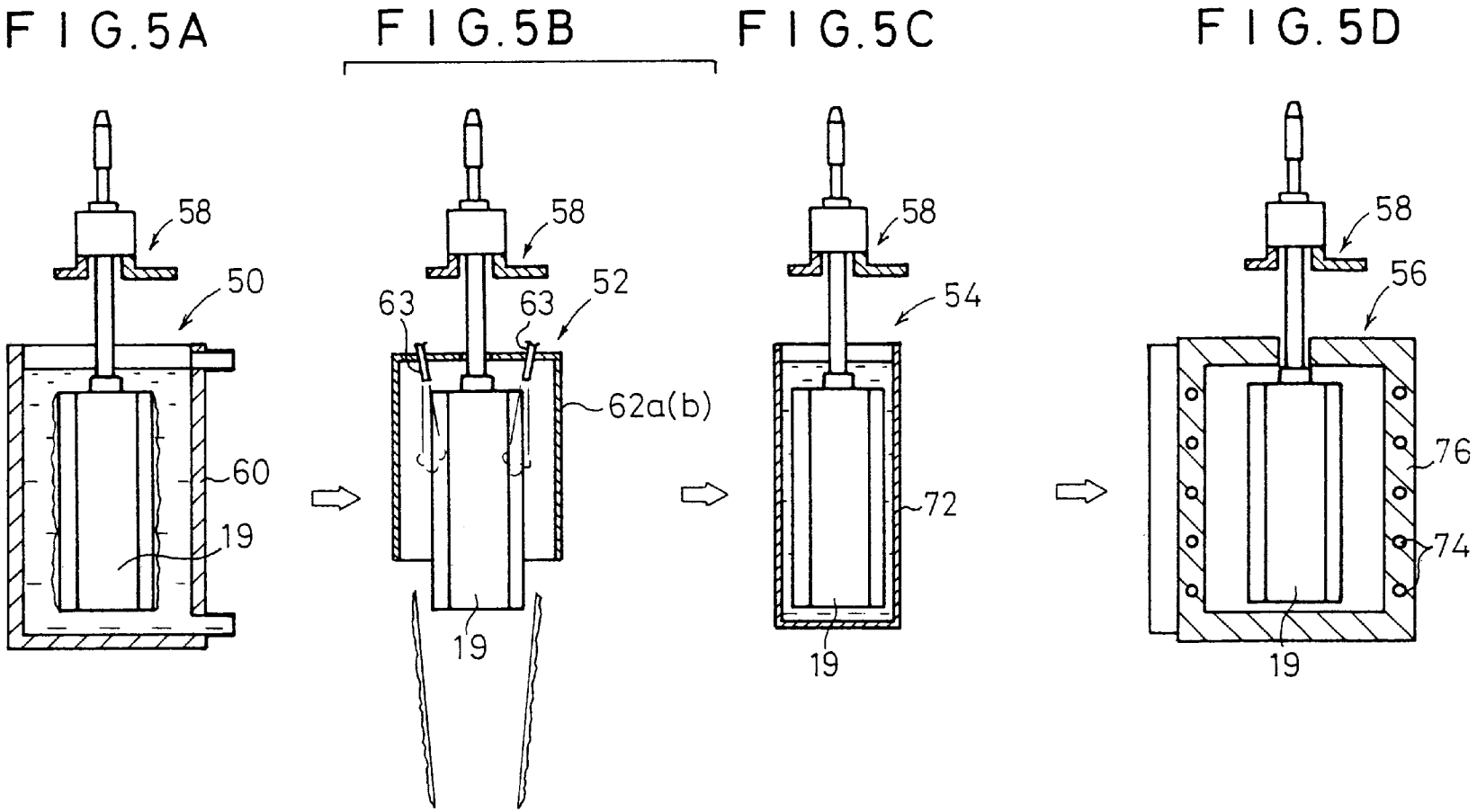
FIGS. 5A–5D illustrate the operation of the cooling member-restoring mechanism.

The chillers 19 after the coating treatment are transported to the drying means 56 by the aid of the transport means 58. The lid member 80*a*, which constitutes the drying means 56, is opened/closed by the aid of the cylinder 78*a*. Accordingly, the chillers 19 are imported into the drying preheating furnace 76. As shown in FIG. 5D, the heater 74 is provided in the drying preheating furnace 76. The drying treatment is applied to the chillers 19, and the chillers 19 are preheated to a predetermined temperature.

As shown in FIG. 4, the chillers 19 after the drying treatment are led from the drying preheating furnace 76 in accordance with the opening/closing action of the lid member 80*b*, and they are arranged at the receiving position P2. At the receiving position P2, the three-axis robot 47 receives the chillers 19 to which the predetermined restoring treatment has been applied. The cooling and agitating treatments for the molten metal 12 are performed by the first agitator 38*a* by using the chillers 19.

In the first embodiment, as shown in FIGS. 1 and 2, the articulated robot 28 is arranged so that it is movable linearly back and forth in the direction of the arrow A by the aid of the rails 102 between the molten metal-holding furnace 14 and the forming machine 26. The first to third agitators 38*a* to 38*c* for constructing the semisolidified metal-producing mechanism 22 and the first to third treating sections 48*a* to 48*c* for constructing the cooling member-restoring mechanism 23 are arranged in the direction of the back and forth movement of the articulated robot 28.

Accordingly, the following effect is obtained. That is, the control of the articulated robot 28 is simplified, and the crucible 18 can be transported quickly in the shortest distance by the aid of the articulated robot 28. It is easy to realize the efficient entire operation for producing the metal formed product.

Further, the first to third treating sections 48*a* to 48*c* are arranged closely to the first to third agitators 38*a* to 38*c*. The three-axis robot 47, which constitutes each of the driving sections 42, delivers the chillers 19 to the first to third treating sections 48*a* to 48*c* every time when the molten metal 12 is cooled and agitated with the first to third agitators 38*a* to 38*c* respectively, and thus the restoring treatment for the chillers 19 is immediately started. Accordingly, the entire operation of the restoring treatment for the chillers 19 is performed automatically and efficiently. An advantage is obtained such that the metal formed product having a high quality can be produced highly efficiently.

In the first embodiment, the air blow means (air blow nozzle 63) is used as the solidified matter-removing means 52 for removing the aluminum solidified matters adhered to the surfaces of the chillers 19. However, in place of the air blow means, it is possible to use, for example, a vibration-generating means or a sandblast means.

Figure 8:
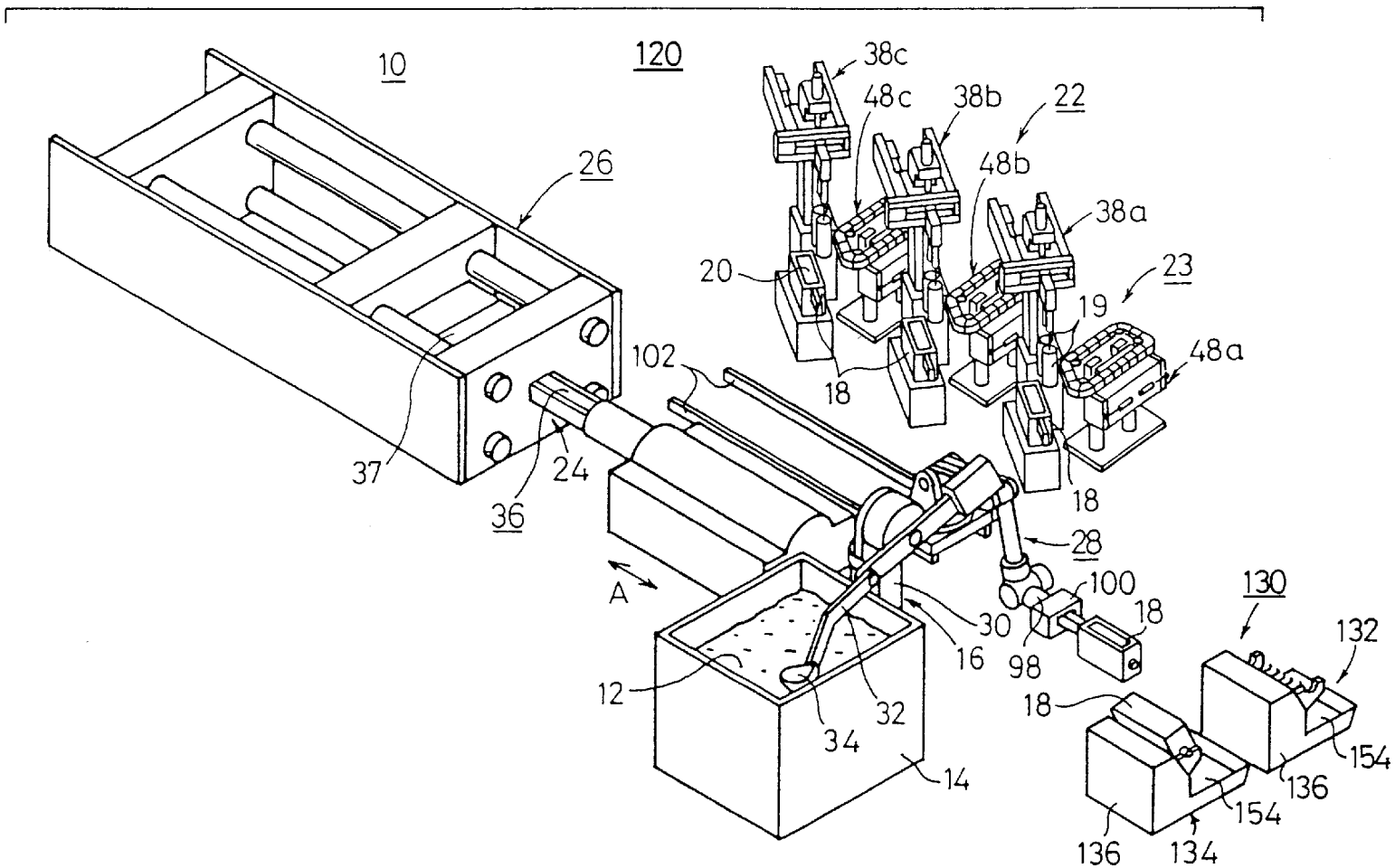
FIG. 8 shows a schematic perspective view illustrating an apparatus for producing a metal formed product according to a second embodiment of the present invention.
Figure 9:
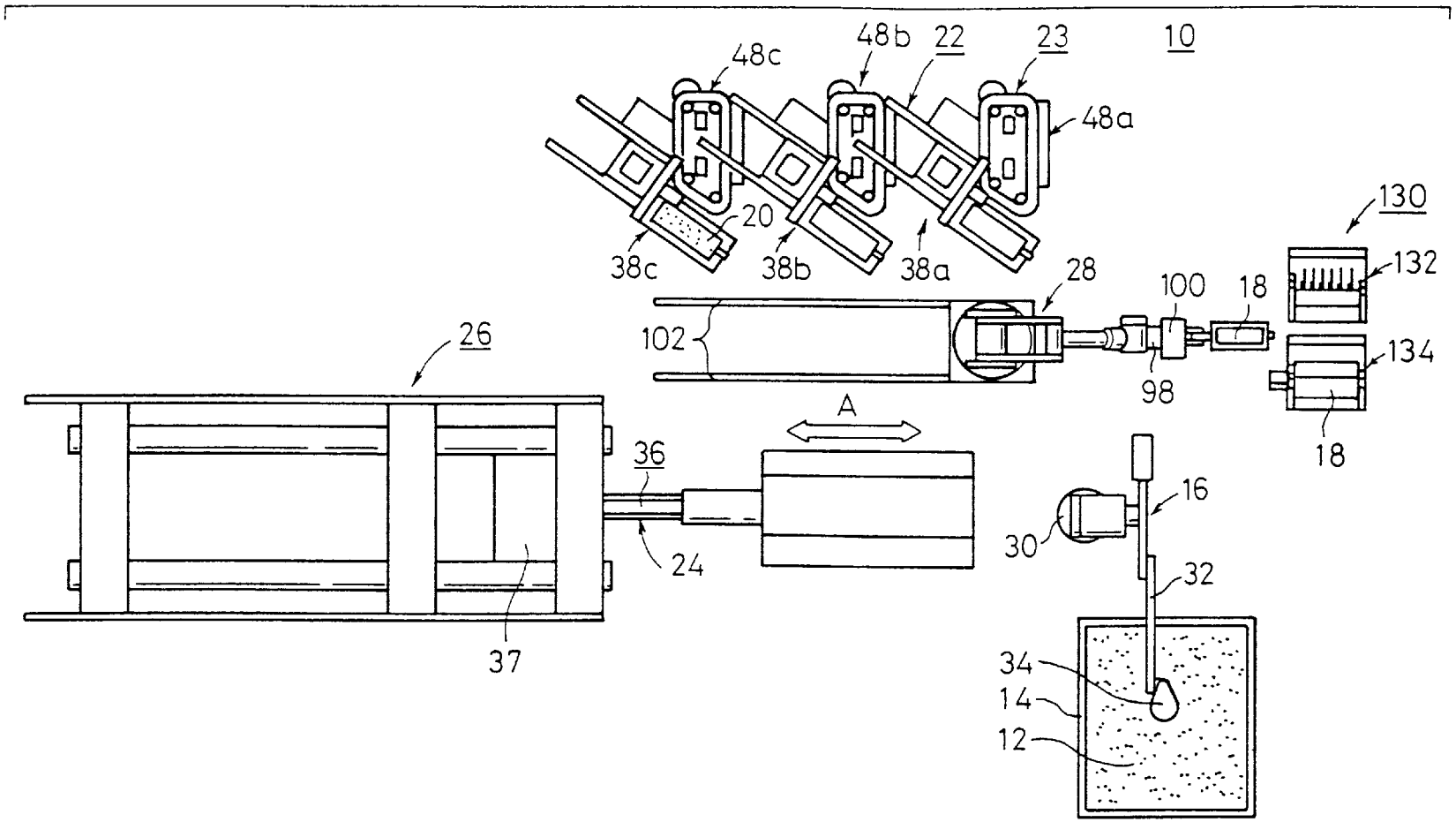
FIG. 9 shows a plan view illustrating the production apparatus shown in FIG. 8.

FIG. 8 shows a schematic perspective view illustrating an apparatus 120 for producing a metal formed product according to a second embodiment of the present invention, and FIG. 9 shows a plan view illustrating the production apparatus 120. The same constitutive components as those of the production apparatus 10 according to the first embodiment are designated by the same reference numerals, detailed explanation of which will be omitted.

The production apparatus 120 comprises the molten metal-holding furnace 14, the molten metal-ladling robot 16, the semisolidified metal-producing mechanism 22, the forming machine 26, a vessel-restoring mechanism 130 which is arranged adjacent to the molten metal-holding furnace 14 and the semisolidified metal-producing mechanism 22, for applying a restoring treatment so that the crucible 18 has a predetermined function, and the articulated robot 28 which is capable of transporting the crucible 18 to the molten metal-holding furnace 14, the semisolidified metal-producing mechanism 22, the forming machine 26, and the vessel-restoring mechanism 130.

Figure 10:
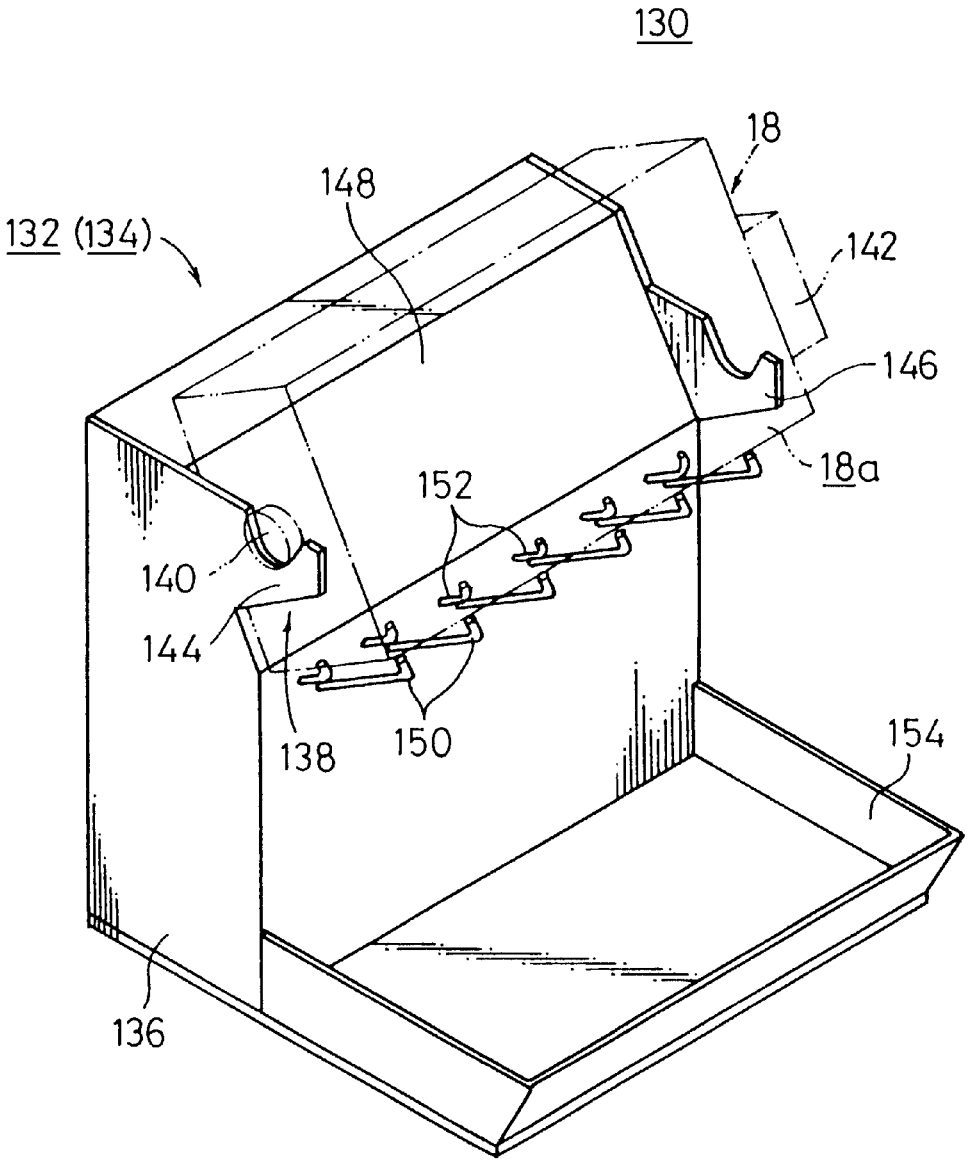
FIG. 10 shows a schematic perspective view illustrating a vessel-restoring mechanism which constitutes the production apparatus shown in FIG. 8.
Figure 11:
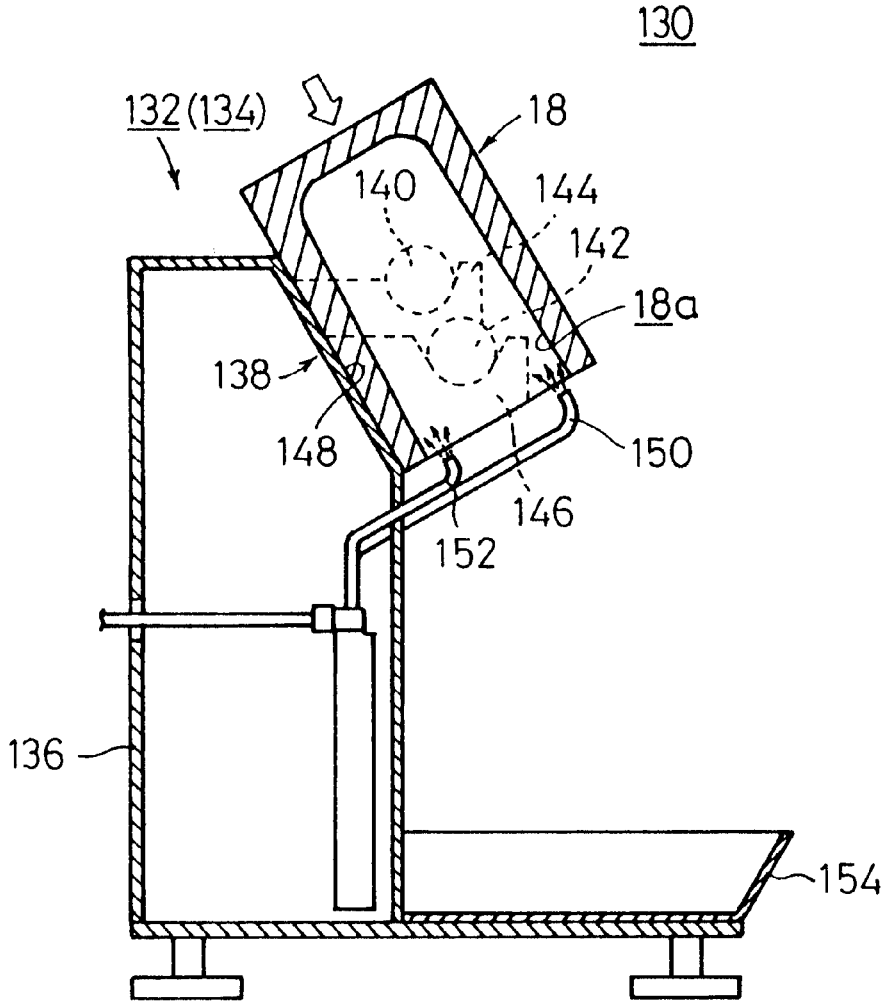
FIG. 11 shows a side view illustrating the vessel-restoring mechanism.

As shown in FIGS. 10 and 11, the vessel-restoring mechanism 130 is provided with first and second holding means 132, 134 capable of holding the crucible 18 disengaged from the articulated robot 28 so that the opening 18*a* is directed obliquely downwardly. The first and second holding means 132, 134 are constructed in the same manner. In the following description, only the first holding means 132 will be explained.

The first holding means 132 has a frame 136. The frame 136 is provided with a crucible-placing section 138 for holding the crucible 18 in a predetermined angle attitude. A shaft section 140 is provided at a first end of the crucible 18. A fastening section 142 for being gripped by the articulated robot 28 is provided at a second end of the crucible 18. The crucible-placing section 138 is provided with receiving stands 144, 146 for arranging the shaft section 140 and the fastening section 142 thereon. The crucible-placing section 138 is provided with an inclined support surface 148 for supporting the side surface of the crucible 18 so that the crucible 18 is maintained at a predetermined angle.

A plurality of air nozzles 150 and a plurality of coating nozzles 152, which are directed to the opening 18*a* of the crucible 18, are installed to the crucible-placing section 138. An unillustrated air supply source and an unillustrated releasing agent supply source communicate with the air nozzles 150 and the coating nozzles 152 respectively. A tray member 154, which is used to recover adhesion matters, for example, aluminum solidified matters removed through the opening 18*a* of the crucible 18, is arranged under the crucible-placing section 138.

The production apparatus 120 according to the second embodiment constructed as described above is operated in the same manner as the first embodiment described above. That is, the molten metal 12 in the molten metal-holding furnace 14 is poured into the crucible 18 which is gripped by the articulated robot 28, by the aid of the molten metal-ladling robot 16. After that, the articulated robot 28 places the crucible 18 at the predetermined position of any one of the first to third agitators 38*a* to 38*c*. Subsequently, the articulated robot 28 grips the crucible 18 including the semisolidified metal 20 cooled and agitated to give the desired slurry state, of the first to third agitators 38*a* to 38*c*, and it takes out the crucible 18 from the semisolidified metal-producing mechanism 22.

Further, the articulated robot 28 is moved to the forming machine 26 to tilt the crucible 18. Accordingly, the semisolidified metal 20 in the crucible 18 is allowed to fall toward the opening 36, and it is supplied into the injection sleeve 24. After that, the articulated robot 28 transports the empty crucible 18 to the vessel-restoring mechanism 130. In the vessel-restoring mechanism 130, for example, the crucible 18 after the restoring treatment is held by the second holding means 134. The empty crucible 18 is arranged at the crucible-placing section 138 which constitutes the first holding means 132, by the aid of the articulated robot 28.

As shown in FIGS. 10 and 11, in the crucible-placing section 138, the crucible 18, which is gripped by the articulated robot 28, is guided for its side surface along the inclined support surface 148. The shaft section 140 and the fastening section 142 are supported by the receiving stands 144, 146 respectively. Accordingly, the crucible 18 is held in the predetermined angle attitude by the crucible-placing section 138 so that the opening 18*a* is directed obliquely downwardly.

Subsequently, the articulated robot 28 cancels the gripping action for the fastening section 142 of the crucible 18 effected by the gripping section 100. After that, the crucible 18 after the restoring treatment, which is arranged at the second holding means 134, is gripped, and it is moved to the pouring position. On the other hand, in the first holding means 132, the restoring treatment for the crucible 18 is started.

Specifically, at first, the air blow is performed toward the opening 18*a* from the plurality of air nozzles 150 which are arranged to be directed to the opening 18*a* of the crucible 18. The adhered matters such as aluminum adhered to the interior of the crucible 18 are removed. During this process, the adhered matters removed from the crucible 18 are allowed to fall, and they are recovered by the tray member 154 which is arranged under the crucible-placing section 138. Therefore, it is possible to avoid any scattering of the adhered matters to the outside, and the treatment operation for recovering the adhered matters is performed smoothly with ease.

The air blow (or the spray of cooling liquid or the like) is further performed from the air nozzles 150 toward the opening 18*a* of the crucible 18, and the crucible 18 is cooled to have a predetermined temperature. The air blow from the air nozzles 150 is stopped, and the releasing agent is sprayed to the interior of the crucible 18 from the plurality of coating nozzles 152. The coating is effected for the inner wall surface of the opening 18*a*. Accordingly, the restoring treatment for the crucible 18 is completed, and the crucible 18 is allowed to wait at the first holding means 132.

In the second embodiment, as for the crucible 18, four of the crucibles 18 are used. The number of four is larger by one than a number of those to be practically used, i.e., a number corresponding to the first to third agitators 38*a* to 38*c*. The restoring treatment for the crucible 18 is performed in the vessel-restoring mechanism 130 during the period in which the molten metal 12 is ladled from the molten metal-holding furnace 14 and the operation for forming the metal formed product is performed by the forming machine 26.

Accordingly, the operation for forming the metal formed product is not stopped during the restoring treatment for the crucible 18. It is possible to shorten the cycle time of the entire production apparatus 120 all at once. An effect is obtained such that the production efficiency is effectively improved.

The articulated robot 28 is constructed so that it is capable of transporting the crucible 18 to the molten metal-holding furnace 14, the semisolidified metal-producing mechanism 22, the forming machine 26, and the vessel-restoring mechanism 130. Therefore, all of the forming steps for the metal formed product including the restoring treatment for the crucible 18 are performed automatically and efficiently.

The vessel-restoring mechanism 130 is constructed such that the air blow is performed and the releasing agent is jetted toward the opening 18*a* by the aid of the plurality of air nozzles 150 and the plurality of coating nozzles 152 in the state in which the crucible 18 is held so that the opening 18*a* is directed obliquely downwardly by the aid of the first and second holding means 132, 134. Accordingly, the operation for removing aluminum adhered to the interior of the opening 18*a* is reliably performed with the simple arrangement. Further, an advantage is obtained such that the entire operation of the restoring treatment for the crucible 18 can be performed quickly and efficiently.

In the second embodiment, the control of the articulated robot 28 is simplified. The crucible 18 can be transported quickly in the shortest distance to the semisolidified metal-producing mechanism 22 and the vessel-restoring mechanism 130 by the aid of the articulated robot 28. An effect is obtained such that it is easy to realize the efficient entire operation for producing the metal formed product.

In the second embodiment, the restoring treatment for the chillers 19 is automatically performed in the cooling member-restoring mechanism 23 so that the chillers 19 have the desired function. On the other hand, the restoring treatment for the crucible 18 is automatically performed in the vessel-restoring mechanism 130 so that the crucible 18 has the desired function.

Accordingly, the entire operation of each of the restoring treatments for the chillers 19 and the crucible 18 is performed automatically and efficiently. The entire treatment for producing the metal formed product can be performed efficiently and automatically. Further, the production operation is not interrupted during the restoring operations for the chillers 19 and the crucible 18. An effect is obtained such that this feature effectively functions especially when the metal formed product is continuously produced.

In the first and second embodiments described above, the molten metal-ladling robot 16 for ladling the molten metal in the amount of one shot is provided between the molten metal-holding furnace 14 and the articulated robot 28. However, when the arrangement is made such that the molten metal 12 in the amount of one shot is directly poured from the molten metal-holding furnace 14 to the crucible 18 held by the articulated robot 28, it is not necessarily indispensable to use the molten metal-ladling robot 16. This arrangement may be equivalently adopted in the following embodiments.

Figure 12:
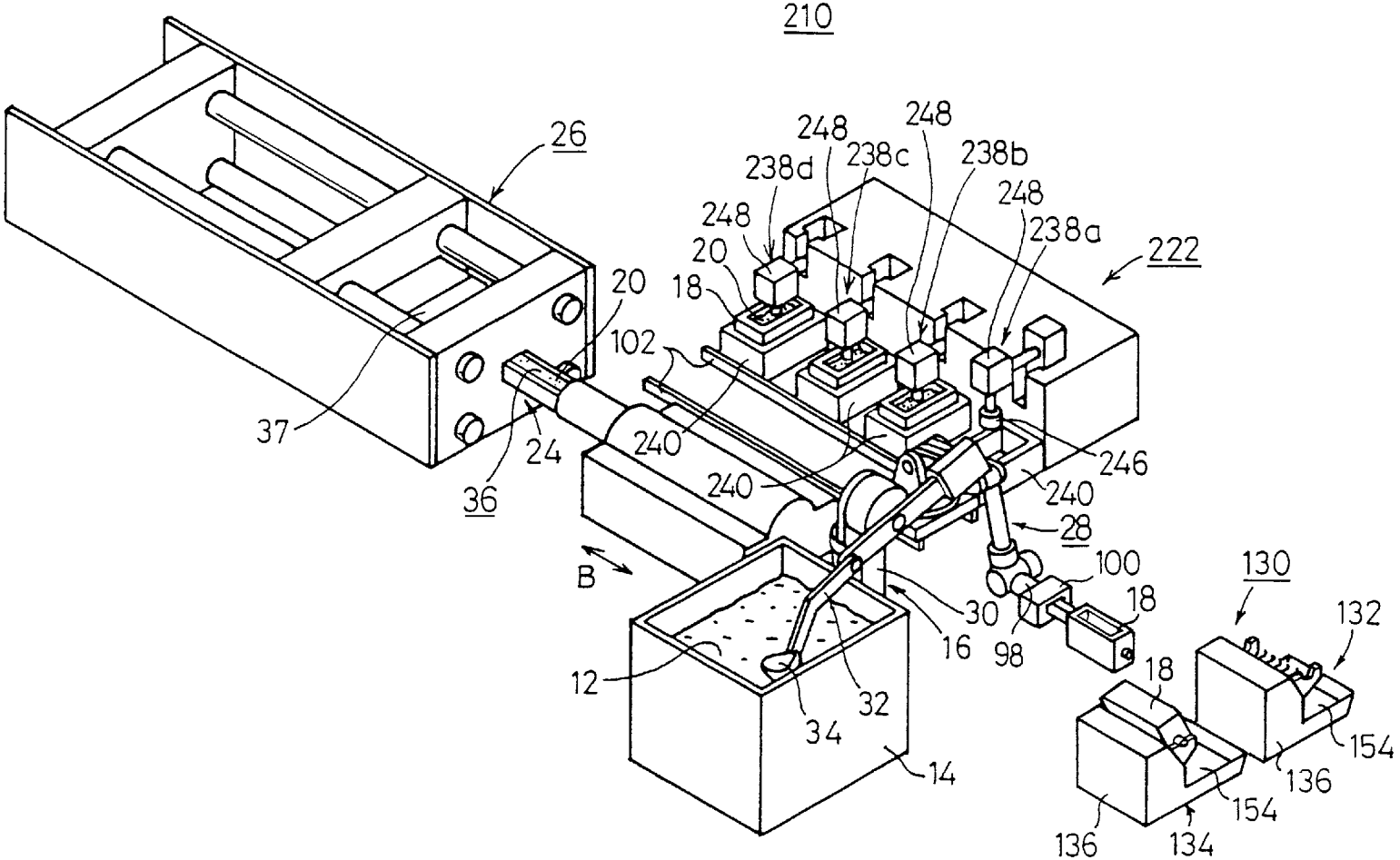
FIG. 12 shows a schematic perspective view illustrating an apparatus for producing a metal formed product according to a third embodiment of the present invention.
Figure 13:
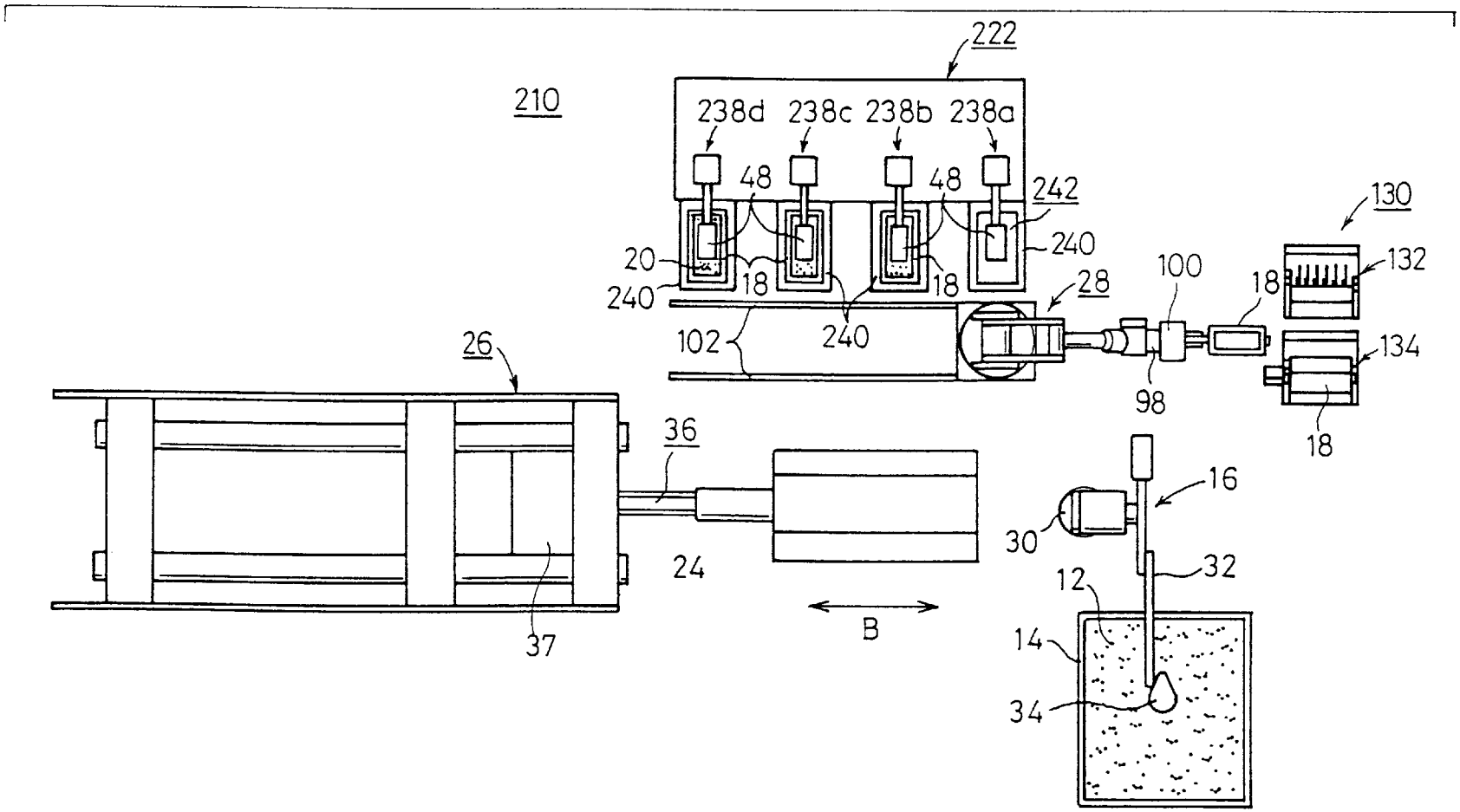
FIG. 13 shows a plan view illustrating the production apparatus.

FIG. 12 shows a schematic perspective view illustrating an apparatus 210 for producing a metal formed product according to a third embodiment of the present invention, and FIG. 13 shows a plan view illustrating the production apparatus 210. The same constitutive components as those of the production apparatus 120 according to the second embodiment are designated by the same reference numerals, detailed explanation of which will be omitted.

The production apparatus 210 comprises the molten metal-holding furnace 14, the molten metal-ladling robot 16, a semisolidified metal-producing mechanism 222, the forming machine 26, the vessel-restoring mechanism 130, and the articulated robot 28 which is capable of transporting the crucible 18 to the molten metal-holding furnace 14, the semisolidified metal-producing mechanism 222, the forming machine 26, and the vessel-restoring mechanism 130.

The semisolidified metal-producing mechanism 222 includes first to fourth agitators 238*a* to 238*d* for arranging the crucible 18 and cooling and agitating the molten metal 12 in the crucible 18. The first to fourth agitators 238*a* to 238*d* are constructed in the same manner.

In the following description, the first agitator 238*a* will be principally explained as an example.

Figure 14:
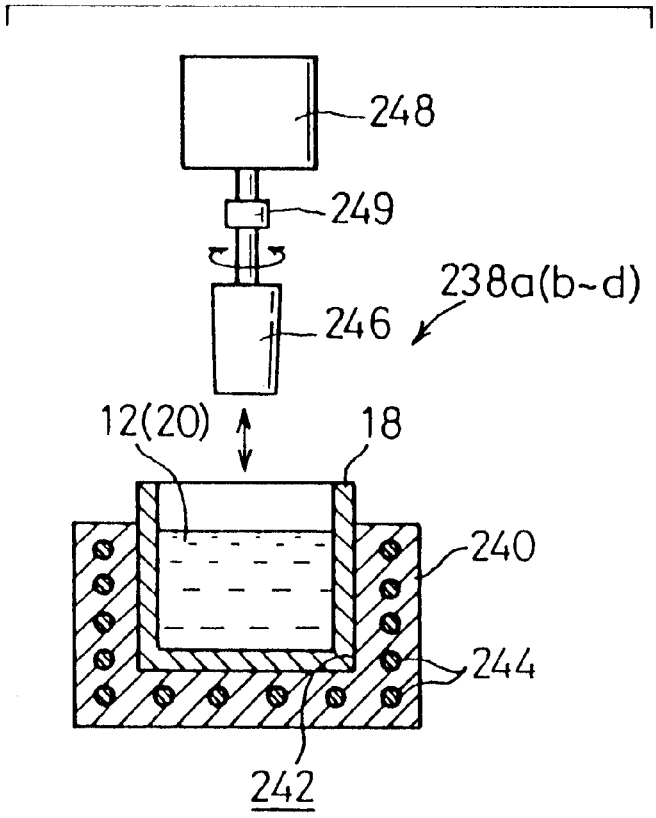
FIG. 14 illustrates an agitator which constitutes the production apparatus.

The first agitator 238*a* is provided with a crucible-receiving stand 240 for detachably arranging the crucible 18. As shown in FIG. 14, the crucible-receiving stand 240 is provided with a recess 242 for accommodating the crucible 18. A heater 244 is embedded at the inside of the crucible-receiving stand 240 so that the crucible 18 arranged in the recess 242 is surrounded thereby.

Chillers 246, which also have the agitating function, are detachably arranged by the aid of a driving section 248 over the crucible-receiving stand 240. The chiller 246 is composed of, for example, a material such as copper and stainless steel which is not melted at the molten metal temperature of, for example, the aluminum molten metal to be used as the molten metal 12. The contour of the chiller 246 is designed to have a columnar configuration, and it has a draft downwardly. The chiller 246 is detachable with respect to the driving section 248 by the aid of a coupler 249 made of ceramics. The driving section 248 makes upward/downward movement over the crucible-receiving stand 240, and it drives and rotates the chillers 246.

The production apparatus 210 according to the third embodiment constructed as described above is operated in the same manner as the first and second embodiments described above. That is, the molten metal 12 in the molten metal-holding furnace 14 is poured into the empty crucible 18 gripped by the articulated robot 28, by the aid of the molten metal-ladling robot 16.

Subsequently, the articulated robot 28 places the crucible 18 at a predetermined position of any one of the first to fourth agitators 238*a* to 238*d*. For example, the articulated robot 28 inserts the crucible 18 into the recess 242 of the crucible-receiving stand 240 which constitutes the first agitator 238*a*. As shown in FIG. 14, in the crucible-receiving stand 240, the heater 244 is operated to previously maintain a predetermined temperature so that the molten metal 12 in the crucible 18 arranged in the recess 242 is prevented from quick cooling by the surroundings.

As for the first agitator 238*a*, the chillers 246 are previously heated and held at about 100° C. in order to remove water and stabilize the cooling condition. The chillers 246 are immersed in the molten metal 12 in the crucible 18, while being rotated in a predetermined direction at a relatively low speed by the aid of the driving section 248. After that, the rotation speed of the chillers 246 in the molten metal 12 is increased in accordance with the action of the driving section 248. Accordingly, the molten metal 12 is quickly agitated while effecting cooling. After the chillers 246 agitate the molten metal 12 for a preset period of time or until a slurry supply signal is inputted, the chillers 246 are pulled up from the crucible 18 while being rotated.

On the other hand, the articulated robot 28 is moved corresponding, for example, to the fourth agitator 238*d* which includes the semisolidified metal 20 cooled and agitated to give a desired slurry state, of the first to fourth agitators 238*a* to 238*d*. As for the fourth agitator 238*d*, the driving section 248 waits at a position thereover, and the chillers 246 are removed therefrom. The articulated robot 28 grips the crucible 18 arranged on the crucible-receiving stand 240 of the fourth agitator 238*d* so that the crucible 18 is taken out from the fourth agitator 238*d*.

The articulated robot 28 is moved toward the forming machine 26. The semisolidified metal 20 in the crucible 18 is allowed to fall, and it is supplied into the injection sleeve 24 through the opening 36. After that, the articulated robot 28 transports the empty crucible 18 to the vessel-restoring mechanism 130. In the vessel-restoring mechanism 130, the predetermined restoring treatment is applied to the crucible 18 in the same manner as in the second embodiment.

Accordingly, in the third embodiment, the operation for forming the metal formed product is not stopped during the restoring operation for the crucible 18. It is possible to shorten the cycle time of the entire production apparatus 210 all at once. The same effect as that obtained in the first and second embodiments, for example, such that the production efficiency is effectively improved.

Figure 15:
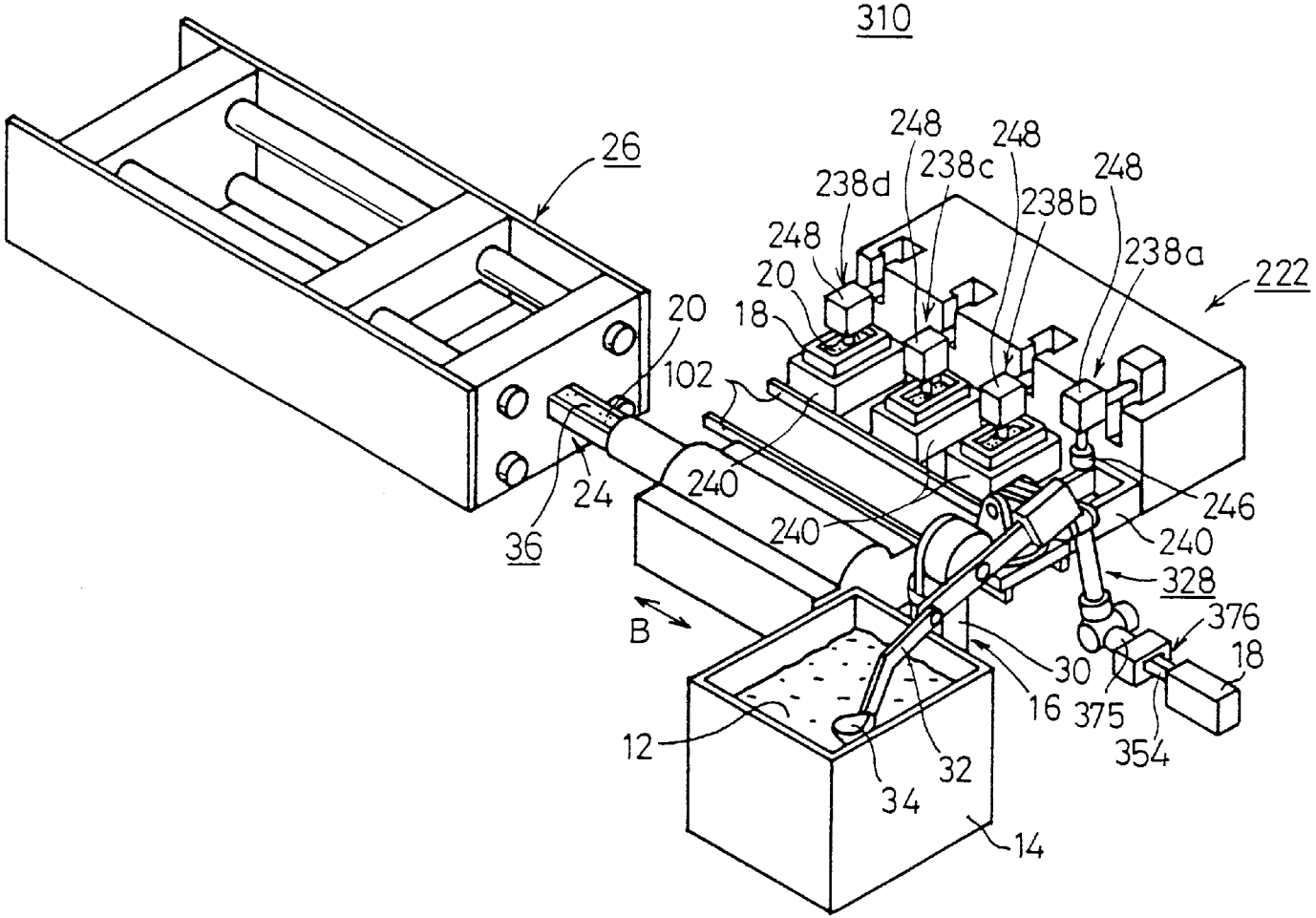
FIG. 15 shows a schematic perspective view illustrating an apparatus for producing a metal formed product according to a fourth embodiment of the present invention.

FIG. 15 shows a schematic perspective view illustrating an apparatus 310 for producing a metal formed product according to a fourth embodiment of the present invention. The same constitutive components as those of the production apparatus 210 according to the third embodiment are designated by the same reference numerals, detailed explanation of which will be omitted.

The production apparatus 310 comprises the molten metal-holding furnace 14, the molten metal-ladling robot 16, the semisolidified metal-producing mechanism 222, the forming machine 26, and an articulated robot 328 which is capable of transporting the crucible 18 to the molten metal-holding furnace 14, the semisolidified metal-producing mechanism 222, and the forming machine 26.

Figure 16:
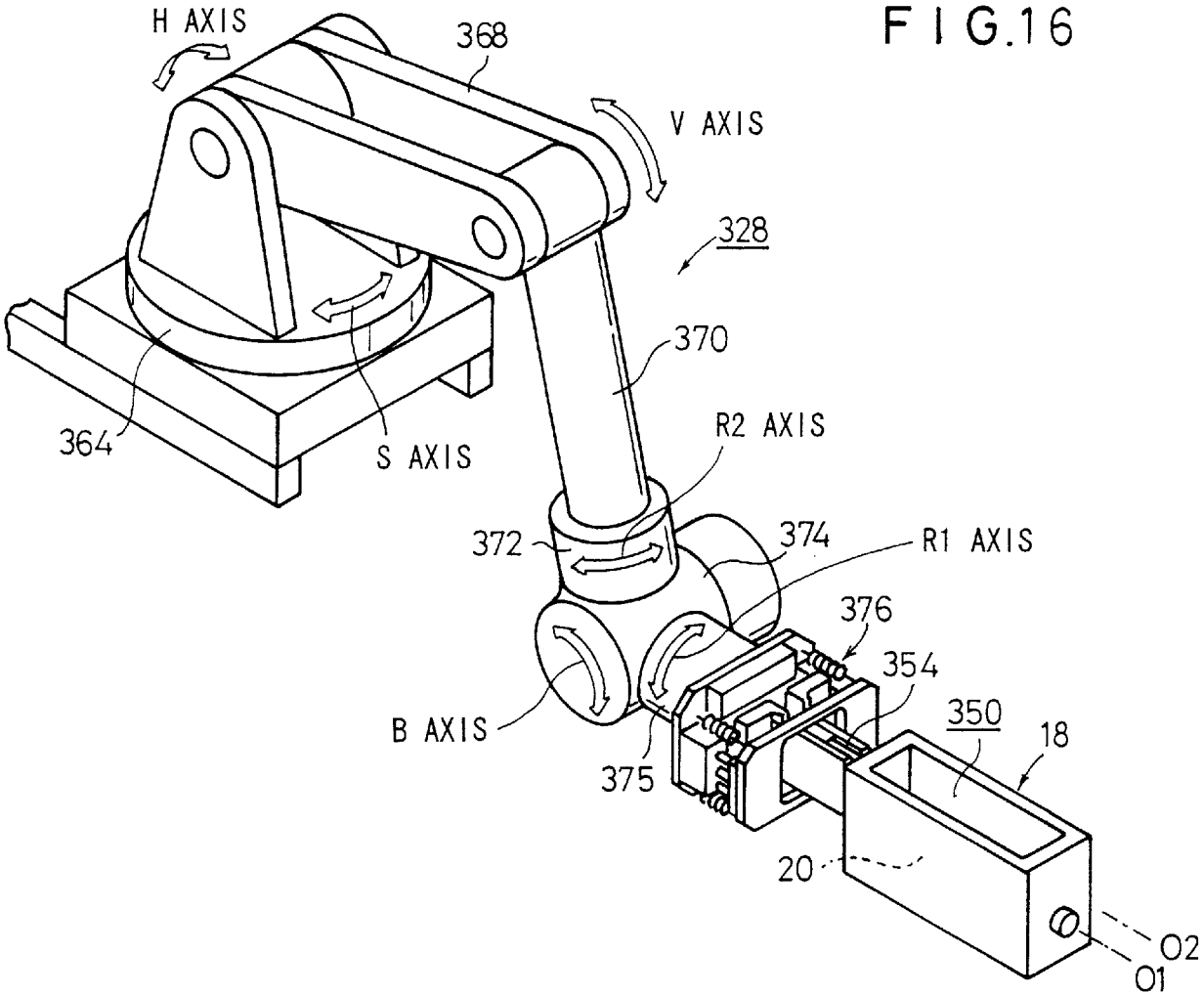
FIG. 16 shows a perspective view illustrating an articulated robot which constitutes the production apparatus.
Figure 17:
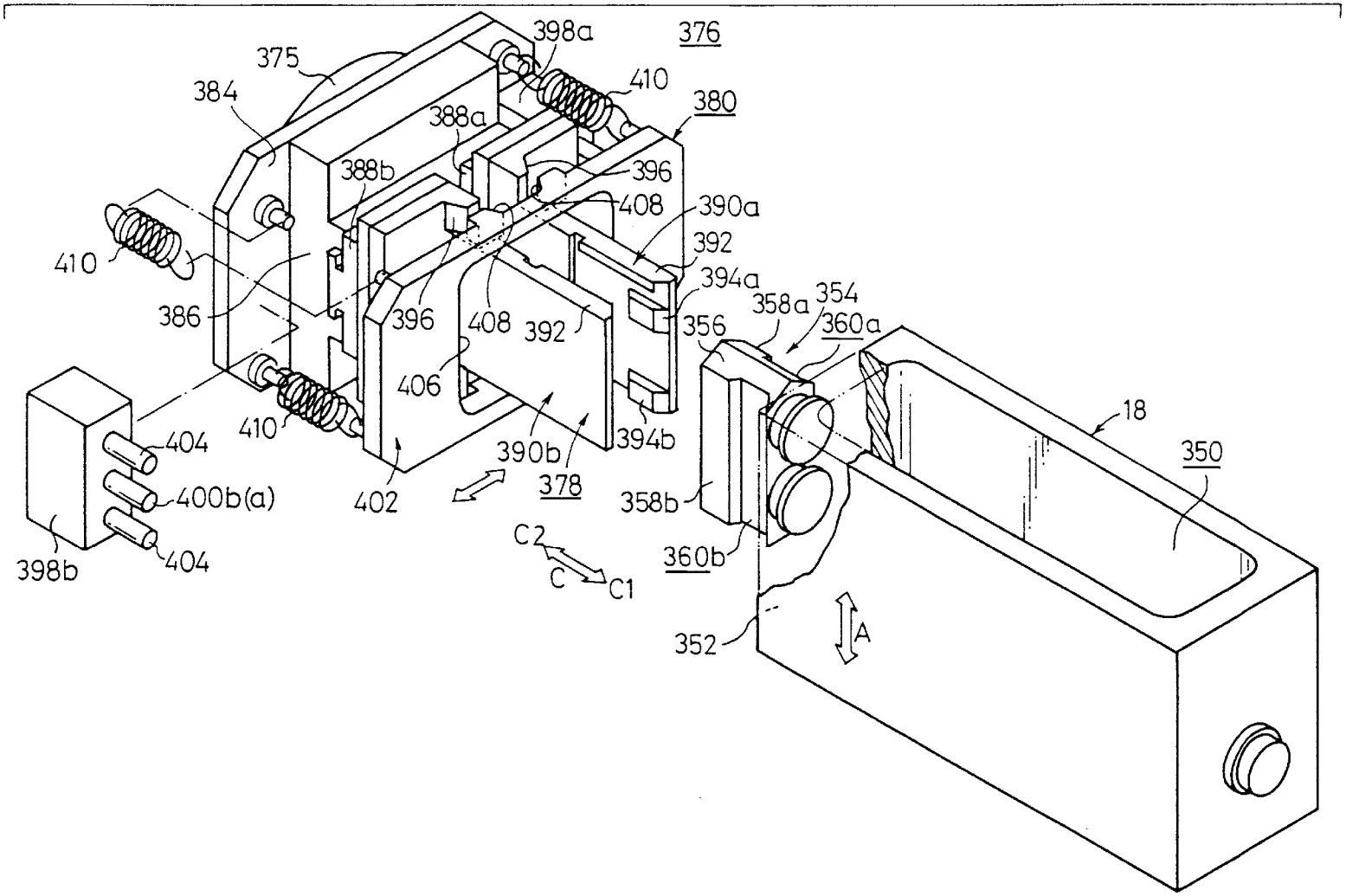
FIG. 17 shows a partial exploded perspective view illustrating a gripping section and a crucible which constitute the production apparatus.

As shown in FIG. 16, the crucible 18 has an opening 350 which has substantially the same shape as that of the opening 36 of the injection sleeve 24. A gripping engaging section 354, which is engageable with a gripping mechanism 376 (as described later on) of the articulated robot 28, is provided only at a first side surface 352 of the crucible 18. As shown in FIG. 17, the engaging section 354 is provided with a plate-shaped member 356 which is secured to the first side surface 352 of the crucible 18 by being fastened by screws. The plate-shaped member 356 is provided at its upper end with a ridge-shaped inclined section, and it has two surfaces 358*a*, 358*b* which are parallel to one another in the depth direction of the crucible 18 (direction of the arrow A). Further, engaging grooves 360*a*, 360*b* are formed in the depth direction on the respective surfaces 358*a*, 358*b*.

The articulated robot 328 is composed of, for example, a six-axis robot. As shown in FIG. 16, a rotary stand 366, which is rotatable about an S axis, is provided on a base 364. A first arm 368 is provided swingably in an H axis direction on the rotary stand 366. A second arm 370 is provided swingably along a V axis on the first arm 368. A swinging shaft 372, which is rotatable about an R2 axis, is arranged at a forward end of the second arm 370. A wrist 374 is installed rotatably about a B axis to the swinging shaft 372. A rotary shaft 376, which is rotatable in an R1 axis direction, is provided on the wrist 374. The gripping mechanism 376 is installed to the rotary shaft 375.

Figure 18:
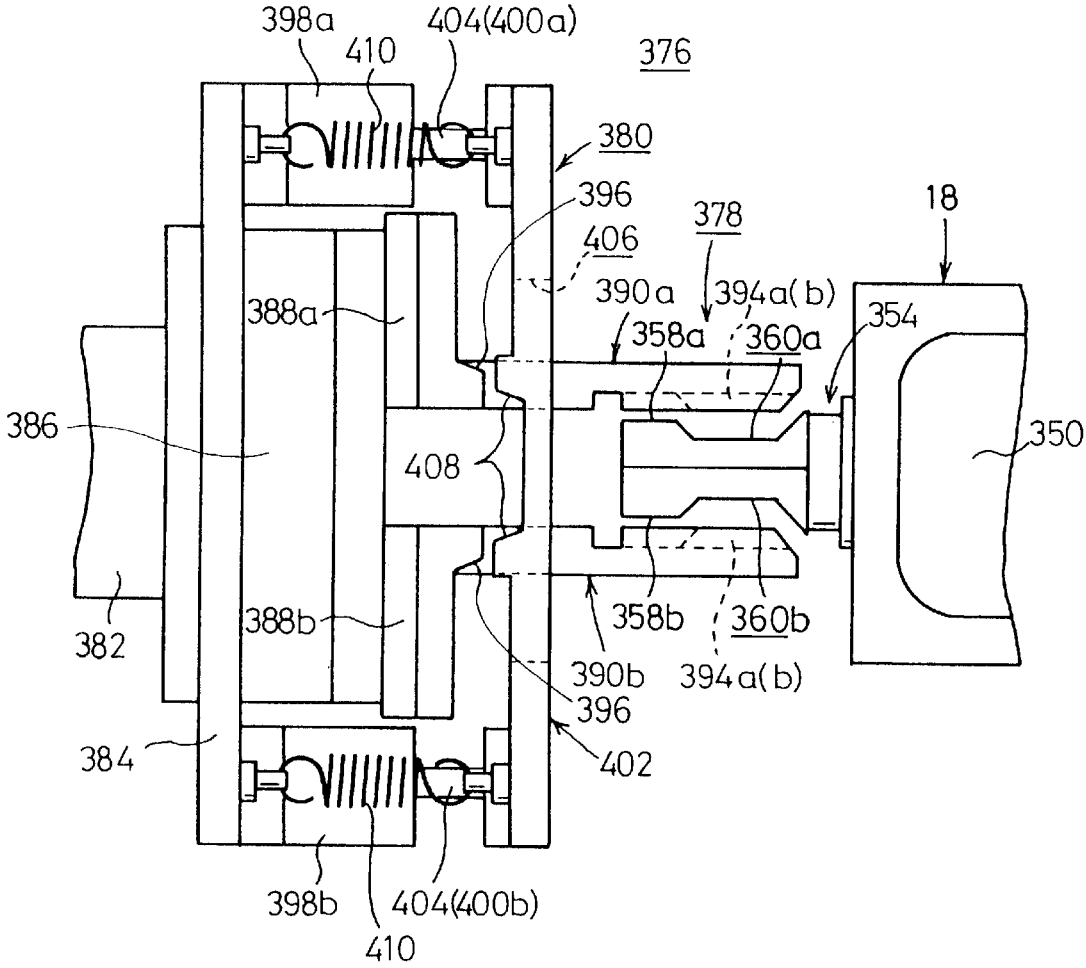
FIG. 18 shows a plan view illustrating the gripping section.

As shown in FIGS. 17 and 18, the gripping mechanism 376 comprises a first clamp means 378 for clamping the engaging section 354 of the crucible 18, and a second clamp means 380 for clamping the first clamp means 378 which directly grips the engaging section 354 integrally with the crucible 18. The first clamp means 378 is provided with a fixed plate member 384 which is fitted to the rotary shaft 375 extending from the wrist 374. A main clamping first cylinder 386 is installed to the fixed plate member 384. The first cylinder 386 has movable bases 388*a*, 388*b* which are displaceable to make approach to one another and make separation from each other. First and second clamp pawls 390*a*, 390*b* are secured to the movable bases 388*a*, 388*b*.

The first clamp pawl 390*a* is engageable with the engaging section 354, and it is provided at its upper portion with a projection 392. The first clamp pawl 390*a* has upper and lower two trapezoidal sections 394*a*, 394*b* which are formed to expand and which are fitted to the groove 360*a*. A tapered surface 396 is provided on the proximal end side of the first clamp pawl 390*a* to be fastened by screws to the movable base 388*a* so that the tapered surface 396 is inclined inwardly toward the front. The second clamp pawl 390*b* is constructed in the same manner as the first clamp pawl 390*a*. The same constitutive components are designated by the same reference numerals, detailed explanation of which will be omitted.

The second clamp means 380 is provided with sub-clamping second cylinders 398*a*, 398*b* which are secured to the fixed plate member 384. A movable plate member 402, which constitutes the clamp member, is secured to rods 400*a*, 400*b* protruding from the second cylinders 398*a*, 398*b*. A pair of guide bars 404 are arranged with the rod 400*a*, 400*b* interposed therebetween. The guide bars 404 are secured to the movable plate member 402, and they are inserted into the second cylinders 398*a*, 398*b*.

The movable plate member 402 has an opening 406 which is formed at its central portion for inserting the first and second clamp pawls 390*a*, 390*b* therethrough. The movable plate member 402 is provided with a pair of tapered surfaces 408 for making sliding contact with the respective tapered surfaces 396 of the first and second clamp pawls 390*a*, 390*b* to press and hold the first and second clamp pawls 390*a*, 390*b* in directions to make approach to one another. First ends of tensile springs 410 are engaged with four corners of the movable plate member 402. Second ends of the tensile springs 410 are attached to the fixed plate member 384. The movable plate member 402 is always urged by the resilient force of the springs 410 in a direction to fix the first and second clamp pawls 390*a*, 390*b*.

The operation of the production apparatus 310 constructed as described above will be explained below in relation to a production method concerning the embodiment of the present invention.

The articulated robot 328 is moved corresponding to, for example, the fourth agitator 238*d* having the semisolidified metal 20 cooled and agitated to give a desired slurry state, of the first to fourth agitators 238*a* to 238*d*. The articulated robot 328 grips the crucible 18 which is arranged on the crucible-receiving stand 240 of the fourth agitator 238*d*, and it takes out the crucible 18 from the fourth agitator 238*d*.

Specifically, the second cylinders 398*a*, 398*b*, which constitute the second clamp means 380, are driven. The movable plate member 402 protrudes frontwardly (in the direction of the arrow C1) against the resilient force of the springs 410 (see FIG. 17). Accordingly, the first and second clamp pawls 390*a*, 390*b*, which constitute the first clamp means 378, are displaceable in the directions to make approach to one another and make separation from each other. When the first cylinder 386 is driven, the first and second clamp pawls 390*a*, 390*b* are arranged in the direction to make separation from each other integrally with movable bases 388*a*, 388*b*.

Figure 19:
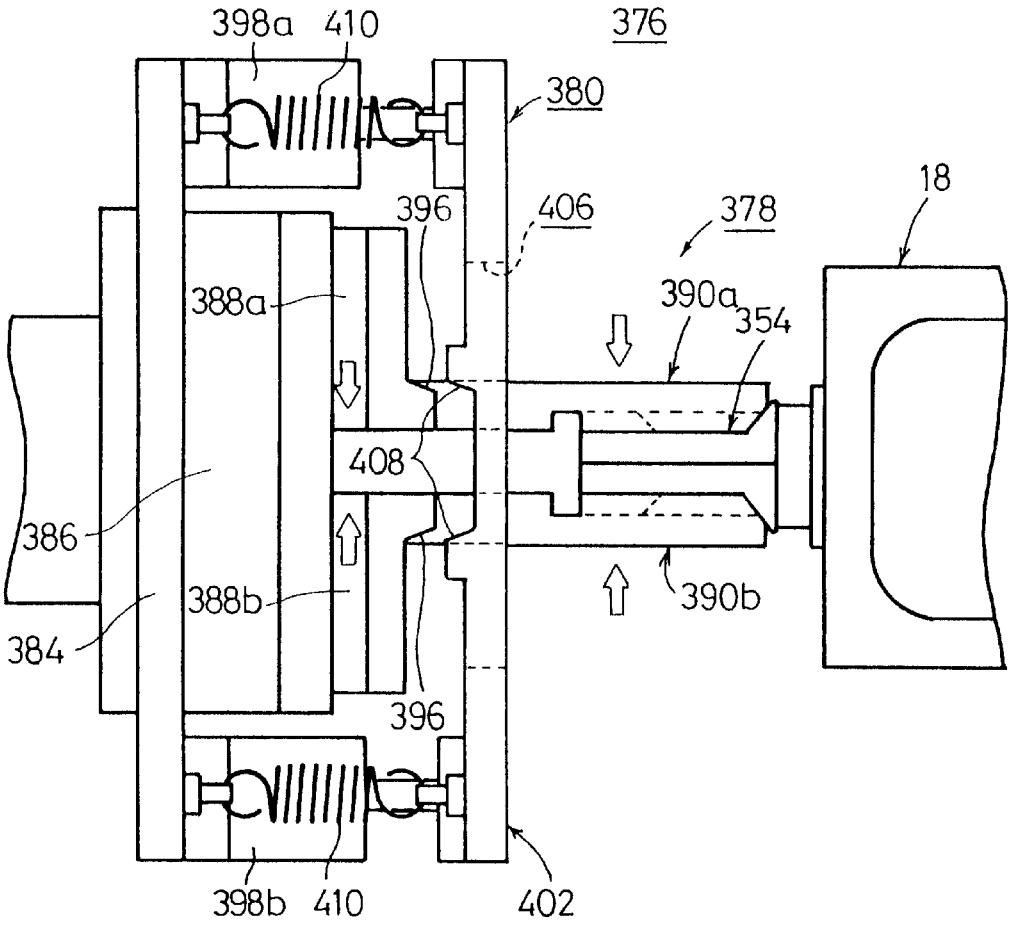
FIG. 19 illustrates the operation of a second clamp means which constitutes the gripping mechanism.

The wrist 374, which constitutes the articulated robot 328, is moved toward the crucible 18 arranged in the fourth agitator 238*d*. The engaging section 354, which is secured to the first side surface 352 of the crucible 18, is arranged between the first and second clamp pawls 390*a*, 390*b* (see FIG. 18). Subsequently, the first cylinder 386 is driven, and the first and second clamp pawls 390*a*, 390*b* are displaced in the direction to make approach to one another integrally with the movable bases 388*a*, 388*b*. The engaging section 354 is gripped by the first and second clamp pawls 390*a*, 390*b* (see FIG. 19).

In this process, the projections 392 of the first and second clamp pawls 390*a*, 390*b* are engaged with the upper portions of the plate-shaped member 356. The trapezoidal sections 394*a*, 394*b* are fitted to the grooves 360*a*, 360*b* which are formed on the surfaces 358*a*, 358*b*.

Figure 20:
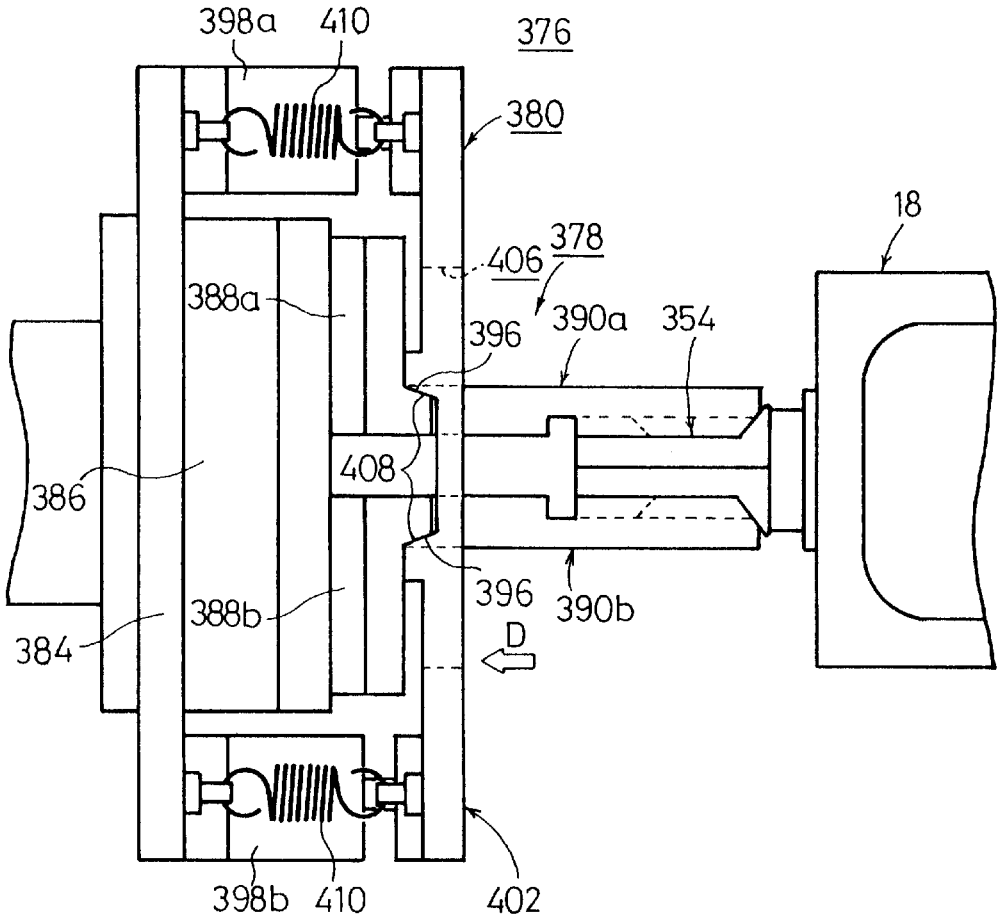
FIG. 20 shows a plan view illustrating a state in which the crucible is gripped by the gripping mechanism.

In this state, the second cylinders 398*a*, 398*b*, which constitute the second clamp means 380, are driven, and the movable plate member 402 is moved toward the wrist 374 (in the direction of the arrow D in FIG. 20). Accordingly, the tapered surfaces 408, which are provided on the movable plate member 402, make sliding contact with the tapered sufaces 396 which are provided on the first and second clamp pawls 390*a*, 390*b*. The first and second clamp pawls 390*a*, 390*b* are pressed and held in the direction to make approach to one another. Accordingly, the engaging section 354, which is provided on the crucible 18, is gripped tightly and reliably by the aid of the first and second clamp means 378, 380. The articulated robot 328 arranges the crucible 18 in a horizontal attitude corresponding to the opening 36 of the forming machine 26.

Figure 21:
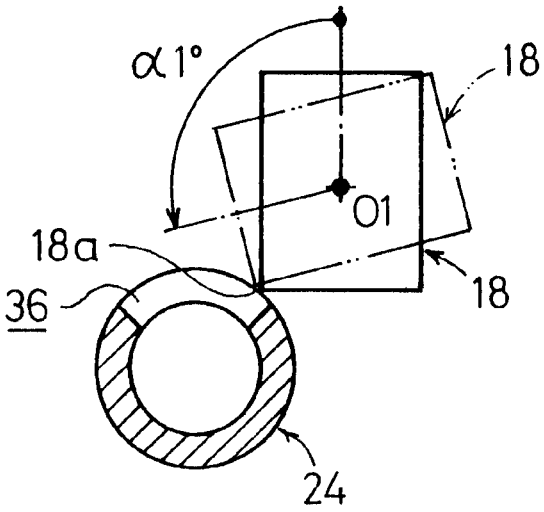
FIG. 21 illustrates the operation performed when the crucible is rotated.

In the fourth embodiment, as shown in FIG. 21, the crucible 18 is arranged by the articulated robot 328 in the horizontal attitude closely to the upper end edge of the opening 36 of the injection sleeve 24, and then the rotary shaft 375 is firstly rotated by a predetermined angle about the R1 axis. Accordingly, the crucible 18, which is supported on one side by the gripping section 376, is rotated by a predetermined angle $\alpha 1°$ about the rotation center O1 by using the center of the gripping section 376. Accordingly, the end 18*a* of the crucible 18 on the side of the opening 50 is arranged closely to the end of the opening 36 of the injection sleeve 24 (see two-dot chain lines in FIG. 21).

Figure 22:
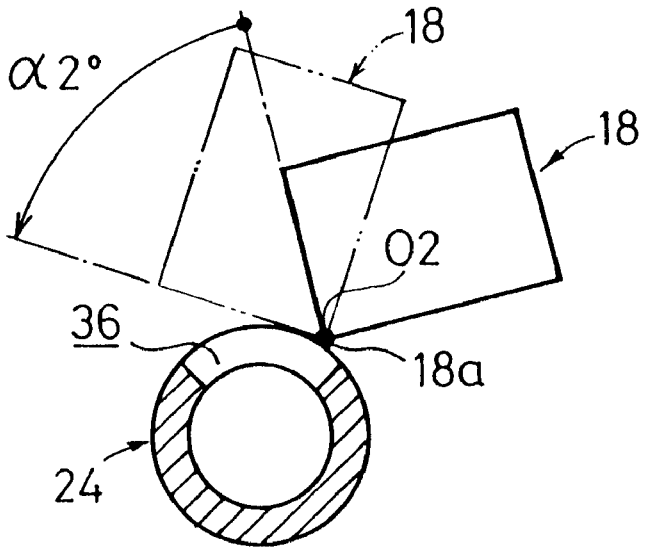
FIG. 22 illustrates the operation performed when the crucible is tilted.

Subsequently, as shown in FIG. 22, the articulated robot 328 assumes a virtual tilting axis O2 in the vicinity of the end of the opening 36 of the injection sleeve 24, i.e., at the end 18*a* of the crucible 18 having been rotated by the angle $\alpha 1°$. The crucible 18 is tilted by a predetermined angle $\alpha 2°$ about the virtual tilting axis O2 (see two-dot chain lines in FIG. 22). In this process, as shown in FIG. 16, the articulated robot 328 is operated in accordance with the selective driving concerning the S axis of the rotary stand 366, the H axis of the first arm 368, the V axis of the second arm 370, the R2 axis of the swinging shaft 372, the B axis of the wrist 374, and the R1 axis of the rotary shaft 375. Accordingly, the crucible 18 is tilted about the virtual tilting axis O2 which is set in the vicinity of the end of the opening 36.

Accordingly, the semisolidified metal 20 in the crucible 18 is reliably introduced from the opening 50 into the opening 36 of the injection sleeve 24 during the period in which the crucible 18 is tilted in the range of the angle $\alpha 2°$ as shown in FIG. 22. The all amount of the semisolidified metal 20 can be introduced into the injection sleeve 24.

As described above, in the fourth embodiment, the crucible 18 is rotated by the angle $\alpha 1°$ about the rotation center O1, and then the crucible 18 is tilted about the virtual tilting axis O2 which is set in the vicinity of the end of the opening 36 of the injection sleeve 24. Therefore, the crucible 18 is practically tilted on the injection sleeve 24 by using the open side end 18*a* as the support point. The semisolidified metal 20, which is accommodated in the opening 50, is reliably introduced from the opening 50 into the opening 36 of the injection sleeve 24 during the process in which the crucible 18 arrives at any tilting position within the range of the angle $\alpha 2°$.

Accordingly, the all amount of the semisolidified metal 20 in the crucible 18 can be introduced into the injection sleeve 24. No semisolidified metal 20 remains in the crucible 18. An effect is obtained such that the semisolidified metal 20 can be supplied to the injection sleeve 24 efficiently and reliably.

Further, the crucible 18 is firstly rotated up to the angle $\alpha 1°$ about the center of the rotation center O1, and then it is tilted about the center of the virtual tilting axis O2. Accordingly, the operation for introducing the semisolidified metal 20 in the crucible 18 is quickly performed, and it is easy to realize the efficient entire operation for supplying the semisolidified metal 20. Further, the rotation and the tilting operation of the crucible 18 are performed only by selectively making the driving concerning the S axis, the H axis, the V axis, the R2 axis, the B axis, and the R1 axis of the articulated robot 28. Thus, it is possible to simplify the entire control.

In the fourth embodiment, the engaging section 354 is provided only at the first side surface 352 of the crucible 18. The engaging section 354 is gripped by the gripping mechanism 376 which is installed to the wrist 374 of the articulated robot 328. Accordingly, the dimension of the gripping mechanism 376 is greatly shortened in the axial direction (direction of the arrow C in FIG. 17) as compared with the both-side support hand structure in which the crucible 18 is supported at the both ends in the longitudinal direction. Accordingly, especially when the crucible 18 is not gripped, the protruding amount of the gripping mechanism 376 in the direction of the arrow C is greatly reduced. Therefore, the interference range of the gripping mechanism 376 is decreased all at once. Therefore, the following effect is obtained. That is, the articulated robot 328 can be moved in the shortest distance, and the cycle time can be effectively shortened.

Further, when the crucible 18 is moved toward the injection sleeve 24, the gripping mechanism 376 does not interfere with the forming machine 26. Accordingly, the crucible 18 can be arranged as closely as possible over the opening 36 of the injection sleeve 24. The semisolidified metal 20 can be introduced from the opening 36 into the injection sleeve 24 smoothly and reliably.

On the other hand, when the molten metal 12 is poured into the crucible 18, the gripping mechanism 376 and the molten metal-ladling robot 16 do not make interference with each other. The ladle 34 can be arranged as closely as possible with respect to the crucible 18. Therefore, the tilting speed of the ladle 34 can be increased, the pouring speed is quickened, and thus it is possible to shorten the cycle time.

In the fourth embodiment, the gripping mechanism 376 is provided with the first clamp means 378 for directly gripping the engaging section 354 of the crucible 18, and the second clamp means 380 for gripping the first clamp means 378 which grips the engaging section 354, integrally with the crucible 18. Therefore, the crucible 18 can be held reliably and tightly by means of the one-side support hand structure. The crucible 18 is neither disengaged from the gripping mechanism 376 nor unnecessarily tilted. The entire operation for producing the metal formed product can be efficiently performed. Further, the structure is simplified, it is possible to realize the compact size of the entire gripping mechanism 376, and it is easy to mitigate the load acting on the wrist 374 of the articulated robot 28.

The second clamp means 380 is provided with the springs 410 for urging the movable plate member 402 inwardly, i.e., in the direction to hold the first and second clamp pawls 390*a*, 390*b*. Accordingly, for example, even when the supply of air to the second cylinders 398*a*, 398*b* is stopped, the movable plate member 402 presses and holds the first and second clamp pawls 390*a*, 390*b* in the direction to make approach to one another in accordance with the tensile action of the springs 410. An effect is obtained, for example, such that the crucible 18 can be reliably prevented from falling.

Figure 23:
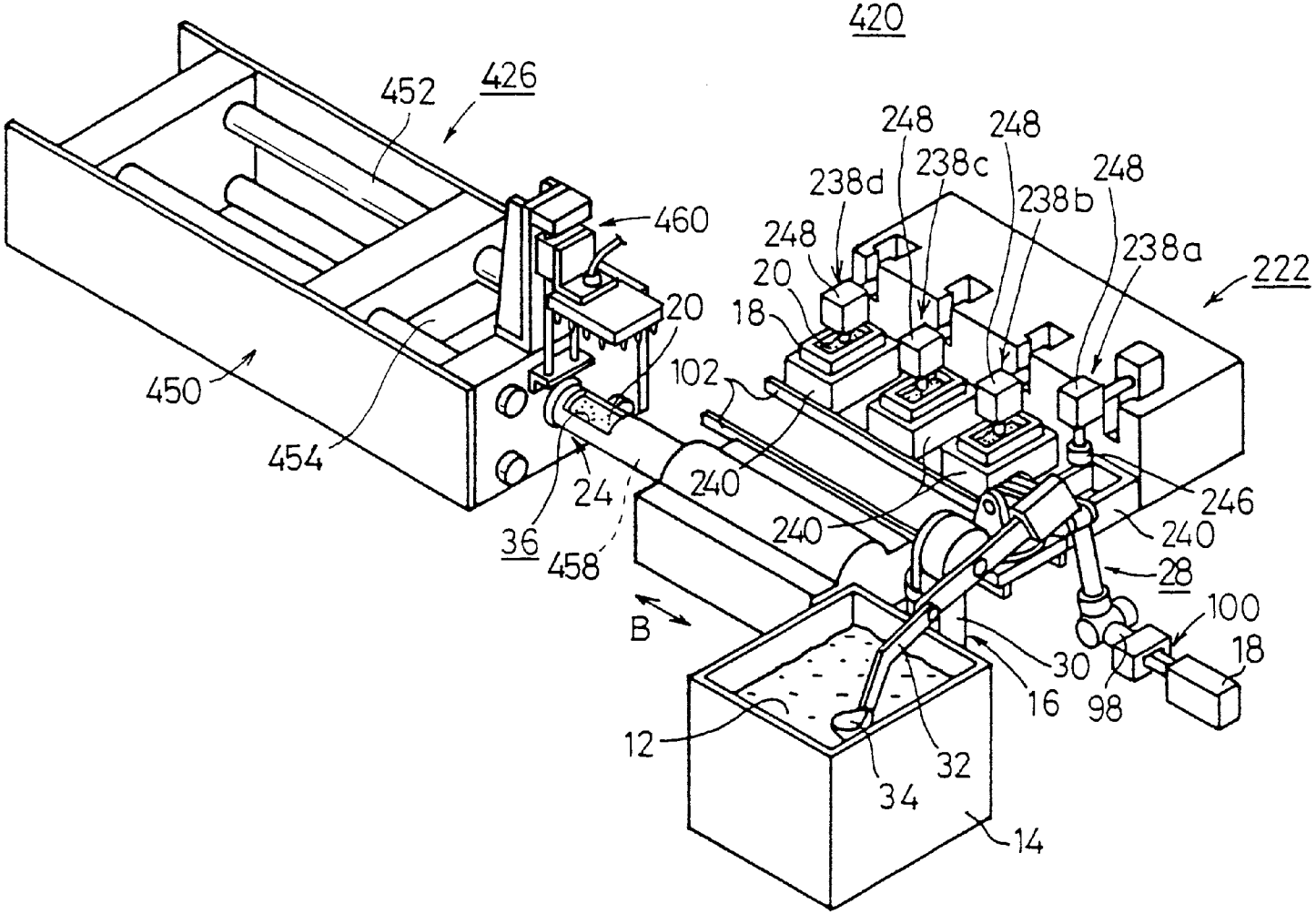
FIG. 23 shows a schematic perspective view illustrating an apparatus for producing a metal formed product according to a fifth embodiment of the present invention.
Figure 24:
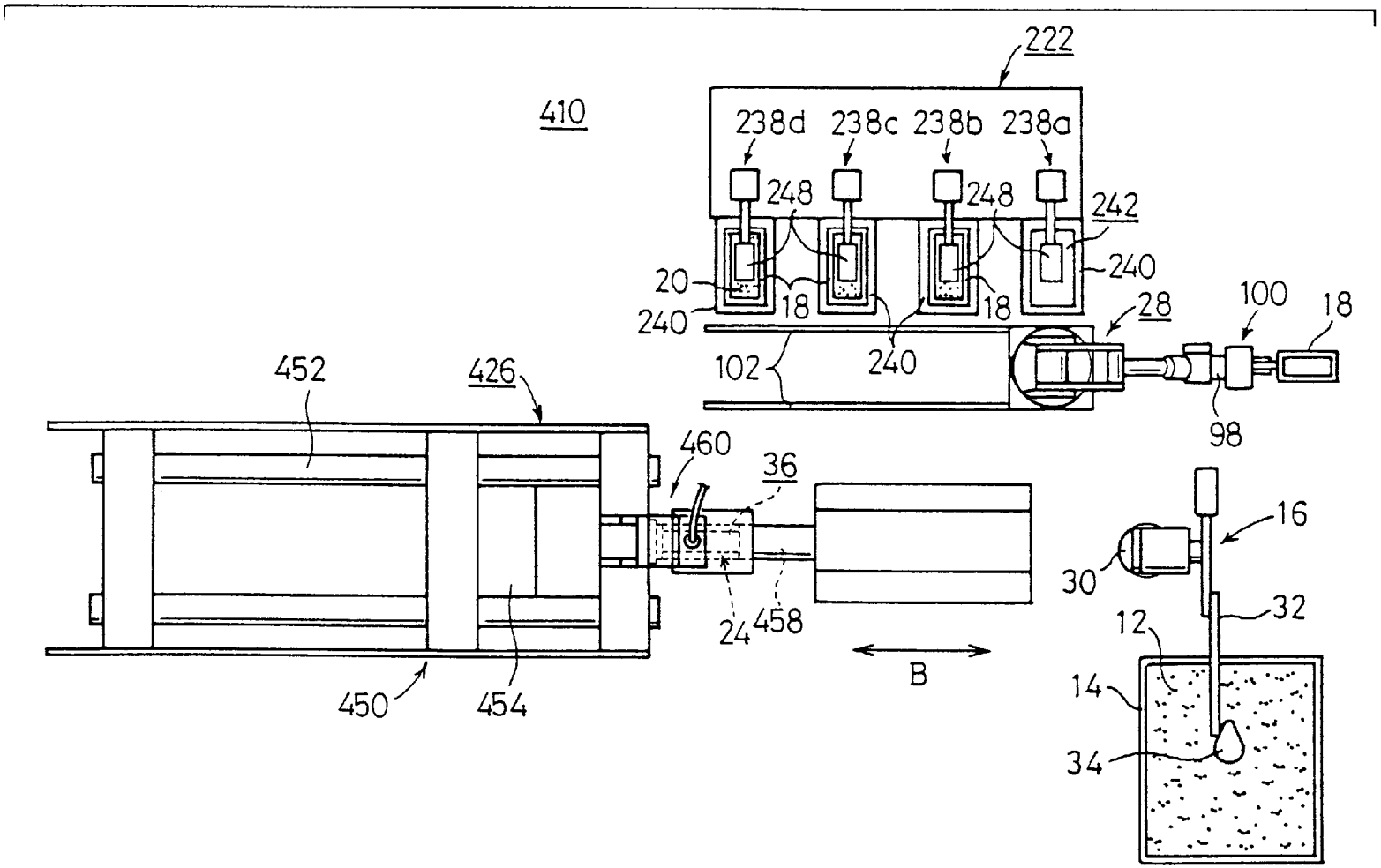
FIG. 24 shows a plan view illustrating the production apparatus.

FIG. 23 shows a schematic perspective view illustrating an apparatus 420 for producing a metal formed product according to a fifth embodiment of the present invention, and FIG. 24 shows a plan view illustrating the production apparatus 420. The same constitutive components as those of the production apparatus 210 according to the third embodiment are designated by the same reference numerals, detailed explanation of which will be omitted.

The production apparatus 420 comprises the molten metal-holding furnace 14, the molten metal-ladling robot 16, the semisolidified metal-producing mechanism 222, a forming machine 426, and the articulated robot 28 which is capable of transporting the crucible 18 to the molten metal-holding furnace 14, the semisolidified metal-producing mechanism 222, and the forming machine 426.

The forming machine 426 is provided with a main apparatus body 450. A mold 454 is installed openably/closably by the aid of tie rods 452. The main apparatus body 450 is provided with the injection sleeve 24 which communicates with an unillustrated cavity in the mold 454. The opening 36 is formed at the upper portion of the injection sleeve 24. An end of a plunger 458 is inserted into the injection sleeve 24. The plunger 458 is movable back and forth in the direction of the arrow B in the injection sleeve 24.

Figure 25:
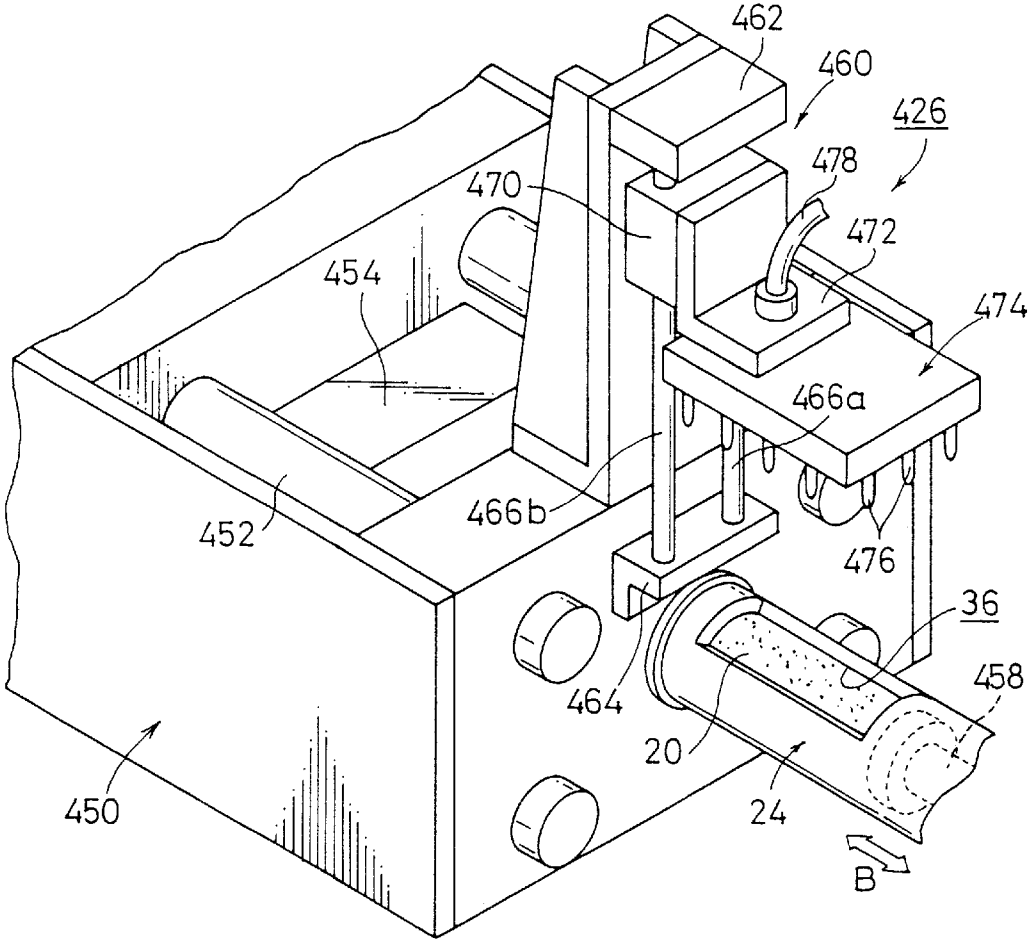
FIG. 25 shows a perspective view illustrating a forming machine which is incorporated into the production apparatus.

The main apparatus body 450 is installed with a cooling medium-jetting mechanism 460 for jetting a cooling medium, for example, cooling air toward the semisolidified metal 20 through the opening 36 of the injection sleeve 24. As shown in FIG. 25, the cooling medium-jetting mechanism 460 is provided with guide rods 466*a*, 466*b* which are supported by an upper attachment base 462 and a lower attachment base 464 secured to the main apparatus body 450 and which extend in the vertical direction in parallel to one another. A rodless cylinder 470 is supported movably back and forth in the vertical direction by the guide rods 466*a*, 466*b*.

A jetting section 474 is secured to the rodless cylinder 470 by the aid of a support block 472. A plurality of nozzles 476 made of copper are installed vertically downwardly to the jetting section 474. The respective nozzles 476 integrally communicate with a tube 478 which is fixed to the support block 472. The tube 478 is connected to an unillustrated air supply source.

Figure 26:
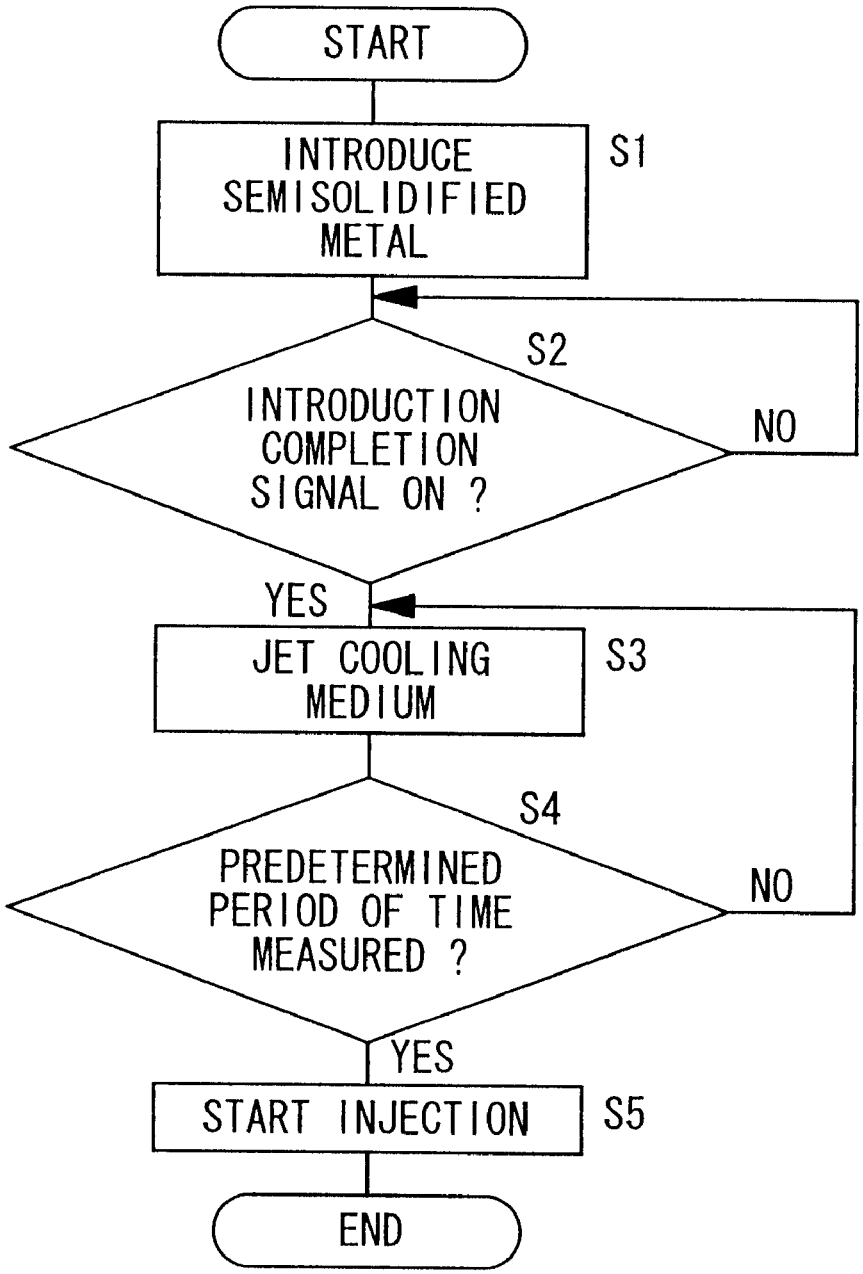
FIG. 26 shows a flow chart illustrating a production method.

The operation of the production apparatus 420 constructed as described above will be explained below along with a flow chart shown in FIG. 26 in relation to a production method concerning the embodiment of the present invention.

Figure 27:
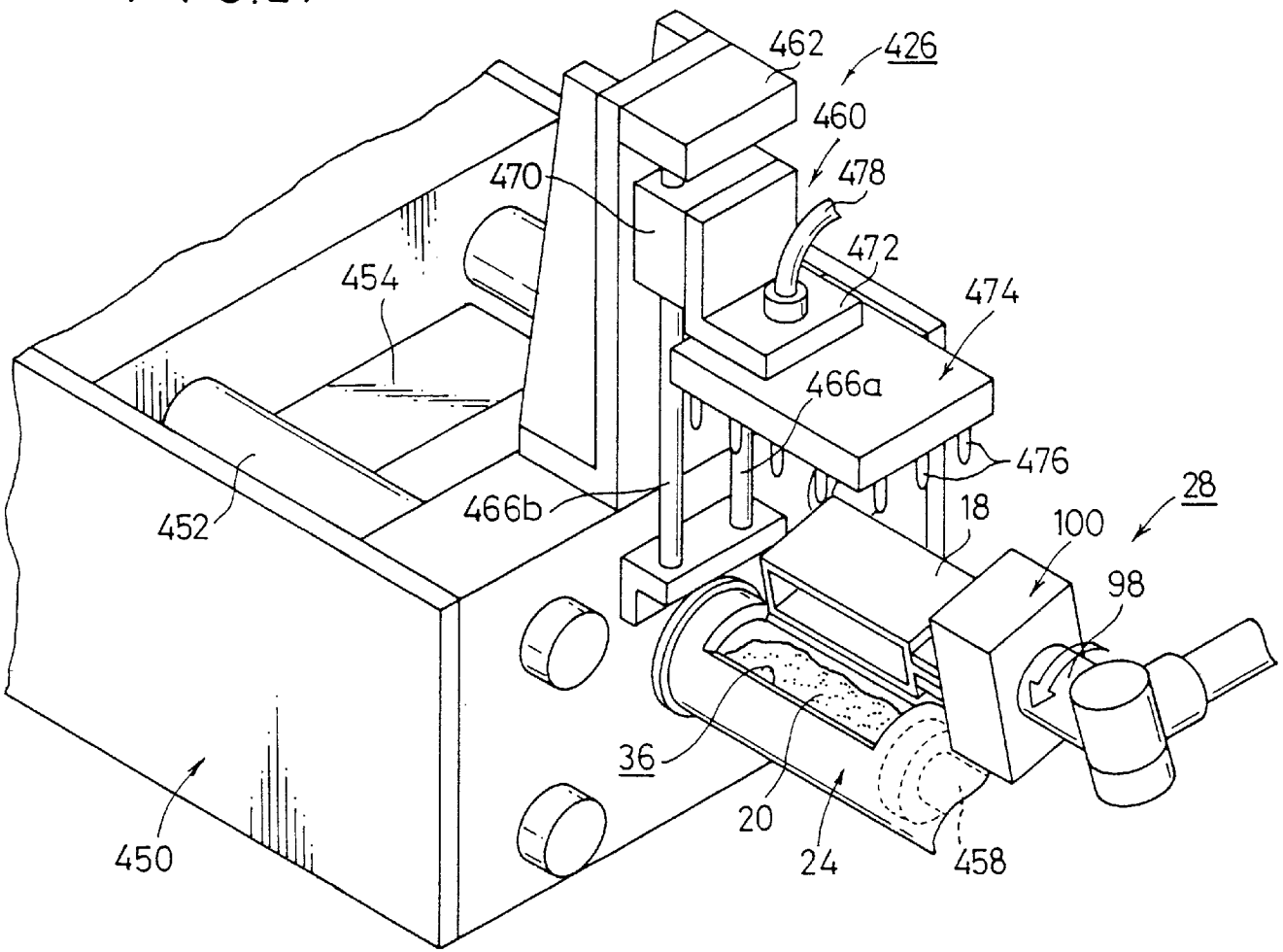
FIG. 27 illustrates the operation performed when semisolidified metal is introduced into an injection sleeve which constitutes the forming machine.

The articulated robot 28 arranges the crucible 18 which accommodates the semisolidified metal 20, in the horizontal attitude corresponding to the opening 36 of the forming machine 426. As shown in FIG. 27, the crucible 18 is inverted integrally with the gripping section 100 in accordance with the rotary action of the wrist 98. The semisolidified metal 20 in the crucible 18 is allowed to fall, and it is introduced through the opening 36 into the injection sleeve 24 (step S1 in FIG. 26). If it is confirmed that the semisolidified metal 20 has been introduced into the injection sleeve 24 (YES in the step S2), the routine proceeds to the step S3 to drive the cooling medium-jetting mechanism 460.

Figure 28:
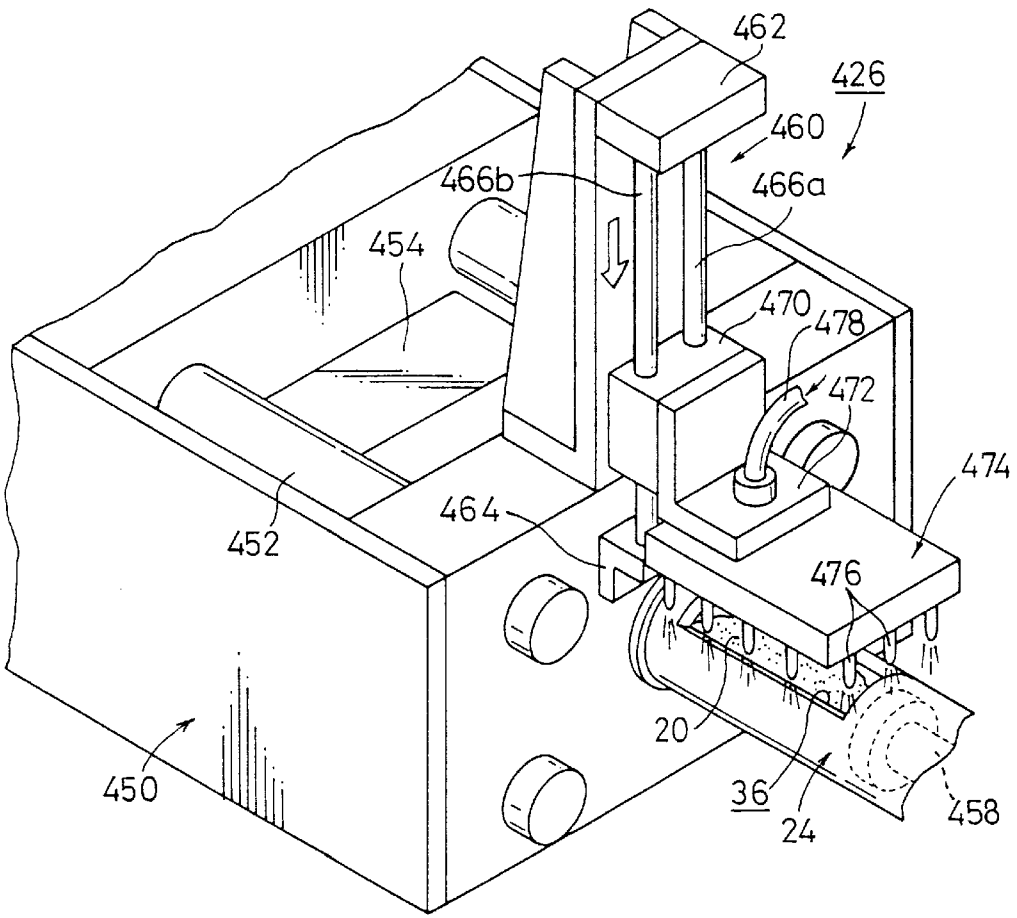
FIG. 28 illustrates the operation performed when cooling air is jetted to the semisolidified metal through an opening of the injection sleeve.

As shown in FIG. 28, the cooling medium-jetting mechanism 460 is operated such that the jetting section 474 is moved vertically in the downward direction integrally with the support block 472 in accordance with the driving action of the rodless cylinder 470. The jetting section 474 is arranged closely to the opening 36 of the injection sleeve 24. In this state, when the cooling air is supplied to the tube 478 from the unillustrated air supply source, the cooling air is jetted toward the semisolidified metal 20 through the opening 36 from the forward ends of the respective nozzles 476 which communicate with the tube 478.

When the cooling air is jetted for a predetermined period of time, specifically for a period of 6.0 seconds (YES in the step S4), the jetting of the cooling air from the cooling medium-jetting mechanism 460 is stopped. On the other hand, the injection of the semisolidified metal 20 in the injection sleeve 24 is started by the aid of the plunger 458 (step S5).

Figure 29:
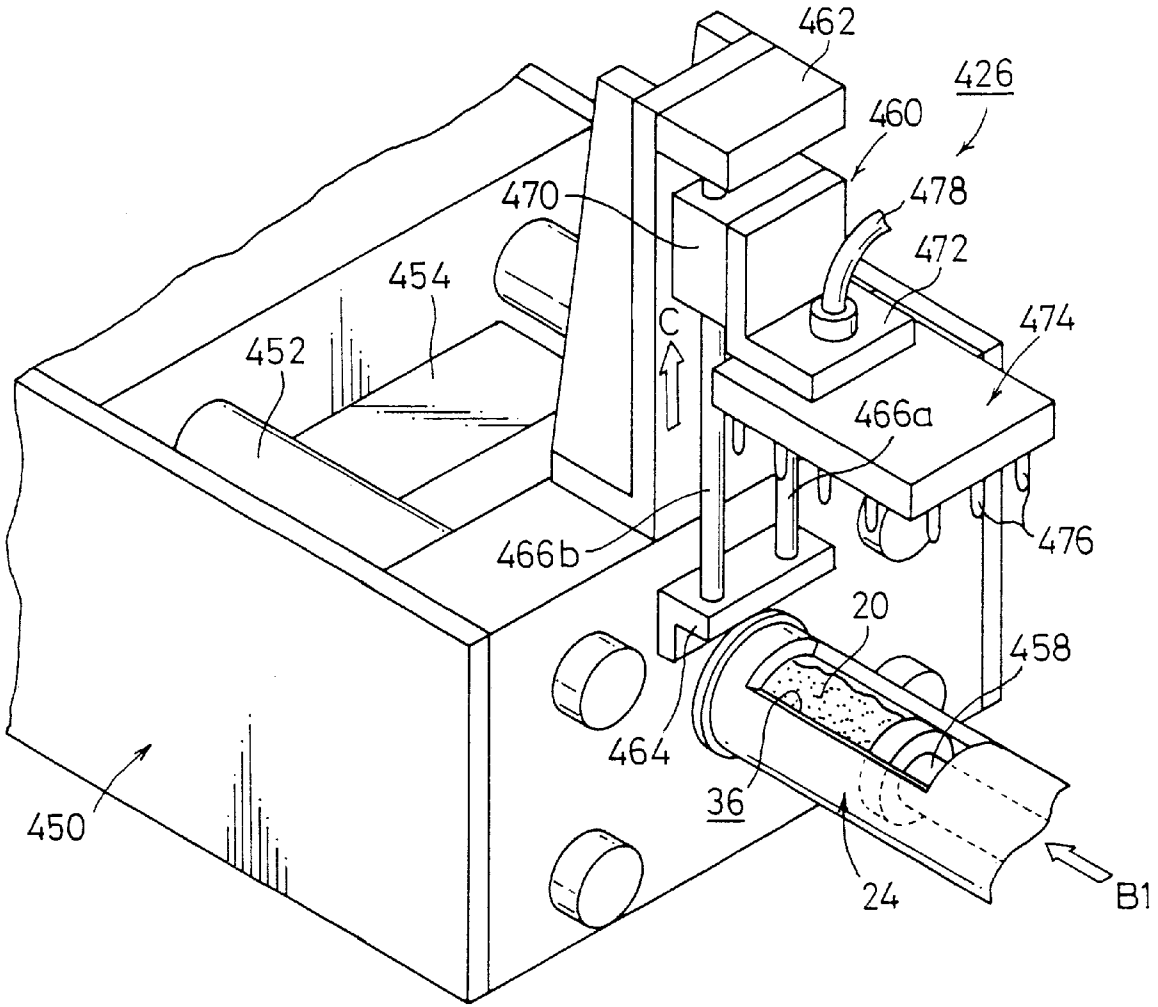
FIG. 29 illustrates the operation performed when the semisolidified metal is charged to a cavity.

During this process, as shown in FIG. 29, the cooling medium-jetting mechanism 460 is operated such that the rodless cylinder 470 is retracted vertically in the upward direction (direction of the arrow C) along the guide rods 466*a*, 466*b*, and the plunger 458 is advanced into the injection sleeve 24 (in the direction of the arrow B1). Accordingly, the semisolidified metal 20 in the injection sleeve 24 is charged to the unillustrated cavity formed in the mold 454, and the metal formed product is injection-molded.

In the fifth embodiment, after the semisolidified metal 20 is introduced into the injection sleeve 24, the cooling medium-jetting mechanism 460 is driven, and the cooling air is jetted for the predetermined period of time through the opening 36 of the injection sleeve 24 toward the semisolidified metal 20. Accordingly, the surface on the side of the opening 36, of the semisolidified metal 20 in the injection sleeve 24 is forcibly cooled, and the surface is quickly hardened.

Therefore, when the semisolidified metal 20 in the injection sleeve 24 is charged into the unillustrated cavity formed in the mold 454 in accordance with the pressing action of the plunger 458, it is possible to effectively avoid the overflow of the semisolidified metal 20 from the opening 36 of the injection sleeve 24 to the outside. Accordingly, the following effect is obtained. That is, the occurrence of defective formation, which would be otherwise caused by shortage of charging is reliably avoided. It is possible to efficiently obtain the metal formed product having a stable quality.

Further, the semisolidified metal 20 in the injection sleeve 24 is forcibly cooled by the aid of the cooling medium-jetting mechanism 460. Therefore, it is possible to reduce the hardening time for the semisolidified metal 20 all at once. Accordingly, an advantage is obtained such that it is possible to shorten the forming cycle time of the metal formed product.

When the aluminum alloy is introduced into the injection sleeve 24 at 590° C., and it is cooled to 560° C. (lower limit value) under a cooling condition of −5° C./second, then the jetting time for the cooling air by the cooling medium-jetting mechanism 460 is set to be within a range of 2.5 seconds to 6.0 seconds. If the jetting time is not more than 2.5 seconds, then the surface of the semisolidified metal 20 is not hardened effectively, and it is feared that the semisolidified metal 20 may overflow to the outside during the injection. On the other hand, if the jetting time is not less than 6.0 seconds, then the hardening of the semisolidified metal 20 is advanced, and it is feared that any defective charge to the cavity may occur.

The fifth embodiment is provided with the plurality of nozzles 476. The nozzles 476 are made of copper. Therefore, the flow of air can be adjusted by freely bending the nozzles 476. It is possible to effectively maintain the function to cool the semisolidified metal 20.

Figure 30:
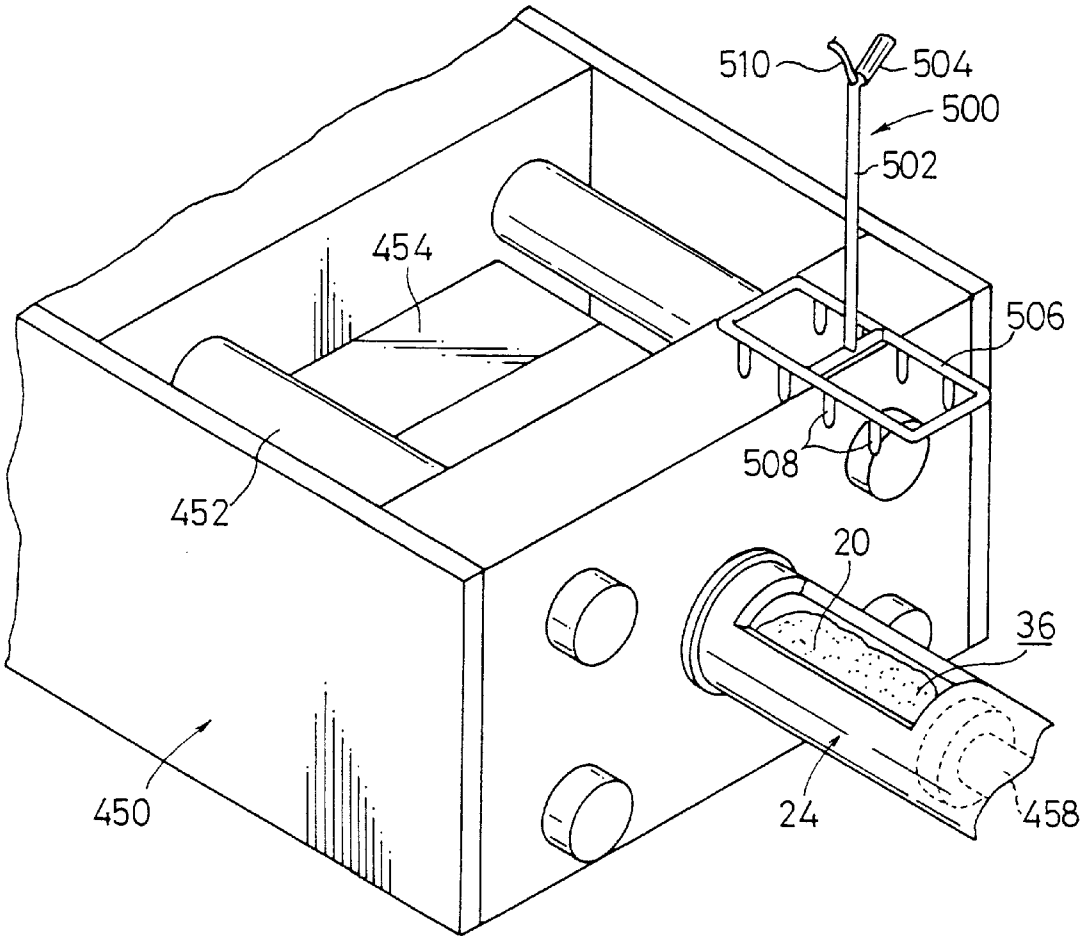
FIG. 30 shows a perspective view illustrating an another modified example of cooling medium-jetting mechanism which constitutes the fifth embodiment of the present invention.

In the fifth embodiment, the cooling medium-jetting mechanism 460, which is movable upwardly and downwardly by the aid of the rodless cylinder 470, is used for the main apparatus body 450. However, if necessary, a transportable cooling medium-jetting mechanism 500 may be used as shown in FIG. 30.

The cooling medium-jetting mechanism 500 is provided with a gripping grip 504 at a first end of a tube 502. A plurality of nozzles 508 are provided at a second end of the tube 502 together with a frame tube 506. The respective nozzles 508 communicate with an air hose 510 from the frame tube 506 via the tube 502. An unillustrated air supply source is connected to the air hose 510.

The cooling medium-jetting mechanism 500 constructed as described above is operated as follows. That is, an operator grips the grip 504 to arrange the nozzles 508 closely to the opening 36 of the injection sleeve 24. In this state, the cooling air from the unillustrated air supply source is jetted from the nozzles 508 via the air hose 510. Accordingly, the semisolidified metal 20, which is introduced into the injection sleeve 24, is forcibly cooled by the aid of the cooling air jetted through the opening 36. The surface of the semisolidified metal 20 is quickly hardened.

Figure 31:
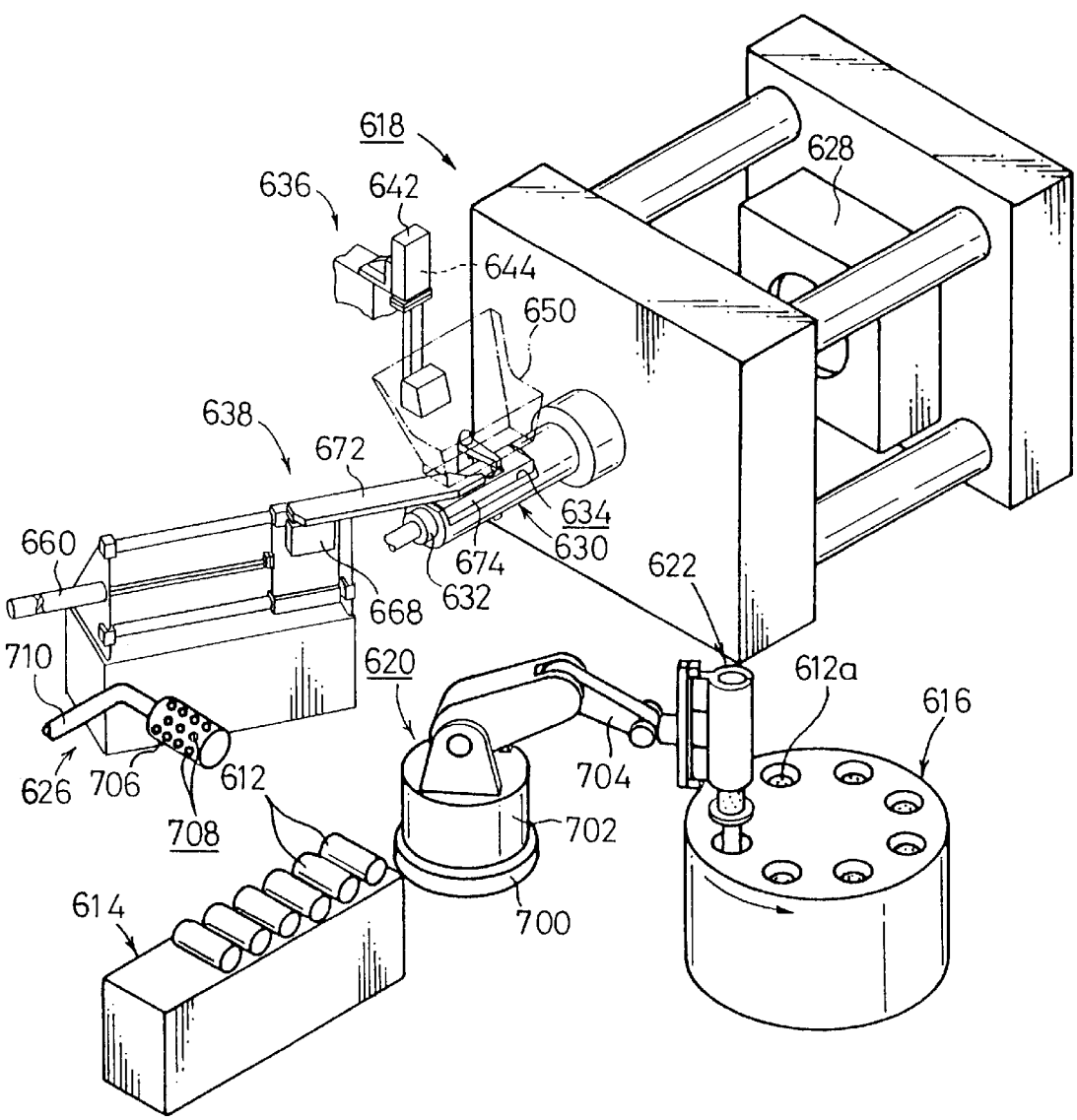
FIG. 31 shows a schematic perspective view illustrating an apparatus for producing a metal formed product according to a sixth embodiment of the present invention.
Figure 32:
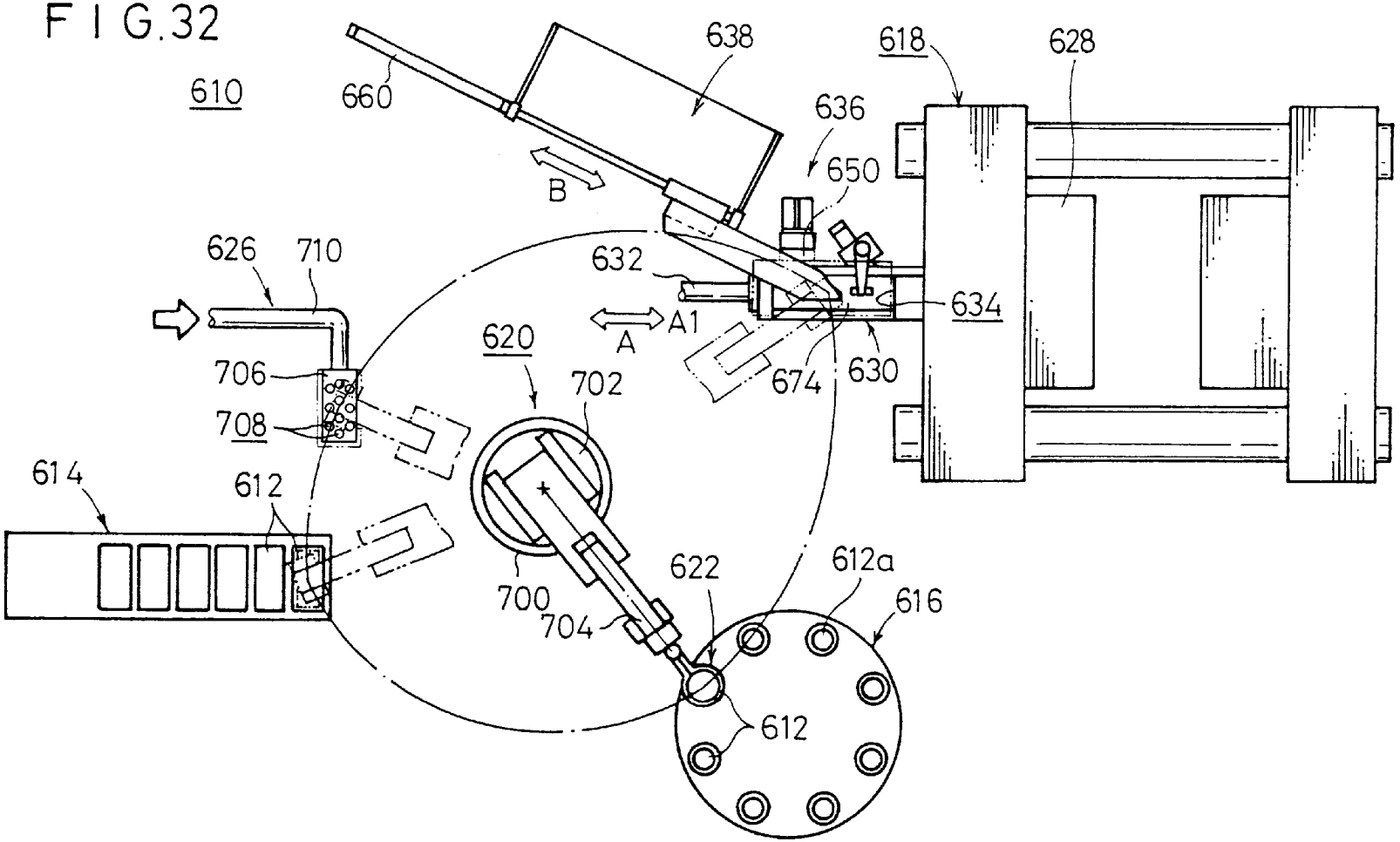
FIG. 32 shows a schematic plan view illustrating the production apparatus.

FIG. 31 shows a schematic perspective view illustrating an apparatus 610 for producing a metal formed product according to a sixth embodiment of the present invention, and FIG. 32 shows a schematic plan view illustrating the production apparatus 610.

The production apparatus 610 comprises a supply mechanism 614 for arranging a metal billet 612, a heating mechanism 616 for heating the metal billet 612 to obtain semimolten metal 612*a* as solid-liquid co-existing metal, a forming machine (forming mechanism) 618 for forming a metal formed product from the semimolten metal 612*a*, a transport robot 620 for transporting the metal billet 612 from the supply mechanism 614 to the heating mechanism 616 and transporting the semimolten metal 612*a* from the heating mechanism 616 to the forming machine 618, and a cooling mechanism 626 for applying a cooling treatment to a billet-gripping means 622 which constitutes the transport robot 620.

The metal billet 612, which is arranged at the supply mechanism 614, is composed of, for example, aluminum, alloy thereof, magnesium, or alloy thereof. A plurality of metal billets 612 are arranged in a state of ordinary temperature. The heating mechanism 616 accommodates a plurality of metal billets 612, and a high frequency hardening treatment is applied to the metal billets 612 while making rotation in the direction of the arrow. Thus, the respective metal billets 612 are heated to be in a semimolten state.

The forming machine 618 comprises a mold 628, an injection sleeve 630 which communicates with an unillustrated cavity in the mold 628, a plunger 632 which presses, toward the cavity, the semimolten metal 612*a* introduced into the injection sleeve 630, a guide means 636 which is movable back and forth from a position over an opening 634 formed at an upper surface of the injection sleeve 630 to make engagement with the opening 634 so that the semimolten metal 612*a* may be guided to the opening 634, and a cover means 638 which is capable of closing the opening 634 by covering the opening 634 of the injection sleeve 630 from an upward position.

Figure 33:
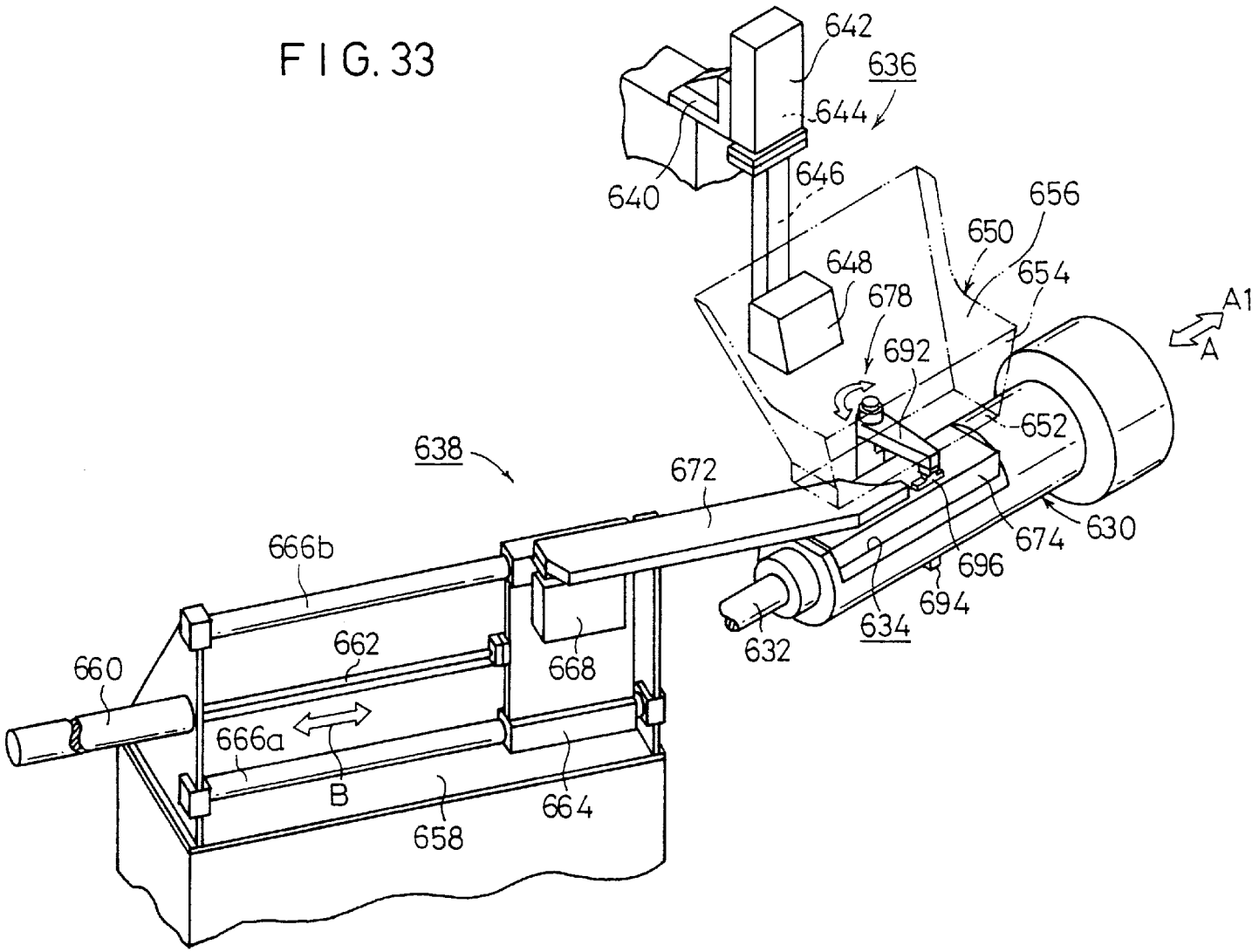
FIG. 33 shows a perspective view illustrating a guide means and a cover means which constitute a forming machine.
Figure 34:
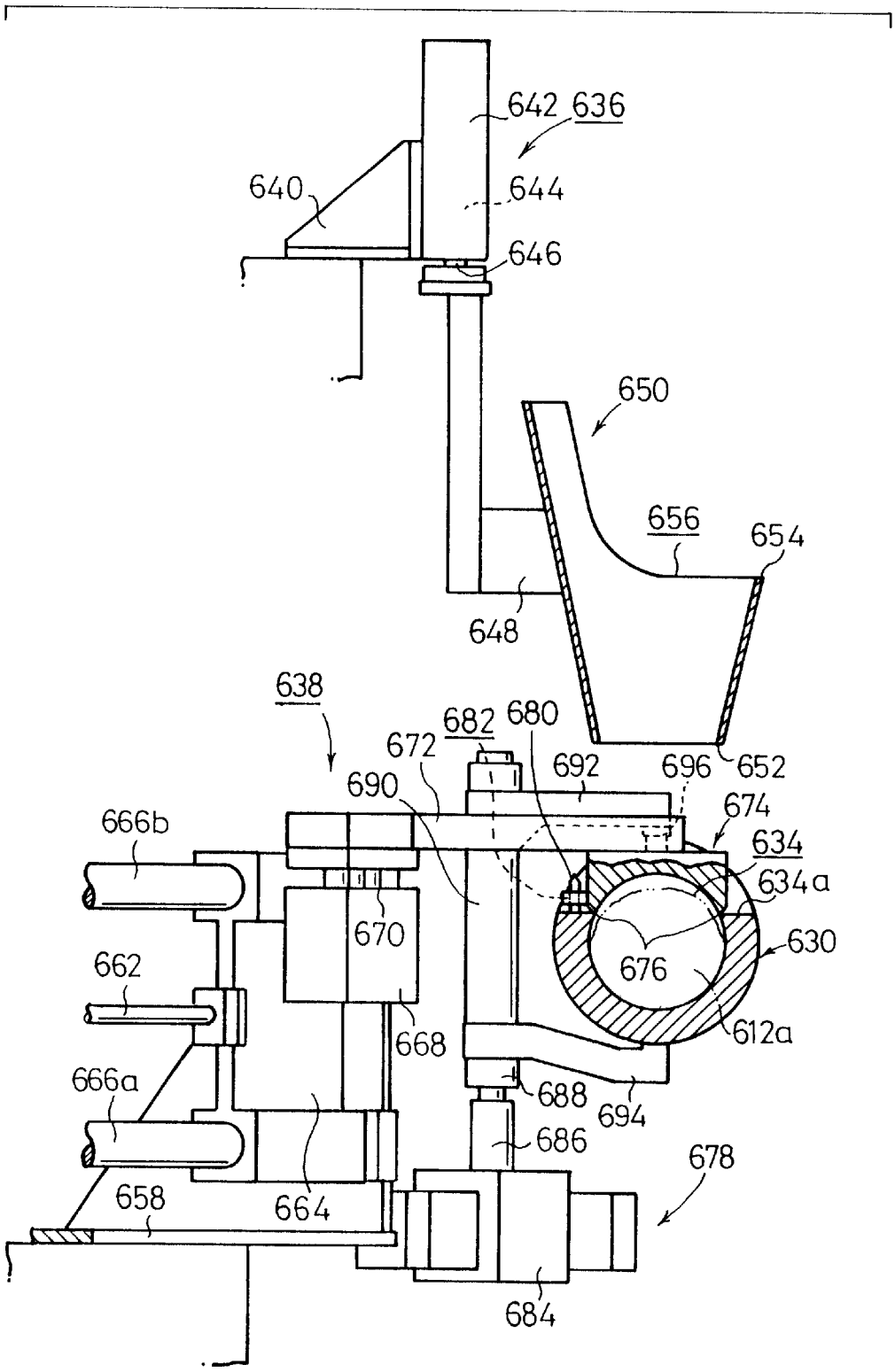
FIG. 34 shows a front view illustrating the guide means and the cover means.

As shown in FIGS. 33 and 34, the guide means 636 is provided with a first attachment base 640. A cylinder (elevator means) 644, which is surrounded by a casing 642, is attached to the first attachment base 640. A fixing member 648 is provided on a rod 646 which extends downwardly from the cylinder 644. A sleeve guide 650 is secured to the fixing member 648.

The sleeve guide 650 is constructed such that the lower end 652 has a narrow width along the diametral direction of the injection sleeve 630 as compared with the upper end 654. The lower end 652 is engageable with the opening 634 of the injection sleeve 630. The lower end 652 is designed to have approximately the same size as that of the opening size of the opening 634 in the axial direction of the injection sleeve 630 (direction of the arrow A). An opening 656 for guiding the semimolten metal 612*a* to the opening 634 is provided in the sleeve guide 650.

The cover means 638 is provided with a second attachment base 658. The second attachment base 658 is provided with a cylinder (first actuator) 660 which is directed in a direction (direction of the arrow B) that is inclined by a predetermined angle with respect to the axial direction of the injection sleeve 630. A slide base 664 is secured to a rod 662 which extends from the cylinder 660. Guide bars 666*a*, 666*b*, which are disposed over and under the rod 662 and which are parallel to one another, are arranged on the second attachment base 658. The guide bars 666*a*, 666*b* are fitted to the slide base 664, and they guide the slide base 664.

An elevator cylinder (second actuator) 668 is installed to the slide base 664. A first end of an arm member 672 is secured to a rod 670 which extends upwardly from the elevator cylinder 668. The arm member 672 is constructed to have a long size in the direction of the arrow B. A sleeve cover (cover member) 674 is installed to a second end of the arm member 672. The sleeve cover 674 corresponds to the shape of the opening 634 of the injection sleeve 630. The sleeve cover 674 is provided with acute forward end sections 676 which make line to line contact with an inner end of an end surface 634*a* of the opening 634, with each of their inner surfaces being designed to have a circular arc-shaped configuration.

A positioning and holding means 678 for positioning and holding the sleeve cover 674 with respect to the opening 634 includes a pin 680 which is provided on the injection sleeve 630. The pin 680 is fitted to a hole 682 which is formed in the sleeve cover 674. Accordingly, the sleeve cover 674 is positioned with respect to the opening 364.

The positioning and holding means 678 is provided with a motor 684 which is arranged corresponding to the side of the injection sleeve 630. A rotary rod 688 is coaxially connected to a rotary shaft 686 of the motor 684. The rotary rod 688 is rotatably supported by a cylindrical member 690. An upper damper 692 and a lower damper 694 are secured to upper and lower portions of the rotary rod 688 respectively. The lower damper 694 makes sliding contact with the lower circumferential surface of the injection sleeve 630, while the upper clamper 692 is engageable with a fastening member 696 which is provided on the sleeve cover 674.

As shown in FIGS. 31 and 32, the transport robot 620 comprises a main swinging body 702 which is swingable with respect to a base pedestal 700. The billet-gripping means 622, which is openable and closable, is installed to a forward end of an articulated arm 704 provided on the main swinging body 702. The cooling mechanism 626 is provided with a main body 706 which is arranged in the billet-gripping means 622. A plurality of air blow holes 708 are formed at the circumferential surface of the main body 706. An unillustrated cooling medium supply source, for example, an air supply source is connected via a tube 710 to the main body 706.

The operation of the production apparatus 610 constructed as described above will be explained below.

At first, the transport robot 620 is driven, and the arm 704 and the main swinging body 702 are driven. The billet-gripping means 622 is transported to a position over the supply mechanism 614, and one metal billet 612 on the supply mechanism 614 is gripped. The metal billet 612, which is gripped by the billet-gripping means 622, is transported from the supply mechanism 614 to the heating mechanism 616 in accordance with the action of the transport robot 620. The metal billet 612 is arranged with respect to the heating mechanism 616.

In the heating mechanism 616, the high frequency hardening treatment is applied, while the metal billet 612 is moved in the direction of the arrow. Accordingly, the metal billet 612 is in a desired solid-liquid co-existing state to obtain the semimolten metal 612*a*. Subsequently, the billet-gripping means 622, which constitutes the transport robot 620, grips the semimolten metal 612*a* obtained by being heated by the heating mechanism 616. The semimolten metal 612*a* is introduced in a horizontal attitude into the opening 634 of the injection sleeve 630 which constitutes the forming machine 618.

In the sixth embodiment, the guide means 636 and the cover means 638 are selectively used depending on the sleeve filling rate R of the injection sleeve 630 and the solidus rate of the semimolten metal 612*a*.

Figure 35:
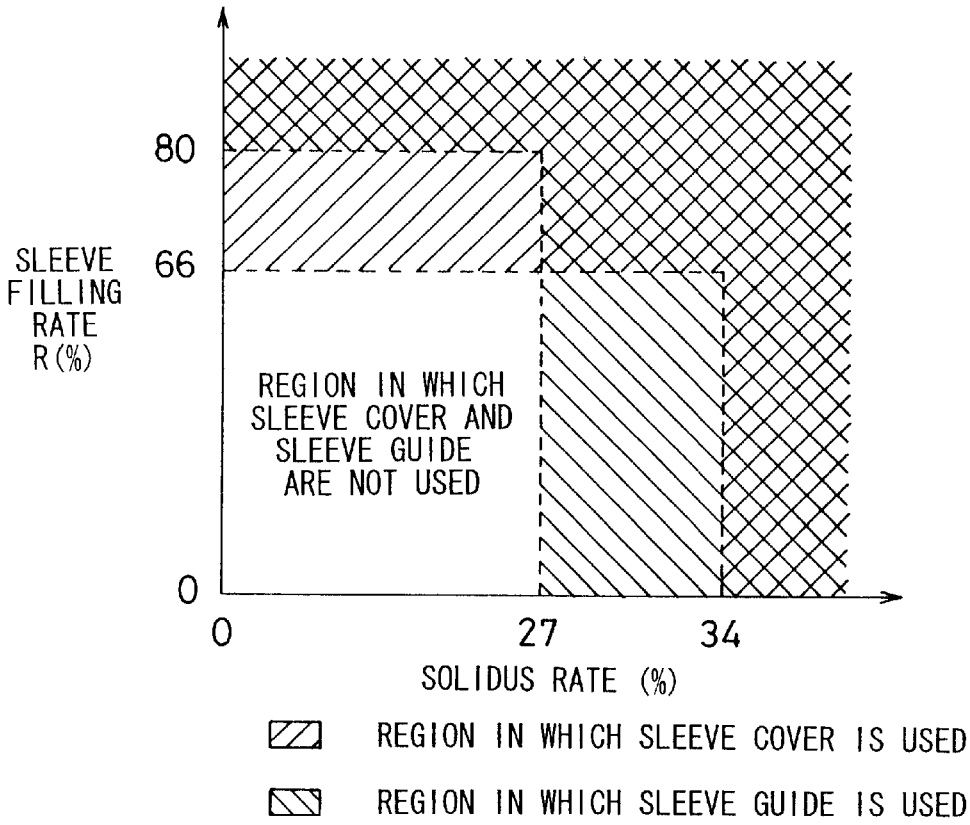
FIG. 35 illustrates the condition of the use of the guide means and the cover means on the basis of the sleeve filling rate R and the solidus rate.

This procedure will be explained on the basis of FIG. 35. If the sleeve filling rate R is not less than 66%, it is feared that any warpage occurs in the semimolten metal 612*a* during the injection of the semimolten metal 612*a*. Therefore, the sleeve cover 674, which constitutes the cover means 638, is used. Further, if the solidus rate is not less than 34%, it is feared that the semimolten metal 612*a* overflows from the opening 634 of the injection sleeve 630. Therefore, the cover means 638 is used in the same manner.

On the other hand, if the sleeve filling rate R is further increased to be not less than 80%, it is feared that the semimolten metal 612*a* spills out when the semimolten metal 612*a* is introduced into the opening 634. Therefore, the sleeve guide 650, which constitutes the guide means 636, is used. If the solidus rate is not less than 27%, the semimolten metal 612*a* tends to be introduced while maintaining the shape of being gripped by the billet-gripping means 622. It is feared that the semimolten metal 612*a* does not enter the opening 634. Therefore, the guide means 636 is used in the same manner.

Figure 36:
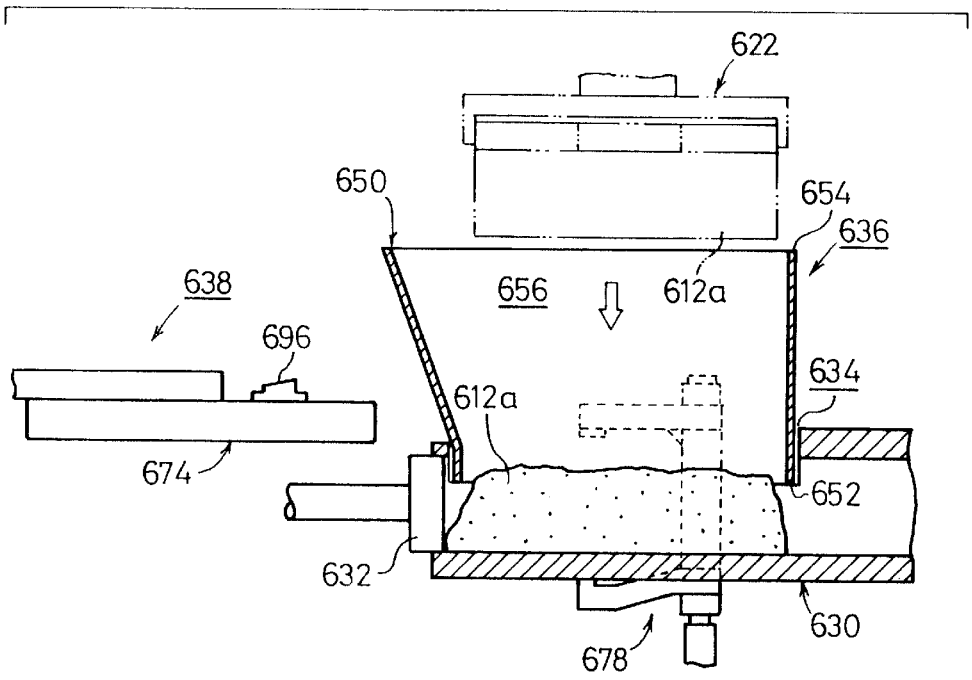
FIG. 36 illustrates the operation performed when the guide means is engaged with an injection sleeve.

Explanation will be made below for a case in which both of the guide means 636 and the cover means 638 are used. At first, the sleeve cover 674, which constitutes the cover means 638, is retracted to a position separated from the injection sleeve 630. The positioning and holding means 678 is separated from the injection sleeve 630. In this state, the cylinder 644, which constitutes the guide means 636, is driven, and the rod 646 is displaced vertically downwardly. Accordingly, the sleeve guide 650, which is supported at the lower end of the rod 646 by the aid of the fixing member 648, is moved downwardly from the position over the injection sleeve 630, and the lower end 652 is fitted to the opening 634 of the injection sleeve 630 (see FIG. 36).

Subsequently, the billet-gripping means 622, which constitutes the transport robot 620, introduces the semimolten metal 612*a* in the horizontal attitude from the position over the sleeve guide 650 which constitutes the guide means 636. The semimolten metal 612*a* is introduced into the opening 656 from the widened upper end 650*a* of the sleeve guide 650. The semimolten metal 612*a* is guided to the opening 634 of the injection sleeve 630 along the narrow-width lower end 652, and it is introduced into the injection sleeve 630.

As described above, in the sixth embodiment, the semimolten metal 612*a* is allowed to fall from the position over the sleeve guide 650 in the state in which the sleeve guide 650 for constructing the guide means 636 is arranged and engaged with the opening 634 of the injection sleeve 630. Accordingly, the semimolten metal 612*a* is reliably introduced into the injection sleeve 630 through the opening 634 in accordance with the guiding action of the sleeve guide 650.

Especially, when the sleeve filling rate R is increased to be not less than 80%, or when the solidus rate of the semimolten metal 612*a* is not less than 27%, then the semimolten metal 612*a* does not overflow from the opening 634, and the semimolten metal 612*a* does not fail to enter the opening 634. Accordingly, an effect is obtained such that the semimolten metal 612*a* can be reliably introduced into the injection sleeve 630 with ease.

Figure 37:
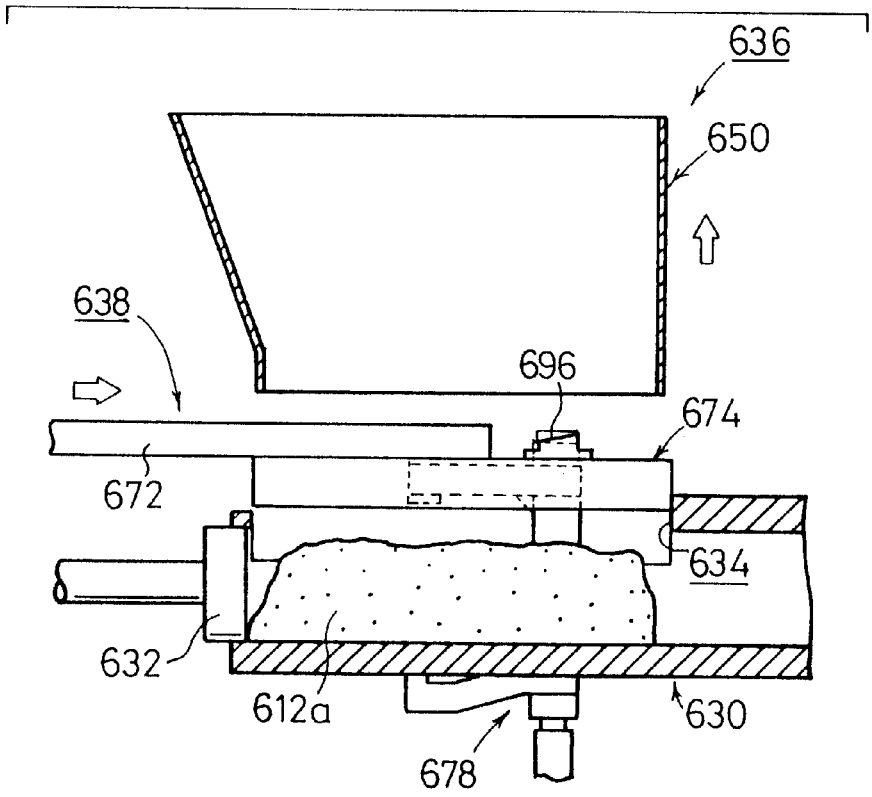
FIG. 37 illustrates the operation performed when the guide means is separated from the injection sleeve, and then the cover means is moved.

After the semimolten metal 612*a* is introduced into the injection sleeve 630, the cylinder 644 is driven to move the sleeve guide 650 to the upward position. The sleeve guide 650 is arranged at the position separated from the injection sleeve 630. Subsequently, the cylinder 660, which constitutes the cover means 638, is driven, and the slide base 664 is moved in the direction of the arrow B in accordance with the guiding action of the guide bars 666*a*, 666*b*. Therefore, the sleeve cover 674, which is supported by the slide base 664 by the aid of the arm member 672, is moved toward the injection sleeve 630, and it is arranged at a position over the opening 634 (see FIG. 37).

In this situation, the elevator cylinder 668, which is secured to the slide base 664, is driven, and the sleeve cover 674 is moved downwardly integrally with the arm member 672. The opening 634 is closed by the sleeve cover 674. The forward end sections 676 of the sleeve cover 674 abut against the end surface 634*a* of the injection sleeve 630 (see FIGS. 34 and 38). During this process, the pin 680, which is secured to the injection sleeve 630, is fitted to the hole 680 provided for the sleeve cover 674. The sleeve cover 674 is accurately positioned with respect to the injection sleeve 630, i.e., with respect to the opening 634.

Further, the motor 684, which constitutes the positioning and holding means 678, is driven. The rotary rod 688 is rotated integrally with the rotary shaft 686. During this process, the lower clamper 694 and the upper clamper 692, which are secured to the rotary rod 688, make mutual approach to the injection sleeve 630 while making the swinging movement. The lower circumferential surface of the injection sleeve 630 is supported by the lower clamper 694. On the other hand, the upper clamper 692 is engaged with the fastening member 696 provided for the sleeve cover 674 to hold the sleeve cover 674.

Figure 38:
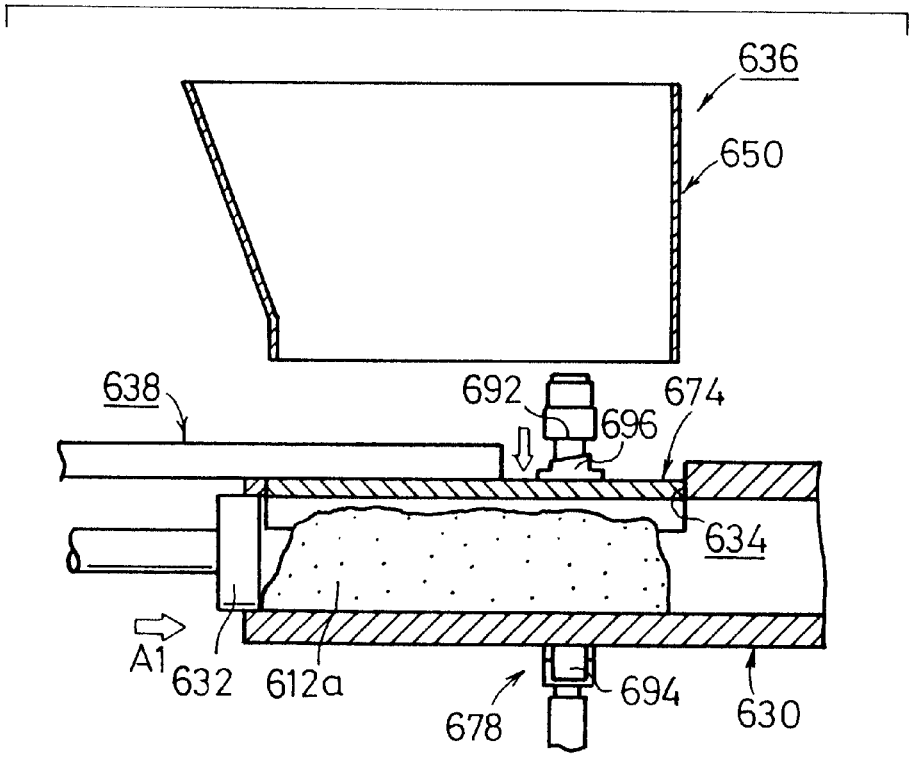
FIG. 38 illustrates the operation performed when an opening of the injection sleeve is closed by the cover means.

In this situation, as shown in FIG. 38, when the plunger 632 is displaced in the direction of the arrow Al in the injection sleeve 630, then the semimolten metal 612*a* in the injection sleeve 630 is pressurized in the direction of the arrow Al by the aid of the plunger 632, and it is charged into the unillustrated cavity.

As described above, when the semimolten metal 612*a* is injected in the injection sleeve 630, the opening 634 is closed by the sleeve cover 674 which constitutes the cover means 638. Therefore, even when the sleeve filling rate R is not less than 66%, it is possible to avoid the warpage of the semimolten metal 612*a*. Even when the solidus rate is not less than 34%, the semimolten metal 612*a* does not swell over the opening 634.

Accordingly, in the sixth embodiment, even when the sleeve filling rate R and the solidus rate are diversely changed, the guide means 636 and the cover means 638 are selectively used. Therefore, the semimolten metal 612*a* is reliably introduced into the injection sleeve 630. Further, the semimolten metal 612*a* can be charged to the unillustrated cavity smoothly and reliably in accordance with the pressurizing action of the plunger 632 in the injection sleeve 630. Therefore, an effect is obtained such that the metal formed product, which has a stable quality, can be always obtained in an efficient manner.

After the unillustrated cavity is filled with the semimolten metal 612*a* and the casting operation is completed, the motor 684, which constitutes the positioning and holding means 678, is driven. The lower damper 694 and the upper damper 692 are separated from the injection sleeve 630. Subsequently, the elevator cylinder 668 is driven, and the sleeve cover 674 is moved upwardly integrally with the arm member 672. The pin 680 is disengaged from the hole 682, and the sleeve cover 674 is separated from the opening 634. When the cylinder 660 is driven, the sleeve cover 674 is moved in the direction to make separation from the injection sleeve 630.

On the other hand, the transport robot 620, which has introduced the semimolten metal 612*a* into the forming machine 618, is moved toward the cooling mechanism 626 to detect the temperature of the billet-gripping means 622. When the temperature of the billet-gripping means 622 is not more than a preset temperature, the billet-gripping means 622 is moved toward the supply mechanism 614 to newly perform the transport process for another metal billet 612. When the temperature of the billet-gripping means 622 is not less than the preset temperature, the cooling medium, for example, the air is introduced into the main body 706 which constitutes the cooling mechanism 626. The air is jetted toward the billet-gripping means 622 from the air blow holes 708 which are formed at the outer circumferential surface of the main body 706. Accordingly, the billet-gripping means 622 is cooled. After the temperature of the billet-gripping means 622 is not more than the preset temperature, the billet-gripping means 622 is transported toward the supply mechanism 614.

Figure 39:
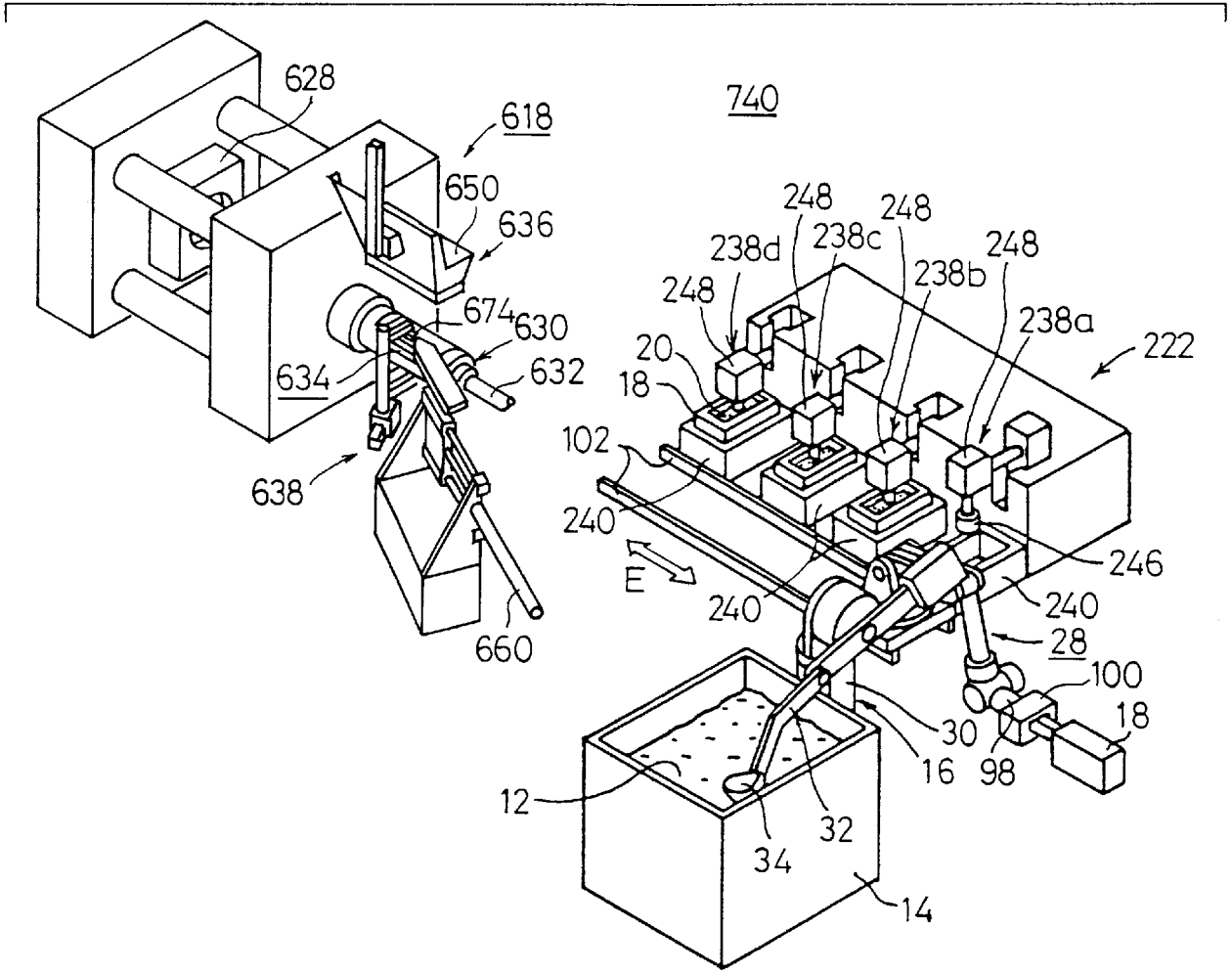
FIG. 39 shows a schematic perspective view illustrating an apparatus for producing a metal formed product according to a seventh embodiment of the present invention.
Figure 40:
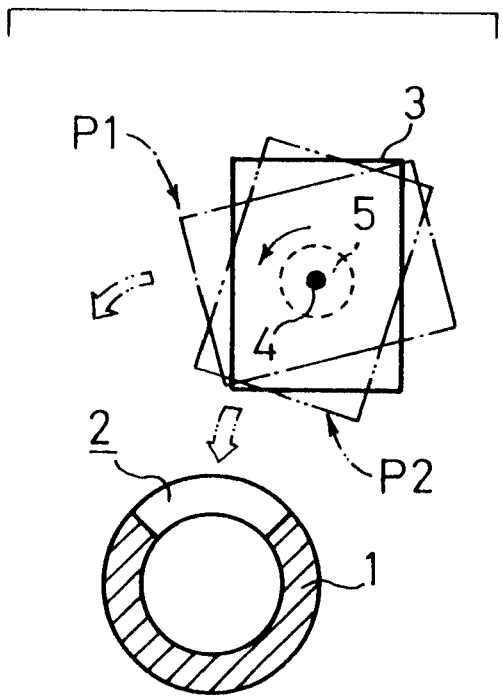
FIG. 40 illustrates a method for producing a metal formed product concerning the conventional technique.
Figure 41:
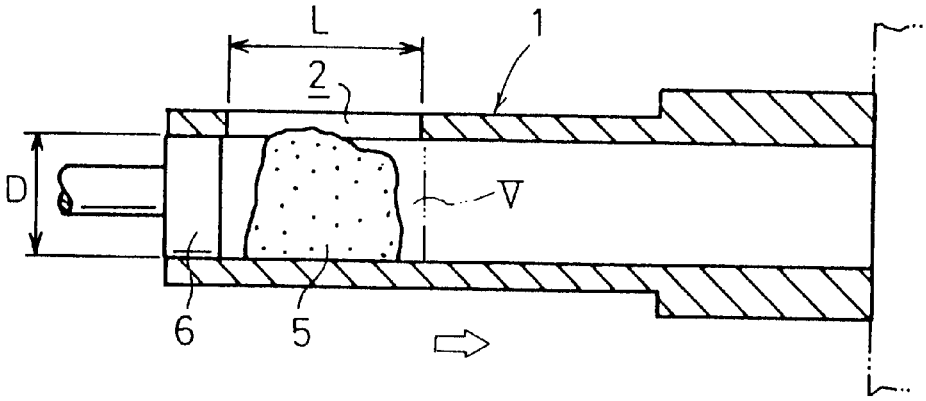
FIG. 41 illustrates the operation performed when semisolidified metal is injected in an injection sleeve concerning the conventional technique.

FIG. 39 shows a schematic perspective view illustrating an apparatus 740 for producing a metal formed product according to a seventh embodiment of the present invention. The same constitutive components as those of the production apparatuses 210, 610 according to the third and sixth embodiments described above are designated by the same reference numerals, detailed explanation of which will be omitted.

In the seventh embodiment, the cover means 638 and the guide means 636 for constructing the forming machine 618 are selectively used. Therefore, even when the sleeve filling rate R and the solidus rate are diversely changed, the semisolidified metal 20 can be reliably introduced into the injection sleeve 630. The semisolidified metal 20 can be charged to the unillustrated cavity smoothly and reliably in accordance with the pressurizing action of the plunger 632 in the injection sleeve 630. Therefore, for example, an effect is obtained such that the metal formed product, which has a stable quality, can be always obtained in an efficient manner, in the same manner as in the sixth embodiment.

In the apparatus for producing the metal formed product according to the present invention, the cooling member-restoring mechanism for applying the restoring treatment to the cooling member is arranged adjacent to the semisolidified metal-producing mechanism for obtaining the semisolidified metal from the molten metal. It is possible to immediately apply the restoring treatment to the cooling member with which the cooling and agitation treatments have been applied to the molten metal. Thus, the restoring treatment for the cooling member is quickly performed.

The articulated robot makes the back and forth operation linearly between the holding furnace and the forming mechanism. The plurality sets of the semisolidified metal-producing mechanisms and the cooling member-restoring mechanisms are arranged in the back and forth movement direction of the articulated robot. The operation of the articulated robot is simplified. The metal formed product having the high quality can be efficiently obtained by means of the simple control.

In the present invention, the vessel is transported to the holding furnace, the semisolidified metal-producing mechanism, the forming mechanism, and the vessel-restoring mechanism by the aid of the articulated robot. In the vessel-restoring mechanism, the vessel is disengaged from the articulated robot, and the predetermined restoring treatment is applied thereto. Therefore, the forming process for the metal formed product can be simultaneously performed during the period in which the restoring treatment is performed. Accordingly, the cycle time of the entire forming process for the formed product is effectively shortened. It is possible to efficiently produce the metal formed product having the high quality. It is possible to greatly improve the production efficiency. Further, in the vessel-restoring mechanism, the predetermined restoring treatment is applied in the state in which the vessel is held while directing its opening downwardly. Therefore, for example, the operation for removing adhered matters is performed easily and quickly. It is easy to realize the efficient restoring treatment for the vessel.

In the present invention, the vessel is provided, in which the predetermined amount of the molten metal is accommodated in order to obtain the semisolidified metal in accordance with the agitating action. The gripping engaging section, with which the gripping mechanism of the articulated robot is engaged, is provided at only one side surface of the vessel. It is possible to effectively miniaturize the gripping mechanism. Further, the vessel is held reliably and tightly by the aid of the gripping engaging section. Accordingly, for example, it is possible to avoid any disengagement of the vessel as less as possible. The semisolidified metal can be introduced smoothly and reliably from the vessel into the opening of the injection sleeve.

In the present invention, the gripping mechanism, which is provided for the articulated robot, includes the first clamp means for directly gripping the gripping engaging section provided at only one side surface of the vessel, and the second clamp means for gripping the first clamp means integrally with the vessel. The vessel can be tightly gripped by means of the one-side support hand structure. Accordingly, the vessel, which is gripped by the gripping mechanism, is prevented from unnecessary movement and falling. Thus, it is possible to efficiently perform the entire operation for producing the metal formed product.

In the present invention, there are provided the guide means capable of guiding the solid-liquid co-existing metal to the opening of the injection sleeve, and the cover means capable of closing the opening. The solid-liquid co-existing metal can be reliably charged to the cavity without being affected by the sleeve filling rate and the solidus rate. Accordingly, it is possible to effectively avoid any defective charge of the solid-liquid co-existing metal. It is possible to always produce the metal formed product having the stable quality efficiently under the constant injection condition.

In the present invention, after the solid-liquid co-existing metal is introduced into the injection sleeve, the cooling medium is jetted toward the solid-liquid co-existing metal through the opening of the injection sleeve. Accordingly, the surface of the solid-liquid co-existing metal is forcibly cooled and hardened. Therefore, when the solid-liquid co-existing metal is charged to the cavity, it is possible to effectively avoid any shortage of charge of the solid-liquid co-existing metal. It is possible to efficiently obtain the metal formed product having the high quality. Further, the solid-liquid co-existing metal in the injection sleeve is quickly cooled by jetting the cooling medium. Therefore, it is possible to shorten the cycle time all at once.

In the present invention, the vessel, which is gripped by the gripping section of the articulated robot, is rotated up to the predetermined angle range in accordance with the rotary action of the rotary shaft of the gripping section. After that, the respective axes of the articulated robot are selectively operated, and thus the vessel is tilted about the virtual tilting axis which is different from the center of the rotation. The solid-liquid co-existing metal in the vessel is reliably introduced into the opening of the injection sleeve. Accordingly, all amount of the solid-liquid co-existing metal in the vessel can be introduced into the injection sleeve. No solid-liquid co-existing metal remains in the vessel. The entire operation for supplying the solid-liquid co-existing metal can be efficiently performed in accordance with the simple operation.

What is claimed is:

1. An apparatus for producing a metal formed product, comprising:

a holding furnace for holding molten metal;

a semisolidified metal-producing mechanism provided with a vessel for accommodating a predetermined amount of said molten metal therein, for agitating said molten metal in said vessel to give a predetermined slurry state by using a cooling member to obtain semisolidified metal;

a cooling member-restoring mechanism arranged adjacent to said semisolidified metal-producing mechanism, for applying a restoring treatment so that said cooling member has a desired function;

a forming mechanism for forming said semisolidified metal to have a predetermined shape; and an articulated robot capable of transporting said vessel to said holding furnace, said semisolidified metal-producing mechanism, and said forming mechanism, wherein:

said articulated robot is arranged to be linearly movable back and forth between said holding furnace and said forming mechanism;

a plurality of sets of said semisolidified metal-producing mechanisms and said cooling member-restoring mechanisms are arranged along a direction of back and forth movement of said articulated robot; and each of said cooling member-restoring mechanisms comprises transport means to which said cooling member is detachably attached and which is capable of gripping and successively transporting said cooling member through respective restoring treatment stations.

2. The apparatus for producing said metal formed product according to claim 1, wherein:

rails for moving said articulated robot linearly back and forth are arranged between said holding furnace and said forming mechanism; and said plurality of sets of said semisolidified metal-producing mechanisms and said cooling member-restoring mechanisms are arranged along one side of said rails.

3. The apparatus for producing said metal formed product according to claim 1, further comprising a robot for automatically delivering said cooling member between said semisolidified metal-producing mechanism and said cooling member-restoring mechanism.

4. The apparatus for producing a metal formed product according to claim 1, wherein said cooling member-restoring mechanism includes:

cooling means for applying a cooling treatment to said cooling member;

solidified matter-removing means for removing solidified matter adhered to a surface of said cooling member;

coating means for coating said cooling member with a ceramic material; and drying means for applying a drying treatment to said cooling member, wherein said transport means successively transports said cooling member to said cooling means, said solidified matter-removing means, said coating means, and said drying means.

5. The apparatus for producing a metal formed product according to claim 1, further comprising a vessel-restoring mechanism arranged adjacent to said holding furnace and said semisolidified metal-producing mechanism, for applying a restoring treatment for removing adhered metallic matter from said vessel and for resurfacing said vessel.

6. The apparatus for producing said metal formed product according to claim 5, wherein said vessel-restoring mechanism includes:

a holding means capable of holding said vessel disengaged from said articulated robot so that its opening is directed obliquely downwardly; and air nozzles and coating nozzles arranged toward said opening of said vessel.

7. The apparatus for producing said metal formed product according to claim 6, wherein said vessel-restoring mechanism includes first and second holding means capable of simultaneously arranging two of said vessels.

8. The apparatus for producing said metal formed product according to claim 5, wherein said vessel-restoring mechanism includes a tray member for recovering adhered matters removed from an opening of said vessel.

9. The apparatus for producing a metal formed product according to claim 1, wherein said forming mechanism comprises an injection sleeve for introducing said semisolidified metal thereinto, wherein:

said vessel is designed to have substantially the same opening shape as a shape of an opening of said injection sleeve for introducing said semisolidified metal; and a gripping engaging section, with which a gripping mechanism of said articulated robot is engageable, is provided at only one side surface of said vessel.

10. The apparatus for producing said metal formed product according to claim 9, wherein:

said gripping engaging section includes a plate-shaped member secured to said one side surface of said vessel; and said plate-shaped member has two surfaces which are parallel to one another in a depth direction of said vessel, and engaging grooves are formed on said respective surfaces.

11. The apparatus for producing a metal formed product according to claim 1, wherein:

said articulated robot includes a gripping mechanism which is engageable with a gripping engaging section provided at only one side surface of said vessel, said gripping mechanism comprising:

first clamp means for directly gripping said gripping engaging section; and second clamp means for gripping said first clamp means gripping said gripping engaging section, integrally with said vessel.

12. The apparatus for producing said metal formed product according to claim 11, wherein:

said gripping engaging section has two surfaces which are parallel to one another in a depth direction of said vessel, and engaging grooves are formed on said respective surfaces;

said first clamp means includes first and second clamp pawls which are displaceable to make approach to one another to make engagement with said engaging grooves so that said gripping engaging section is gripped; and said second clamp means includes a clamp member for integrally pressing and holding, toward said articulated robot, said first and second clamp pawls gripping said gripping engaging section.

13. The apparatus for producing a metal formed product according to claim 1, wherein said forming mechanism comprises an injection sleeve for introducing said semisolidified metal thereinto, said metal formed product being produced by introducing a solid-liquid co-existing metal into said injection sleeve through an opening of said injection sleeve to produce said metal formed product, said apparatus further comprising:

guide means which is engageable with said opening by making movement back and forth from a position over said opening of said injection sleeve and which is capable of guiding said solid-liquid co-existing metal to said opening; and cover means which is capable of closing said opening by covering said opening of said injection sleeve from an upward position.

14. The apparatus for producing said metal formed product according to claim 13, wherein said cover means includes:

a cover member for closing said opening;

a first actuator for moving said cover member back and forth in a substantially horizontal direction to arrange said cover member at a position over said opening; and a second actuator for moving said cover member upwardly and downwardly to install said cover member to said opening.

15. The apparatus for producing said metal formed product according to claim 14, further comprising a positioning and holding means for positioning and holding said cover member with respect to said opening.

16. The apparatus for producing said metal formed product according to claim 15, wherein said positioning and holding means includes:

a pin provided for said injection sleeve; and a hole provided for said cover member, to which said pin is fitted.

17. The apparatus for producing said metal formed product according to claim 13, wherein said guide means includes:

a sleeve guide having a lower end corresponding to an opening size of said opening, said lower end being constructed to have a narrow width in a diametral direction of said injection sleeve as compared with an upper end; and an elevator means for moving said sleeve guide upwardly and downwardly so that said lower end is engageable with said opening.

18. The apparatus for producing a metal formed product according to claim 1, wherein said forming mechanism comprises:

an injection sleeve for introducing said semisolidified metal thereinto, said metal formed product being produced by introducing a solid-liquid co-existing metal into said injection sleeve through an opening of said injection sleeve which communicates with a cavity, said apparatus further comprising:

a plunger for charging said solid-liquid co-existing metal in said injection sleeve into said cavity; and a cooling medium-jetting mechanism for jetting a cooling medium toward said solid-liquid co-existing metal through said opening.

19. The apparatus for producing said metal formed product according to claim 18, wherein said cooling medium-jetting mechanism includes:

a support block which is movable upwardly and downwardly by the aid of an actuator; and a jetting section which is secured to said support block and to which a plurality of nozzles are installed vertically downwardly.

20. The apparatus for producing said metal formed product according to claim 18, wherein:

said cooling medium-jetting mechanism is provided with a tube; and said tube has a gripping grip which is provided at a first end, and it has a plurality of nozzles which are provided at a second end.

* * * * *